US010724462B2

(12) United States Patent
Burkell et al.

(10) Patent No.: US 10,724,462 B2
(45) Date of Patent: Jul. 28, 2020

(54) SYSTEM AND METHOD FOR A COMPRESSOR

(71) Applicant: General Electric Company, Schenectady, NY (US)

(72) Inventors: Neil William Burkell, Lawrence Park, PA (US); Milan Karunaratne, Lawrence Park, PA (US); David Edward Petersen, Erie, PA (US); Richard C. Peoples, Grove City, PA (US); Jason M. Strode, Greenville, SC (US); Bret Dwayne Worden, Erie, PA (US)

(73) Assignee: General Electric Company, Schenectady, NY (US)

( * ) Notice: Subject to any disclaimer, the term of this patent is extended or adjusted under 35 U.S.C. 154(b) by 251 days.

(21) Appl. No.: 15/704,656

(22) Filed: Sep. 14, 2017

(65) Prior Publication Data

US 2018/0003122 A1 Jan. 4, 2018

Related U.S. Application Data

(63) Continuation-in-part of application No. 13/866,435, filed on Apr. 19, 2013, now Pat. No. 10,233,920, and
(Continued)

(51) Int. Cl.
*F04B 49/02* (2006.01)
*F02D 41/22* (2006.01)
(Continued)

(52) U.S. Cl.
CPC ..... *F02D 41/221* (2013.01); *F01M 13/0011* (2013.01); *F01M 13/028* (2013.01);
(Continued)

(58) Field of Classification Search
CPC ..... F04B 2201/0401; F04B 25/00; F04B 27/053; F04B 41/02; F04B 41/06;
(Continued)

(56) References Cited

U.S. PATENT DOCUMENTS 4,169,432 A * 10/1979 White ..... F01M 13/025 123/41.86
4,502,452 A * 3/1985 Whitehead ..... F16K 7/18 123/572
(Continued)

FOREIGN PATENT DOCUMENTS

DE 102007039793 A1 * 2/2009 ..... G01M 3/26
EP 0417984 A1 * 3/1991 ..... F02D 41/145
WO 2012/070947 A1 5/2012

OTHER PUBLICATIONS

Translation of German Patent DE 102007039793 A1 to Bone et al published on Feb. 26, 2009.*
(Continued)

*Primary Examiner* — Peter J Bertheaud
*Assistant Examiner* — Dnyanesh G Kasture
(74) *Attorney, Agent, or Firm* — The Small Patent Law Group LLC; Mary D. Lawlor

(57) ABSTRACT

Systems and methods (e.g., a method for controlling and/or operating a compressor) are provided that includes the steps of monitoring a crankcase pressure of a first compressor; analyzing the monitored crankcase pressure that includes calculating an average of the crankcase pressure over a time period and comparing the average of the crankcase pressure over the time period to a nominal crankcase average pressure; identifying a condition of the first compressor based on the analysis of the monitored crankcase pressure; and adjusting operation of a second compressor to compensate for the first compressor in response to identifying the condition of the first compressor based on the analysis of the monitored
(Continued)

crankcase pressure. (The method may be carried out automatically or otherwise by a controller).

19 Claims, 30 Drawing Sheets

Related U.S. Application Data a continuation-in-part of application No. 13/866,573, filed on Apr. 19, 2013, now abandoned, and a continuation-in-part of application No. 13/866,499, filed on Apr. 19, 2013, now abandoned, and a continuation-in-part of application No. 13/866,471, filed on Apr. 19, 2013, now Pat. No. 9,771,933.

(60) Provisional application No. 61/636,192, filed on Apr. 20, 2012.

(51) Int. Cl.

| | |
|---|---|
| ***F02D 41/26*** | (2006.01) |
| ***F01M 13/00*** | (2006.01) |
| ***F01M 13/02*** | (2006.01) |
| ***F02D 41/00*** | (2006.01) |
| ***F04B 51/00*** | (2006.01) |
| ***F04B 41/02*** | (2006.01) |
| ***F04B 27/053*** | (2006.01) |
| ***F04B 41/06*** | (2006.01) |
| ***F04B 49/06*** | (2006.01) |
| ***F04B 25/00*** | (2006.01) |

(52) U.S. Cl.

CPC ..... *F02D 41/009* (2013.01); *F02D 41/26* (2013.01); *F04B 25/00* (2013.01); *F04B 27/053* (2013.01); *F04B 41/02* (2013.01); *F04B 41/06* (2013.01); *F04B 49/02* (2013.01); *F04B 49/065* (2013.01); *F04B 51/00* (2013.01); *F01M 2013/0083* (2013.01); *F04B 2201/0401* (2013.01)

(58) Field of Classification Search

CPC ..... F04B 49/02; F04B 49/065; F04B 51/00; F01M 13/0011; F01M 13/028; F01M 2013/0083; F02D 41/221; F02D 41/26; F02D 41/009

See application file for complete search history.

(56) References Cited

U.S. PATENT DOCUMENTS

| | | | | |
|---|---|---|---|---|
| 4,527,520 | A * | 7/1985 | Koch | F01M 9/108 123/196 R |
| 5,768,901 | A * | 6/1998 | Dormer | F04B 49/065 62/175 |
| 6,301,531 | B1 * | 10/2001 | Pierro | B61L 27/0094 701/31.4 |
| 8,725,323 | B2 | 5/2014 | Cooper et al. | |
| 8,984,930 | B2 | 3/2015 | Worden et al. | |
| 9,114,817 | B2 | 8/2015 | Kraeling et al. | |
| 9,550,484 | B2 | 1/2017 | Smith et al. | |
| 2012/0301328 | A1 * | 11/2012 | Adler | F04B 3/00 417/246 |
| 2013/0280095 | A1 | 10/2013 | Worden et al. | |
| 2013/0336810 | A1 | 12/2013 | Worden et al. | |

OTHER PUBLICATIONS

Non-Final Rejection towards U.S. Appl. No. 13/866,435 dated Jun. 7, 2018.

Foy, R. J. et al., "Automated set-up of a distributed power train," GE Co-pending U.S Appl. No. 60/792,428, filed Apr. 17, 2006.

Kellner, S. A. et al., "System and Method for Communicating in a Vehicle Consist," GE Co-pending U.S. Appl. No. 62/049,524, filed Sep. 12, 2014.

* cited by examiner

SYSTEM AND METHOD FOR A COMPRESSOR

CROSS-REFERENCE TO RELATED APPLICATIONS

This application is a continuation-in-part of U.S. patent application Ser. No. 13/866,499, filed on 19 Apr. 2013 (the "'499 Application"), which claims priority to U.S. Provisional Application No. 61/636,192, filed on 20 Apr. 2012 (the "'192 Application").

This application is also a continuation-in-part of U.S. patent application Ser. No. 13/866,435, filed on 19 Apr. 2013 (the "'435 Application"), which claims priority to the '192 Application.

This application is also a continuation-in-part of U.S. patent application Ser. No. 13/866,573, filed on 19 Apr. 2013 (the "'573 Application"), which claims priority to the '192 Application.

This application is also a continuation-in-part of U.S. patent application Ser. No. 13/866,471, filed on 19 Apr. 2013 (the "'471 Application"), which claims priority to the '192 Application.

The entire disclosures of each of these applications is incorporated herein by reference.

TECHNICAL FIELD

Embodiments of the subject matter disclosed herein relate to air compressor diagnostics and facilitating identifying a leak condition of a compressor.

BACKGROUND

Compressors compress gas, such as air. Compressors may be driven by electric motors, and may be air cooled. Some compressors include three cylinders with two stages. For example, a compressor can have two low pressure cylinders which deliver an intermediate pressure air supply to a single high-pressure cylinder for further compression for final delivery to an air reservoir. Compressor and compressor components are subject to various failure modes, which increase difficulties in maintaining a healthy compressor.

It may be desirable to have a system and method that differs from those systems and methods that are currently available.

BRIEF DESCRIPTION

In an embodiment, a method (e.g., a method for controlling and/or operating a compressor) is provided that includes the steps of monitoring a crankcase pressure of a first compressor; analyzing the monitored crankcase pressure that includes calculating an average of the crankcase pressure over a time period and comparing the average of the crankcase pressure over the time period to a nominal crankcase average pressure; identifying a condition of the first compressor based on the analysis of the monitored crankcase pressure; and adjusting operation of a second compressor to compensate for the first compressor in response to identifying the condition of the first compressor based on the analysis of the monitored crankcase pressure. (The method may be carried out automatically or otherwise by a controller.)

In an embodiment, a system comprises a compressor operatively connectable to an engine, wherein the compressor includes a crankcase having a crankcase pressure sensor.

The system further comprises a controller having one or more processors and one or more memories that is configured to receive a signal corresponding to a monitored crankcase pressure within the crankcase of the compressor from the crankcase pressure sensor. The controller is further configured to analyze the monitored crankcase pressure, to identify a condition of the compressor based on the analysis of the monitored crankcase pressure, and to generate an alert in response to identifying the condition of the compressor based on the analysis of the monitored crankcase pressure.

In an embodiment, a system comprises a compressor operatively connectable to an engine that includes a reservoir configured to store compressed air, an aftercooler that is configured to change a temperature of air that is delivered to the reservoir via an air line, and a first drain valve coupled to the aftercooler. The system further comprises a check valve in line between the aftercooler and at least one or the air line or the reservoir. The check valve is configured to isolate air pressure within the aftercooler and air pressure within the at least one of the air line or the reservoir. The system further comprises a controller that is configured to actuate the check valve to isolate air pressure within the aftercooler and air pressure within the at least one of the air line or the reservoir; and actuate the first drain valve coupled to the aftercooler to enable removal of fluid accumulated within the aftercooler.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
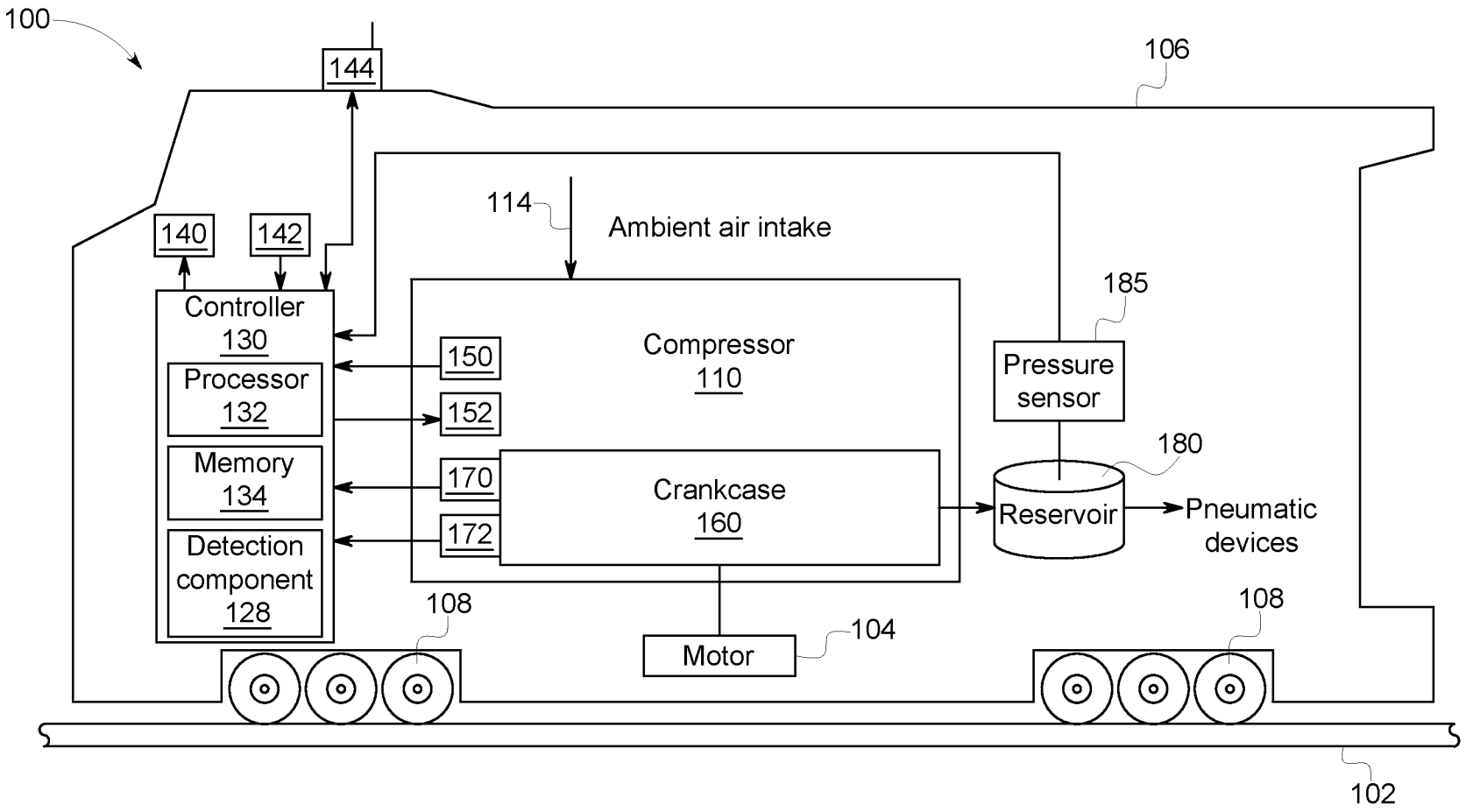
FIG. 1 is an illustration of an embodiment of a vehicle system with a compressor.

One or more embodiments of the subject matter disclosed herein relate to systems and methods that facilitate identifying a leak condition or other condition within a compressor and, in particular, identifying a leak condition by monitoring a crankcase pressure. A controller can be configured to identify a compressor condition based upon the monitored crankcase pressure. Moreover, a crankcase pressure sensor (e.g., also referred to more generally as a detection component) can be configured to monitor crankcase pressure for the compressor, for purposes of detecting a change (e.g., a fluctuation, increase, decrease, among others) in the pressure. Based upon a detected change in the monitored crankcase pressure, the controller can be configured to determine a condition of the compressor. In an embodiment, the controller can be further configured to communicate an alert related to the detected change in the crankcase pressure. The alert can be a signal (e.g., diagnostic code, audio, text, visual, haptic, among others) that indicates a change in the monitored pressure of the crankcase of the compressor. This alert can be utilized to provide maintenance on the compressor or a portion thereof. In an embodiment, the controller can be configured to schedule a maintenance operation based upon the detected change in crankcase pressure and/or the communicated alert in order to perform preventative maintenance. Still further, the controller can be configured to automatically or otherwise control the compressor based on and/or responsive to monitored air pressure.

One or more embodiments of the subject matter disclosed herein relate to systems and methods that facilitate identifying a leak condition within a compressor and, in particular, identifying a leak condition by monitoring a pressure while actuating a piston. A controller can be configured to actuate a piston for a compressor while maintaing pressure within a reservoir. Moreover, a pressure sensor (e.g., also referred to more generally as a detection component) can be configured to monitor pressure in the reservoir, for purpose of detecting a change (e.g., a fluctuation, increase, decrease, among others) in the monitored pressure. Based upon a detected change in the monitored pressure, the controller can be configured to detect a leak condition associated with the detected change in pressure. In an embodiment, the controller can be further configured to communicate an alert related to the detected change in the pressure of the reservoir during the piston actuation. This alert can be utilized to provide maintenance on the compressor or a portion thereof. In an embodiment, the controller can be configured to schedule a maintenance operation based upon the detected change in pressure and/or the communicated alert in order to perform preventative maintenance. Further, the controller may be configured to automatically control the compressor based on a leak condition that is detected, e.g., a duty cycle of the compressor may be automatically reduced.

One or more embodiments of the subject matter disclosed herein relate to systems and methods that facilitate removing fluid from a compressor to mitigate condensation accumulated in the compressor. A controller can be configured to actuate a drain valve coupled to an aftercooler of the compressor and to actuate a check valve to isolate air pressure of the aftercooler from a reservoir of the compressor. Through control of the drain valve of the aftercooler and the check valve, the controller removes fluid from the aftercooler to facitliate thermal management of the compressor. Moreover, a detection component can be configured to monitor at least one of a flow of air from an aftercooler drain valve, a flow from a drain valve, a flow from a discharge line, a flow from an exhaust port of a high-pressure cylinder, among others. Based upon the detection component, the controller can further be configured to determine the presence of a high-pressure cylinder discharge valve leak, based upon a flow from at least one of the check valve or the drain valve to the atmosphere. In an embodiment, the controller can be further configured communicate an alert related to the detected condition (e.g., discharge leak valve, exhaust port leak, among others). The alert can be a signal (e.g., diagnostic code, audio, text, visual, haptic, among others) that indicates a change in the monitored pressure of the intermediate stage of the compressor. This alert can be utilized to provide maintenance on the compressor or a portion thereof. In an embodiment, the controller can be configured to schedule a maintenance operation based upon the detected condition and/or the communicated alert in order to perform preventative maintenance.

One or more embodiments of the subject matter disclosed herein relate to systems and methods that facilitate identifying a leak condition within a compressor and, in particular, identifying a leak condition by monitoring a pressure while actuating an unloader valve. A controller can be configured to actuate an unloader valve for a compressor that maintains pressure within a reservoir. Moreover, a pressure sensor (e.g., also referred to more generally as a detection component) can be configured to monitor pressure for the reservoir to detect a change (e.g., a fluctuation, increase, decrease, among others). Based upon a detected change in the monitored pressure, the controller can be configured to detect a leak condition associated with the detected change in pressure. In an embodiment, the controller can be further configured to communicate an alert related to the detected change in the pressure for the reservoir during the unloader actuation. The alert can be a signal (e.g., diagnostic code, audio, text, visual, haptic, among others) that indicates a change in the monitored pressure of the reservoir of the compressor. This alert can be utilized to provide maintenance on the compressor or a portion thereof. In an embodiment, the controller can be configured to schedule a maintenance operation based upon the detected change in pressure and/or the communicated alert in order to perform preventative maintenance.

With reference to the drawings, like reference numerals designate identical or corresponding parts throughout the several views. However, the inclusion of like elements in different views does not mean a given embodiment necessarily includes such elements or that all embodiments of the invention include such elements.

The term "component" as used herein can be defined as a portion of hardware, a portion of software, or a combination thereof. A portion of hardware can include at least a processor and a portion of memory, wherein the memory includes an instruction to execute. The term "vehicle" as used herein can be defined as any asset that is a mobile machine that transports at least one of a person, people, or a cargo, or that is configured to be portable from one location to another. For instance, a vehicle can be, but is not limited to being, a locomotive or other rail vehicle, an intermodal container, a marine vessel, a mining equipment, a stationary portable power generation equipment, an industrial equipment, a construction equipment, and the like. The term "loaded" as used herein can be defined as a compressor system mode where air is being compressed into the reservoir. The term "loaded start" as used herein can be defined as a compressor system mode in a loaded condition during a starting phase of the compressor. The term "unloaded" as used herein can be defined as a compressor system mode where air is not being compressed into the reservoir.

A compressor compresses gas, such as air. In some embodiments, the compressed gas is supplied to operate pneumatic or other equipment powered by compressed gas. A compressor may be used for mobile applications, such as vehicles. By way of example, vehicles utilizing compressors include locomotives, on-highway vehicles, off-highway vehicles, mining equipment, and marine vessels. In other embodiments, a compressor may be used for stationary applications, such as in manufacturing or industrial applications requiring compressed air for pneumatic equipment among other uses. The compressor depicted in the below figures is one which utilizes spring return inlet and discharge valves for each cylinder, wherein the movement of these valves is caused by the differential pressure across each cylinder as opposed to a mechanical coupling to the compressor crank shaft. The subject invention can be applicable to machines with either type of valve (e.g., spring return valves, mechanical coupled valves, among others) and the spring return valve is depicted solely for example and not to be limiting on the subject innovation.

The components of a compressor may degrade over time resulting in performance reductions and/or eventual failure of a compressor. In vehicle applications, for example, a compressor failure may produce a road failure resulting in substantial costs to the vehicle owner or operator. In this context, a road failure includes a vehicle, such as a locomotive, becoming inoperative when deployed in service as a result of the failure or degradation of a compressor system that prevents operation or requires shutting down the vehicle until repairs can be made. Prior to a total failure, the detection of degraded components or other deterioration of the compressor may be used to identify incipient faults or other conditions indicative of deterioration. In response to detecting such conditions, remedial action may be taken to mitigate the risk of compressor failure and associated costs.

The systems and methods presently disclosed can also be used to diagnose and/or prognose problems in a compressor prior to total compressor failure. If deterioration or degradation of the compressor is detected in the system, action can be taken to reduce progression of the problem and/or further identify the developing problem. In this manner, customers realize a cost savings by prognosing compressor problems in initial stages to reduce the damage to compressor components and avoid compressor failure and unplanned shutdowns. Moreover, secondary damage to other compressor components (e.g., pistons, valves, liners, and the like) or damage to equipment that relies upon the availability of the compressed gas from the compressor may be avoided if compressor problems are detected and addressed at an early stage.

Figure 2:
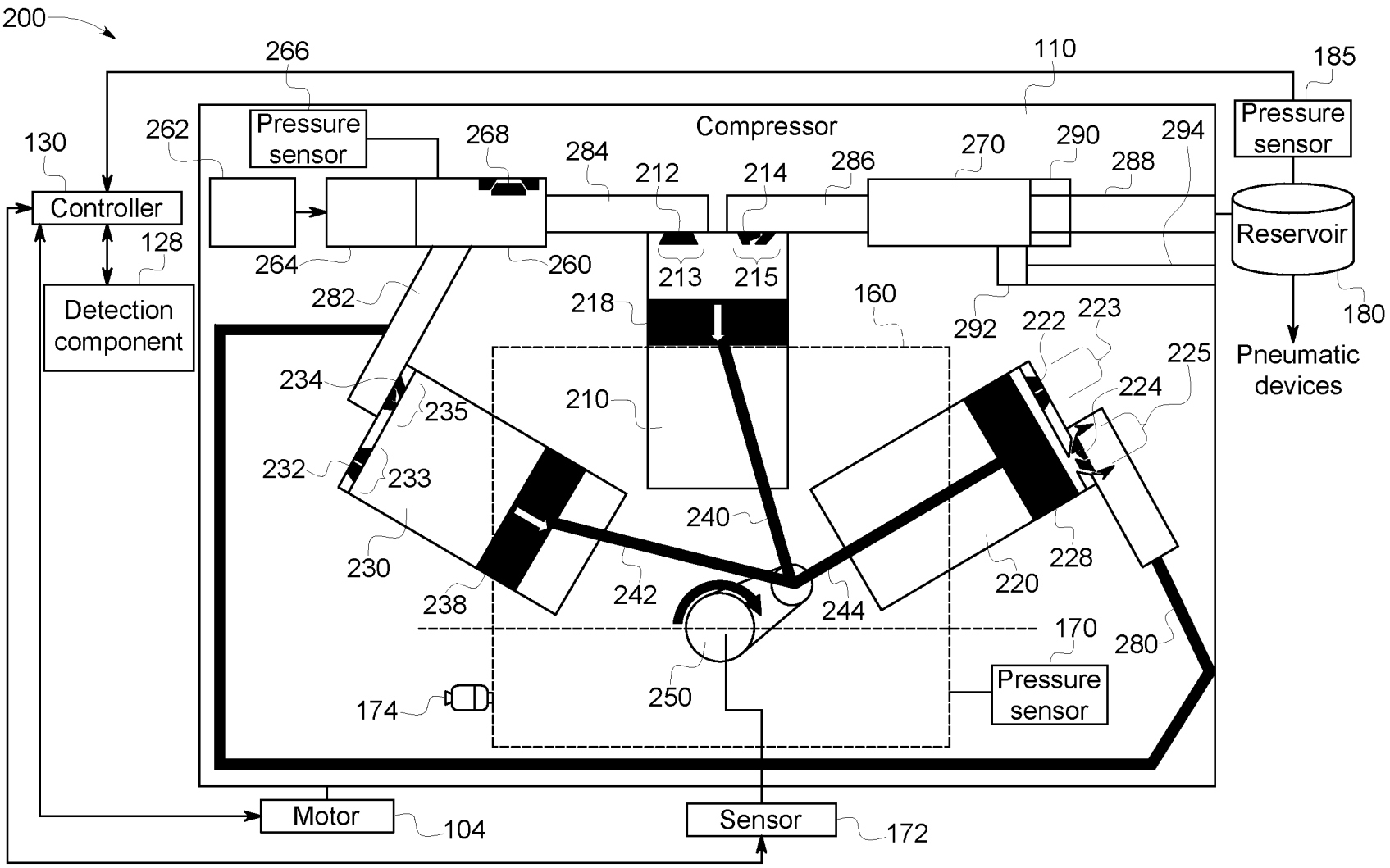
FIG. 2 is an illustration of an embodiment of system that includes a compressor.

FIG. 1 illustrates a block diagram of an embodiment of a vehicle system 100. The vehicle system 100 is depicted as a rail vehicle 106 (e.g., a locomotive) configured to run on a rail 102 via a plurality of wheels 108. The rail vehicle includes a compressor system with a compressor 110. In an embodiment, the compressor is a reciprocating compressor that delivers air at high-pressure. In another embodiment, the compressor is a reciprocating compressor with a bi-directional drive system that drives a piston in a forward direction and the reverse direction. In an embodiment, the compressor receives air from an ambient air intake 114. The air is then compressed to a pressure greater than the ambient pressure and the compressed air is stored in reservoir 180, which is monitored by a reservoir pressure sensor 185. In one embodiment, the compressor is a two-stage compressor (such as illustrated in FIG. 2) in which ambient air is compressed in a first stage to a first pressure level and delivered to a second stage, which further compresses the air to a second pressure level that is higher than the first pressure level. The compressed air at the second pressure level is stored in a reservoir. The compressed air may then be provided to one or more pneumatic devices as needed. In an embodiment, the compressor system may include two or more compressors 110. In other embodiments, the compressor 110 may be a single stage or multi-stage compressor.

The compressor includes a crankcase 160. The crankcase is an enclosure for a crankshaft (not shown in FIG. 1) connected to cylinders (not shown in FIG. 1) of the compressor. A motor 104 (e.g., electric motor) is employed to rotate the crankshaft to drive the pistons within the cylinders. In another embodiment, the crankshaft may be coupled to a drive shaft of an engine or other power source configured to rotate the crankshaft of the compressor. In each embodiment, the crankshaft may be lubricated with compressor oil that is pumped by an oil pump (not shown) and sprayed onto the crankshaft. The crankshaft is mechanically coupled to a plurality of pistons via respective connecting rods. The pistons are drawn and pushed within their respective cylinders as the crankshaft is rotated to compress a gas in one or more stages.

The rail vehicle further includes a controller 130 for controlling various components related to the vehicle system. In an embodiment, the controller is a computerized control system with a processor 132 and a memory 134. The memory may be computer readable storage media, and may include volatile and/or non-volatile memory storage. In an embodiment, the controller includes multiple control units and the control system may be distributed among each of the control units. In yet another embodiment, a plurality of controllers may cooperate as a single controller interfacing with multiple compressors distributed across a plurality of vehicles. Among other features, the controller may include instructions for enabling on-board monitoring and control of vehicle operation. Stationary applications may also include a controller for managing the operation of one or more compressors and related equipment or machinery.

In an embodiment, the controller receives signals from one or more sensors 150 to monitor operating parameters and operating conditions, and correspondingly adjust actuators 152 to control operation of the rail vehicle and the compressor. In various embodiments, the controller receives signals from one or more sensors corresponding to compressor speed, compressor load, boost pressure, exhaust pressure, ambient pressure, exhaust temperature, or other parameters relating to the operation of the compressor or surrounding system. In another embodiment, the controller receives a signal from a crankcase pressure sensor 170 that corresponds to the pressure within the crankcase. In yet another embodiment, the controller receives a signal from a crankshaft position sensor 172 that indicates a position of the crankshaft. The position of the crankshaft may be identified by the angular displacement of the crankshaft relative to a known location such that the controller is able to identify the position of each piston within its respective cylinder based upon the position of the crankshaft. In some embodiments, the controller controls the vehicle system by sending commands to various components. On a locomotive, for example, such components may include traction motors, alternators, cylinder valves, and throttle controls among others. The controller may be connected to the sensors and actuators through wires that may be bundled together into one or more wiring harnesses to reduce space in vehicle system devoted to wiring and to protect the signal wires from abrasion and vibration. In other embodiments, the controller communicates over a wired or wireless network that may allow for the addition of components without dedicated wiring.

The controller may include onboard electronic diagnostics for recording operational characteristics of the compressor. Operational characteristics may include measurements from sensors associated with the compressor or other components of the system. Such operational characteristics may be stored in a database in memory. In one embodiment, current operational characteristics may be compared to past operational characteristics to identify trends of compressor performance.

The controller may include onboard electronic diagnostics for identifying and recording potential degradation and failures of components of vehicle system. For example, when a potentially degraded component is identified, a diagnostic code may be stored in memory. In one embodiment, a unique diagnostic code may correspond to each type of degradation that may be identified by the controller. For example, a first diagnostic code may indicate a malfunctioning exhaust valve of a cylinder, a second diagnostic code may indicate a malfunctioning intake valve of a cylinder, a third diagnostic code may indicate deterioration of a piston or cylinder resulting in a blow-by condition. Additional diagnostic codes may be defined to indicate other deteriorations or failure modes. In yet other embodiments, diagnostic codes may be generated dynamically to provide information about a detected problem that does not correspond to a predetermined diagnostic code. In some embodiments, the controller modifies the output of charged air from the compressor, such as by reducing the duty cycle of the compressor, based on parameters such as the condition or availability of other compressor systems (such as on adjacent locomotive engines), environmental conditions, and overall pneumatic supply demand.

The controller may be further linked to display 140, such as a diagnostic interface display, providing a user interface to the operating crew and/or a maintenance crew. The controller may control the compressor, in response to operator input via user input controls 142, by sending a command to correspondingly adjust various compressor actuators. Non-limiting examples of user input controls may include a throttle control, a braking control, a keyboard, and a power switch. Further, operational characteristics of the compressor, such as diagnostic codes corresponding to degraded components, may be reported via display to the operator and/or the maintenance crew.

The vehicle system may include a communications system 144 linked to the controller. In one embodiment, communications system may include a radio and an antenna for transmitting and receiving voice and data messages. For example, data communications may be between vehicle system and a control center of a railroad, another locomotive, a satellite, and/or a wayside device, such as a railroad switch. For example, the controller may estimate geographic coordinates of a vehicle system using signals from a GPS receiver. As another example, the controller may transmit operational characteristics of the compressor to the control center via a message transmitted from communications system. In one embodiment, a message may be transmitted to the command center by communications system when a degraded component of the compressor is detected and the vehicle system may be scheduled for maintenance.

As discussed above, the term "loaded" refers to a compressor mode where air is being compressed into the reservoir. The compressor depicted is one which utilizes spring return inlet and discharge valves for each cylinder in which the movement of these valves is caused by the differential pressure across them as opposed to a mechanical coupling to the compressor crank shaft. The subject disclosure may be applicable to machines with either type of valve, but the spring return type will be illustrated here for the sake of brevity.

The controller can be configured to adjust at least one of the following: an operation of the compressor; a scheduled maintenance for the compressor; a maintenance for the compressor; a service for the compressor; a diagnostic code of the compressor; an alert for the compressor; an actuation of a drain valve; an actuation of a check valve; among others. In an embodiment, the controller can be configured to adjust the compressor based upon a detection of a change in pressure for the crankcase. In a more particular embodiment, the controller can be configured to adjust the compressor based upon a monitored change in pressure in combination with a position of a piston of the compressor. In an embodiment, the controller can be configured to adjust the compressor based upon a detection of a change in pressure for the reservoir during an actuation of the piston. In a more particular embodiment, the controller can be configured to adjust the compressor based upon a monitored change in pressure in combination with a position of a piston of the compressor.

In an embodiment, the controller can be configured to actuate a drain valve of an aftercooler for a compressor and a check valve that isolates the aftercooler from a reservoir of the compressor. In a more particular embodiment, the controller can be configured to identify a leak condition based upon a flow associated with a drain valve of the aftercooler. For instance, the controller can actuate the check valve to isolate pressure and actuate the drain valve of the aftercooler at the substantially same time to remove fluid from the aftercooler without losing pressure in the reservoir of the compressor. Moreover, the flow of the drain valve of the aftercooler and/or a discharge line (discussed in more detail below) can be monitored to determine a leak condition of a compressor or determine a potential leak condition of a compressor. In such case, an alert can be generated for the compressor.

In an embodiment, the controller can be configured to adjust the compressor based upon a detection of a change in pressure for the reservoir. In a more particular embodiment, the controller can be configured to adjust the compressor based upon a monitored change in pressure in combination with a position of an unloader valve of the compressor.

The compressor 110 can include a detection component 128 that can be configured to detect at least one of a pattern, a signature, a level, among others related to a crankcase pressure measured, wherein such detection is indicative of a leak condition for the compressor. In particular, the leak condition can relate to crankcase breather valve or blow-by condition (discussed in more detail below). The detection component and/or the pressure sensor (e.g., pressure sensor 170) can be employed with the compressor to collect pressure data that is indicative of a leak condition. In an embodiment, the controller can be configured to adjust the compressor based upon the detection component and/or the pressure sensor.

In an embodiment, the detection component 128 that can be configured to detect at least one of a pattern, a signature, a level, among others related to a pressure measured, wherein such detection is indicative of a leak condition for the compressor. In particular, the leak condition can relate to a leak (e.g., exhaust valve leak, among others) from the reservoir of the compressor (discussed in more detail below).

In an embodiment, the detection component 128 that can be configured to detect at least one of a flow of a drain valve or a flow of a discharge line, wherein such detection is indicative of a leak condition for the compressor (discussed in more detail below). The detection component can be employed with the compressor to collect data that is indicative of a condition such as exhaust port leak, high-pressure cylinder discharge valve leak, among others. In an embodiment, the controller can be configured to adjust the compressor based upon the detection component.

In an embodiment, the detection component 128 that can be configured to detect at least one of a pattern, a signature, a level, among others related to a pressure measured, wherein such detection is indicative of a leak condition for the compressor. In particular, the leak condition can relate to a leak from the reservoir of the compressor (discussed in more detail below). The detection component and/or the pressure sensor (e.g., pressure sensor 185) can be employed with the compressor to collect data that is indicative of a leak condition. In an embodiment, the controller can be configured to adjust the compressor based upon the detection component and/or the pressure sensor.

The detection component can be a stand-alone component (as depicted), incorporated into the controller component, or a combination thereof. The controller component can be a stand-alone component (as depicted), incorporated into the detection component, or a combination thereof. In another embodiment, the detection component and/or the pressure sensor can be a stand-alone component (as depicted), incorporated into the controller component, or a combination thereof.

FIG. 2 illustrates a detailed view of a system 200 of the compressor set forth in FIG. 1 above. The compressor includes three cylinders 210, 220, 230. Each cylinder contains a piston 218, 228, 238 that is coupled to a crankshaft 250 via connecting rods 240, 242, 244. The crankshaft is driven by the motor to cyclically pull the respective pistons to a Bottom-Dead-Center (BDC) and push the pistons to a Top-Dead-Center (TDC) to output charged air, which is delivered to the reservoir via air lines 280, 282, 284, 286. In this embodiment, the compressor is divided into two stages: a low pressure stage and a high-pressure stage to produce charged air in a stepwise approach. The low pressure stage compresses air to a first pressure level which is further compressed by the high-pressure stage to a second pressure level. In this example, the low pressure stage includes cylinders 220, 230 and the high-pressure stage includes cylinder 210.

In operation, air from the ambient air intake is first drawn into the low pressure cylinders via intake valves 222, 232, which open and close within intake ports 223, 233. The ambient air is drawn in as the low pressure cylinders are pulled towards BDC and the intake valves 222, 232 separate from intake ports 223, 233 to allow air to enter each cylinder 220, 230. Once the pistons reach BDC, the intake valves 222, 232 close the intake ports 223, 233 to contain air within each cylinder. Subsequently, pistons 228, 238 are pushed toward TDC, thereby compressing the ambient air initially drawn into the cylinders. Once the cylinders have compressed the ambient air to a first pressure level, exhaust valves 224, 234 within exhaust ports 225, 235 are opened to release the low pressure air into low pressure lines 280, 282.

The air compressed to a first pressure level is routed to an intermediate stage reservoir 260. The intermediate stage reservoir 260 received air from one stage of a multistage compressor and provides the compressed air to a subsequent stage of a multistage compressor. In an embodiment, the intermediate stage reservoir 260 is a tank or other volume connected between successive stages by air lines. In other embodiments, the air lines, such as low pressure lines 280, 282 provide sufficient volume to function as an intermediate stage reservoir without the need for a tank or other structure.

In an embodiment, the compressor system also includes an intercooler 264 that removes the heat of compression through a substantially constant pressure cooling process. One or more intercoolers may be provided along with one or more intercooler controllers 262. In some embodiments, the intercooler 264 is integrated with the intermediate stage reservoir 260. A decrease in the temperature of the compressed air increases the air density allowing a greater mass to be drawn into the high-pressure stage increasing the efficiency of the compressor. The operation of the intercooler is controlled by the intercooler controller 262 to manage the cooling operation. In an embodiment, the intercooler controller 262 employs a thermostatic control through mechanical means such as via thermal expansion of metal.

In a multistage compressor system having more than two stages, an intercooler may be provided at each intermediate stage.

The air at a first pressure level (e.g., low pressure air) is exhausted from the intercooler into low pressure air line 284 and subsequently drawn into the high-pressure cylinder 210. More particularly, as piston 218 is pulled toward BDC, the intake valve 212 opens, thereby allowing the low pressure air to be drawn into the cylinder 210 via intake port 213. Once the piston 218 reaches BDC, the intake valve 212 closes to seal the low pressure air within the cylinder 210. The piston is then pushed upward thereby compressing the low pressure air into high-pressure air. High-pressure air is air at a second pressure level greater than the first pressure level, however the amount of compression will vary based upon the requirements of the application. As compression increases, the exhaust valve 214 is opened to allow the high-pressure air to exhaust into high-pressure line 286 via exhaust port 215. An aftercooler 270 cools the high-pressure air to facilitate a greater density to be delivered to the reservoir via high-pressure air line 288.

The above process is repeated cyclically as the crankshaft 250 rotates to provide high-pressure air to the reservoir 180, which is monitored by the reservoir pressure sensor 185. Once the reservoir reaches a particular pressure level (e.g., 140 psi), the compressor operation is discontinued.

In some embodiments, the compressor includes one or more valves configured to vent compressed air from intermediate stages of the compressor system. The unloader valves and/or relief valves may be operated after compressor operations are discontinued, or may be operated during compressor operations to relieve pressure in the compressor system. In an embodiment, an unloader valve 268 is provided in the intermediate stage reservoir 260 and configured to vent the low pressure compressed air from the intermediate stage reservoir, low pressure air lines 280, 282 and intercooler 264. Venting compressed air reduces stress on system components during periods when the compressor is not in use and may extend the life of the system. In another embodiment, the unloader valve 268 operates as a relief valve to limit the buildup of pressure in the intermediate stage reservoir 260. In yet another embodiment, intake valves 222, 232 operate as unloader valves for the cylinders 220, 230 allowing compressed air in the cylinders to vent back to the ambient air intake 114. In another embodiment, the system 200 can include relief valves such as breather valve 174, a relieve valve on the intercooler 264 (shown in FIG. 2), a relieve valve for air line 286, a rapid unloader valve on the intercooler 264 (shown in FIG. 2)

A compressor, such as the compressor illustrated in FIG. 2, operates to charge the reservoir 180 with compressed air or other gas. Once the compressor charges the reservoir to a determined pressure value the compressor operation is discontinued. In some embodiments, when compressor operations are discontinued, one or more unloader valves are opened to vent intermediate stages of the compressor to the atmosphere. The intake valves of the cylinders as well as unloader valves of the intermediate stage reservoirs may all operate as unloader valves to vent the cylinders of the compressor to the atmosphere. Once the unloader valves are actuated and the cylinders and intermediate stages of the compressor have been vented to the atmosphere the pressure within the reservoir is expected to remain constant as previously discussed.

The compressor 110 can include additional features and/or components that are not illustrated in FIGS. 1 and 2. For instance, the system may include a Control Mag Valve (CMV), a Thermostatically Controlled Intercooler System (TCIS) bypass, a rapid unloader valve, an unloader valve for cylinder 230, an unloader valve for cylinder 220, a relief valve(s), among others.

The crankshaft can include a first end opposite a second end in which the first end is coupled to one or more connecting rods for each respective cylinder. The crankshaft, cylinders, and pistons are illustrated in BDC position based upon the location of the first end. BDC position is a location of the first end at approximately negative ninety degrees (−90 degrees) or 270 degrees. It is to be appreciated that the first end is illustrated in FIG. 2 at approximately thirty degrees (30 degrees). A TDC position is a location of the first end at approximately ninety degrees (90 degrees) or −270 degrees.

In one or more embodiments, the controller can be configured to employ an adjustment to the compressor based upon at least one of a detected change of pressure in the crankcase or a detected change of pressure in the crankcase correlated with a position of a piston. In one embodiment, the pressure sensor can monitor a pressure for the crankcase with or without a cycling of a piston. Upon detection of a change in the pressure of the crankcase, the controller can implement an adjustment to the compressor and/or communicate an alert based on the detected change.

Referring now to FIGS. 3-6, an embodiment of a method and/or employment of a system for a compressor is illustrated. In an embodiment, a method for a compressor includes monitoring a crankcase pressure of a compressor, analyzing the monitored crankcase pressure, and identifying a condition of the compressor based on the analysis of the monitored crankcase pressure. When a reciprocating compressor is operating, such as the compressor 110 shown in FIG. 2, the crankshaft 250 rotates causing the pistons 218, 228, 238 to move within their respective cylinders. As the pistons move through each revolution, the effective volume of the crankcase 160 changes.

Figure 3:
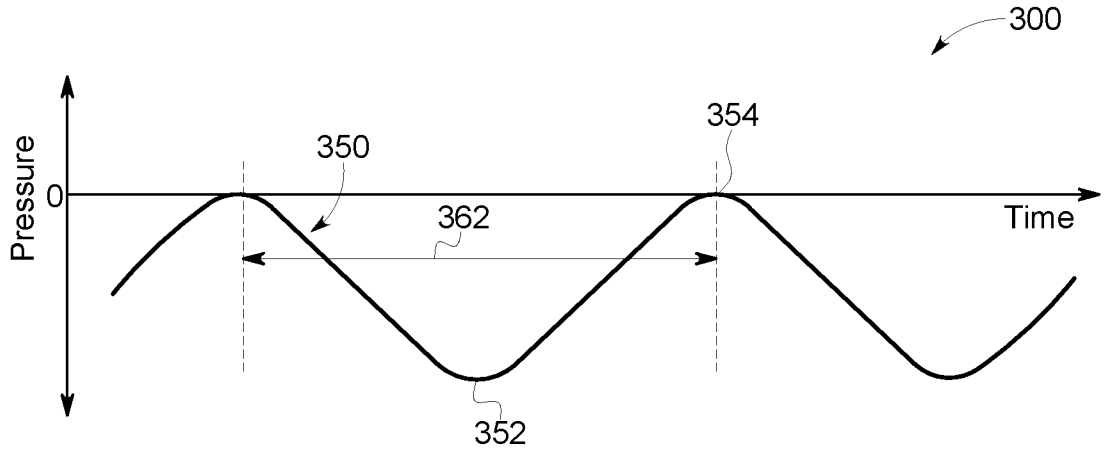
FIG. 3 is a graph depicting a measured crankcase pressure for a compressor.

For ease of illustration, a crankcase pressure 350 of a single stage compressor having only one cylinder, such as cylinder 210, is illustrated in graph 300 of FIG. 3. As the piston rises on a compression stroke the effective volume of the crankcase increases (e.g., due to the volume of the piston leaving the crankcase) resulting in a drop in crankcase pressure as measured by a crankcase pressure sensor, such as crankcase pressure sensor 170. The crankcase pressure 350 falls until the piston reaches top dead center at which point the crankcase pressure reaches a minimum as shown by a trough 352. As the piston moves through a suction stroke the effective volume of the crankcase is reduced resulting in an increase in crankcase pressure. The crankcase pressure 350 rises until the piston reaches bottom dead center at which point the crankcase pressure reaches a peak 354. As illustrated in FIG. 3, crankcase pressure rises and falls corresponding to the position of the piston within the cylinder with a period 362 corresponding to one revolution of the piston. In a multistage compressor, such as a compressor having two or more cylinders, the movement of each piston affects the crankcase pressure in a similar manner. In the compressor illustrated in FIG. 2, each of the three pistons 218, 228, 238 would produce similar periodic pressure variations that would be offset from each other depending upon the configuration of the crankshaft. The corresponding crankcase pressure would therefore reflect multiple peaks and troughs correlated to the positions of one, two or more pistons of the compressor. In multi-stage compressor, the crankcase pressure may be correlated with an indication of the position of one or more of the pistons to identify the effect that each piston has on the crankcase pressure. Using the correlation, a condition of one of the plurality of cylinders of the compressor may be determined.

As shown in graph 300 of FIG. 3, in a healthy compressor system the crankcase pressure 350 is typically maintained below atmospheric pressure, which is indicated as "0". In various embodiments, the compressor includes a crankcase breather valve, such as breather valve 174 in FIG. 2, which regulates crankcase pressure by permitting air to exit the crankcase when crankcase pressure rises and limiting air entering the crankcase when crankcase pressure falls. In this manner, excessive pressure within the crankcase is avoided so as to improve the efficiency of the compressor system. As a result, the average crankcase pressure during operation of the compressor system is maintained in the desired range.

In one embodiment, analyzing the monitored crankcase pressure includes calculating an average of the crankcase pressure over a time period and comparing the average crankcase pressure to a nominal crankcase average pressure. The condition of the compressor may then be determined (e.g., identified) based on the difference between the calculated crankcase average pressure and the nominal crankcase average pressure. In an embodiment, the nominal crankcase average pressure is the expected average pressure based upon the design of the compressor and crankcase. The nominal crankcase average pressure may be determined from empirical tests to establish a baseline when the compressor is new or otherwise known to be operating correctly. The baseline may be stored in memory and compared to the actual crankcase average pressure periodically to monitor compressor operations. In yet another embodiment, the nominal crankcase average pressure is calculated based upon environmental or operating conditions. For example, in some designs the crankcase pressure may vary based on ambient air temperature or ambient air pressure. The nominal crankcase average pressure may thus be adjusted to account for such environmental conditions. In other embodiments, one or more of the compressor operating speed, the reservoir pressure or the compressor oil temperature are correlated to the nominal or expected crankcase average compressor. In yet other embodiments, the nominal crankcase pressure is a predetermined limit which if exceeded requires compressor operation to be discontinued. The nominal crankcase average pressure may therefore be determined from at least one or more of these or other environmental or operating parameters of the compressor.

In a healthy compressor system, the crankcase average pressure and correlation of the crankcase pressure to the position of the piston may remain substantially constant as illustrated in graph 300 of FIG. 3. The failure or degradation of the breather valve however may interfere with the proper regulation of crankcase pressure. If the breaker valve becomes clogged, air is not released as crankcase pressure rises resulting in a shift in the measured crankcase pressure, such as illustrated in graph 400 of FIG. 4. As shown, the periodic peaks 360 and troughs 358 correlated with piston movement are still detectable in a measured crankcase pressure 356 (also referred to as crankcase pressure 356). The crankcase average pressure however rises as the breather valve is unable to vent the excess pressure within the crankcase. In this manner, a crankcase breather valve failure is identified by the increased average pressure, and appropriate maintenance or repair operations may be scheduled. Over time, the increased crankcase average pressure may result in damage to the seals and other components of the compressor system, and if unchecked could render the compressor system inoperative. Increased crankcase pressure may also reduce the efficiency of the compressor system by pushing against each piston as the piston is pulled through its suction stroke increasing the load on the motor 104 or other power source driving the crankshaft 250.

In other embodiments, a method for a compressor that includes monitoring the crankcase pressure is used to identify other compressor failure modes. In one embodiment, a condition of one of a plurality of cylinders is identified based on the correlation of the monitored crankcase pressure and the indication of the position of the piston in the cylinder of a reciprocating compressor. During operation, air is compressed within the cylinder as the piston travels through a compression stroke to fill the reservoir 180 with compressed air. In order to maintain efficient operation, the volume of the cylinder in which compression occurs is substantially sealed, such as with a lining or seal may be used to limit leakage of air as the piston travels within the cylinder.

Figure 5:
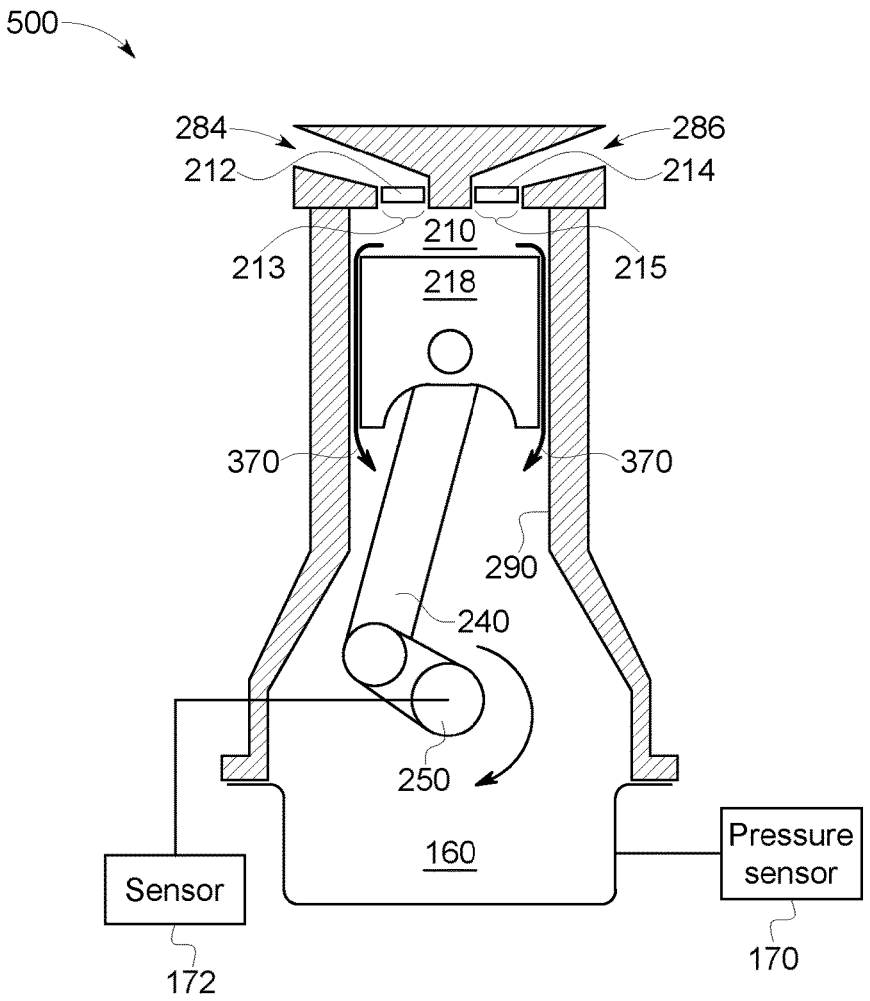
FIG. 5 is an illustration of an embodiment of a system that includes a compressor.

Referring now to system 500 of FIG. 5, the high-pressure cylinder 210 of FIG. 2 is illustrated during a compression stroke. During at least a portion of the compression stroke of the piston 218, the intake valve 212 is closed sealing the intake port 213, and the exhaust valve 214 is closed sealing the exhaust port 215. With the intake and exhaust ports sealed, the internal volume of the cylinder 210 is expected to be substantially sealed such that the air within the cylinder can be compressed. As a result of wear between the piston 218 and a cylinder inner wall or other degradation in the lining or seals used to maintain the closed volume, air may leak between the piston 218 and the cylinder inner wall into the crankcase 160 as illustrated by arrows 370. Wear of the piston or cylinder wall may result from a variety of problems, such as misalignment of the piston or operating without sufficient lubricating oil or at excessive oil temperatures. In addition, seals or cylinder linings may degrade as a result of excess crankcase pressure, such as may be caused by the failure of a breather valve as previously discussed. Regardless of the underlying cause, a piston blow-by condition develops when air escapes from the cylinder 210 passed the piston 218 and into the crankcase 160 (as illustrated by arrows 370).

Figure 6:
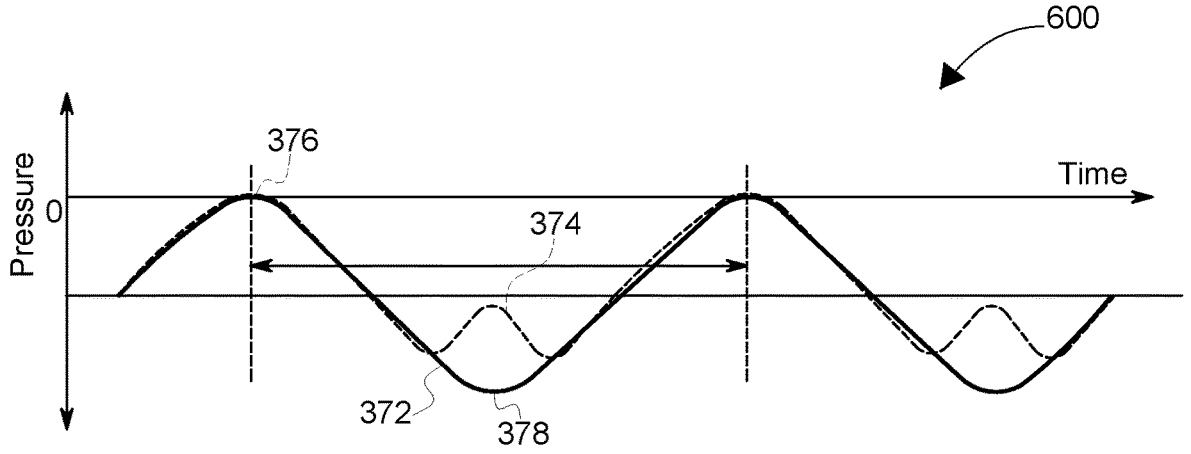
FIG. 6 is a graph depicting a measured crankcase pressure for a compressor.

The flow of air into the crankcase resulting from a piston blow-by condition affects the crankcase pressure measured by the crankcase pressure sensor 170. By way of illustration, graph 600 of FIG. 6 illustrates a healthy crankcase pressure 372 analogous to that illustrated in graph 300 of FIG. 3. When a cylinder has been degraded, the crankcase pressure may develop a blow-by indication 374. In one embodiment, the blow-by indication 374 is an increase in measured crankcase pressure during the compression stroke of a piston. Using crankshaft position sensor 172, the position of each piston may be determined such that the compression stroke of each position is identified. By correlating the identified blow-by condition 374 with the compression stroke of a given piston, a blow-by condition of a given cylinder is identified. The identification of a specific cylinder in which the blow-by condition is occurring facilitates repairs and improves the efficiency of maintenance operations.

In addition to identifying the existence of a blow-by condition, the severity of the blow-by condition may be assessed. As illustrated in graph 600 of FIG. 6, a blow-by condition may present as an increase in crankcase pressure during a compression stroke. In other embodiments where the blow-by condition is less severe, the blow-by indication may be a reduction in the decrease of crankcase pressure during a compression stroke. Stated another way, a reduction in the difference between the peaks 376 and troughs 378 of the measured crankcase pressure may indicate a blow-by condition even if the crankcase pressure does not rise during the compression stroke.

Figure 4:
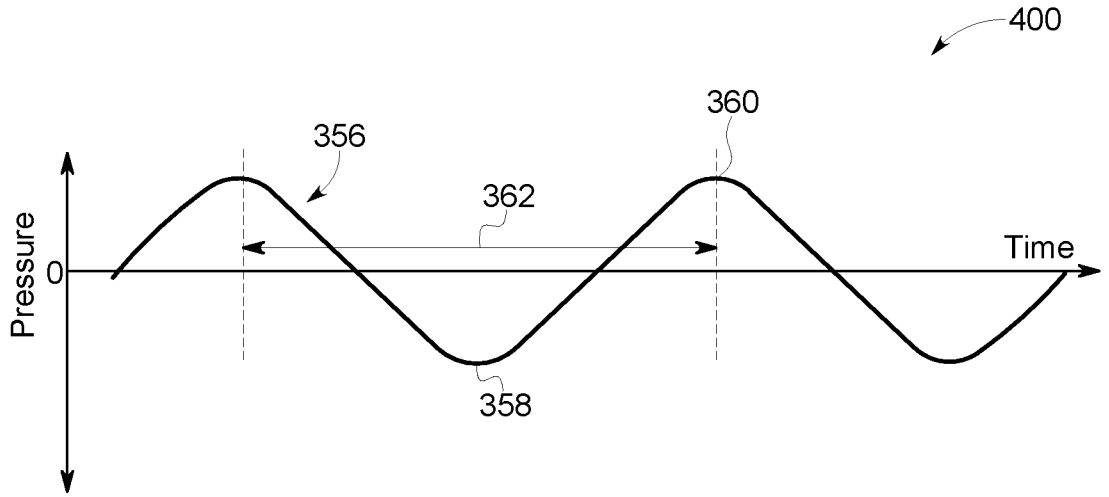
FIG. 4 is a graph depicting a measured crankcase pressure for a compressor.

The illustrations of monitored crankcase pressure in graphs 300, 400, and 600 in FIGS. 3-4, and 6 respectively, demonstrate the effects of a single cylinder. In compressor systems having two or more cylinders, each cylinder produces a similar effect on crankcase pressure such that the resulting crankcase pressure reflects the combination of those effects. In another embodiment, the monitored crankcase pressure is analyzed by identifying the frequency content of the monitored crankcase pressure at one or more known frequencies. The known frequencies are determined based on the rate at which the compressor is operated. As noted above, the monitored crankcase pressure is expected to rise and fall as the piston cycles within the cylinder. The monitored crankcase pressure thus includes a periodic variation that corresponds to a once-per-revolution signature associated with the movement of the piston. As shown in graph 600 of FIG. 6, a piston blow-by condition may produce an additional peak 374 (also referred to as a blow-by condition). The blow-by condition is therefore identifiable in a frequency analysis based upon the rate at which the compressor is operated. In one embodiment, the blow-by condition may result in a detectable change in the once-per-revolution signature. In other embodiments, the blow-by condition may result in a detectable twice-per-revolution signature. A range of frequency components related to the compressor operating speed may also be generated as the crankcase pressure is affected by one or more pistons, one or more blow-by conditions, breather valve failures, or other effects during operation of the compressor. In this manner, a frequency analysis of the monitored crankcase pressure is used to determine (e.g., identify) the condition of the compressor. The frequency analysis may be used in addition or as an alternative to time domain analysis of the monitored crankcase pressure. To further assist in identifying faults, crankcase pressure is monitored under different operating conditions, such as at different reservoir pressure levels, and when the pistons are cycled under loaded and unloaded conditions. In this manner, the methods for a compressor presently disclosed provide advanced detection of faults and facilitate troubleshooting and repair by identifying the nature of the failure and the likely components at fault.

In yet another embodiment, a controller is provided to determine a condition of a compressor. The controller is configured to receive a signal corresponding to a monitored pressure within a crankcase of a compressor. In an embodiment, the controller is configured to communicate with one or more crankcase pressure sensors 170 and receive the signal corresponding to the monitored pressure from the one or more crankcase pressure sensors. The controller is also configured to analyze the monitored crankcase pressure and determine a condition of the compressor based on the analysis of the monitored crankcase pressure. In one embodiment, the controller performs a frequency analysis and identifies frequency components in the monitored crankcase pressure based upon the rate at which the compressor is operated.

In another embodiment, the controller correlates the monitored crankcase pressure with an indication of a position of a piston in a cylinder of the compressor. The controller may communicate with the crankshaft position sensor 172 to determine the position of the piston in the cylinder. In an embodiment, the controller is integral with a vehicle system, such as controller 130. In yet another embodiment, the controller is provided with a test kit used for maintenance and repair or diagnostic operations. In this manner, the controller may be further configured to actuate the compressor in either a loaded or unloaded condition while monitoring crankcase pressure. In embodiments, the controller is able to identify a blow-by condition of at least one cylinder of the compressor and identity a crankcase breather valve failure by analyzing the measured crankcase pressure as described above. The controller may include a processor and may be configured to calculate an average of the crankcase pressure over a time period, and compare the average crankcase pressure over the time period to a nominal crankcase average pressure. In some embodiments, the time period is determined by the operator, however in other embodiments, the time period is determined by the controller based on operating conditions of the compressor. In some applications, the measured crankcase pressure will also be influenced by vibrations and noise from related system components. By averaging the measured crankcase pressure over a time period, such influences may be reduced providing a more accurate assessment of crankcase pressure.

When a fault is detected, such as a blow-by condition or a breather valve failure, a variety of steps may be taken to reduce further degradation of the compressor system. In one embodiment, a signal is generated in response to determining a condition of the compressor based on the analysis of the monitored crankcase pressure. The generated signal may indicate a severity level of the condition, such as the severity of a blow-by condition as indicated by the rise in crankcase pressure during a compression stroke of a piston. In an embodiment, in response to the signal, the duty cycle of the compressor is reduced in order to reduce further degradation of the compressor until repairs can be made. The duty cycle may be reduced by a fixed amount, such as by 25%, 50% or more, or may be reduced in proportion to the severity of the identified failure. If the leak condition is severe, power to the compressor may be disconnected such that the compressor ceases operating until appropriate repairs have been effected. In another embodiment, personnel are notified by an audio alarm, a visual alarm, a text message, an email, an instant message, a phone call, or other method appropriate for the operating environment. In a system having multiple compressors, in response to a detected leak on one compressor the operation of the other compressors may be adjusted to compensate for the reduced performance of one compressor allowing the system to remain functional until repairs can be scheduled.

In one or more embodiments, the controller can be configured to employ an adjustment to the compressor based upon at least one of a detected change of pressure in the reservoir or a detected change of pressure in the reservoir during an actuation of piston. In embodiment, the pressure sensor can monitor a pressure for the reservoir with or without a cycling of a piston. Upon detection of a change in the pressure, the controller can implement an adjustment to the compressor and/or communicate an alert based on the detected change.

Figure 8:
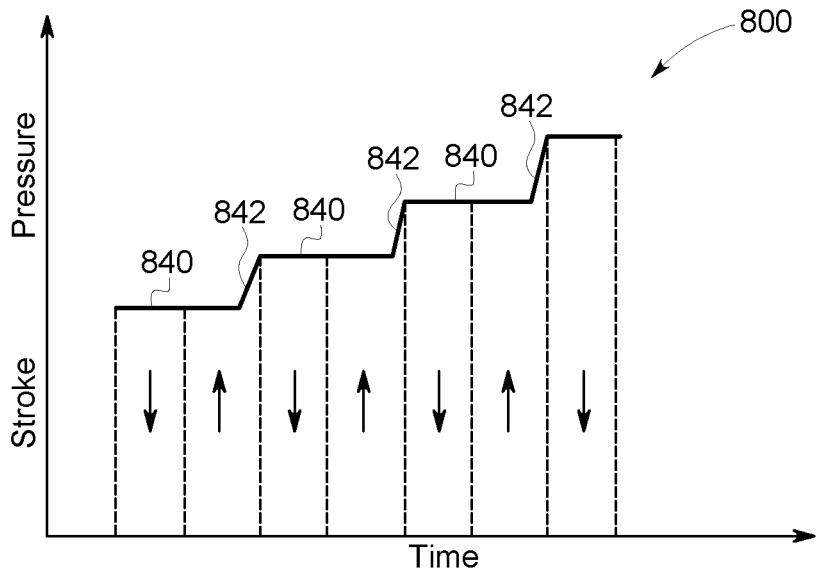
FIG. 8 is a graph that illustrates a measured pressure over time with indication of a compression stroke or a suction stroke for a compressor.
Figure 9:
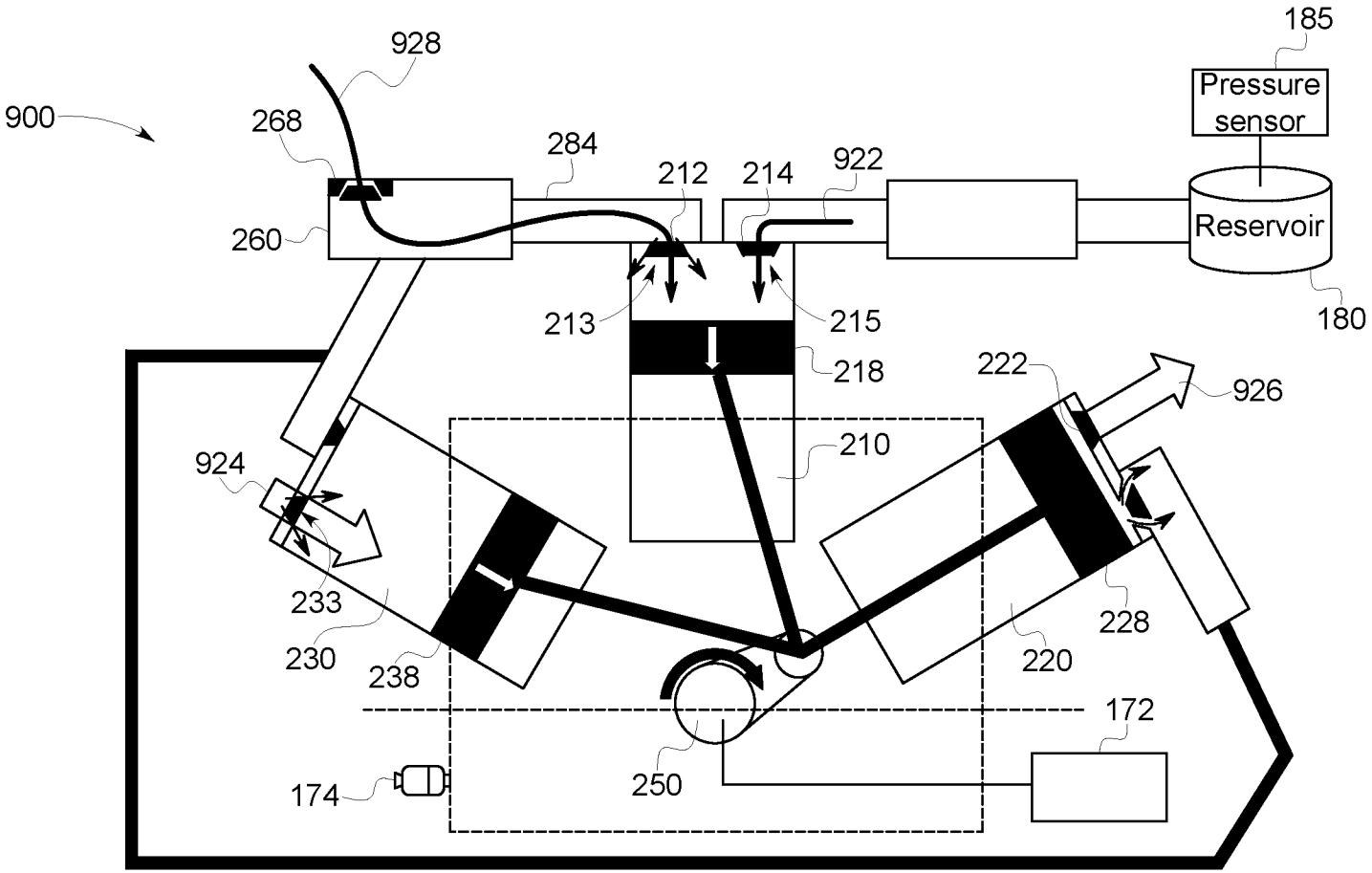
FIG. 9 is an illustration of an embodiment of a system that includes a compressor.
Figure 10:
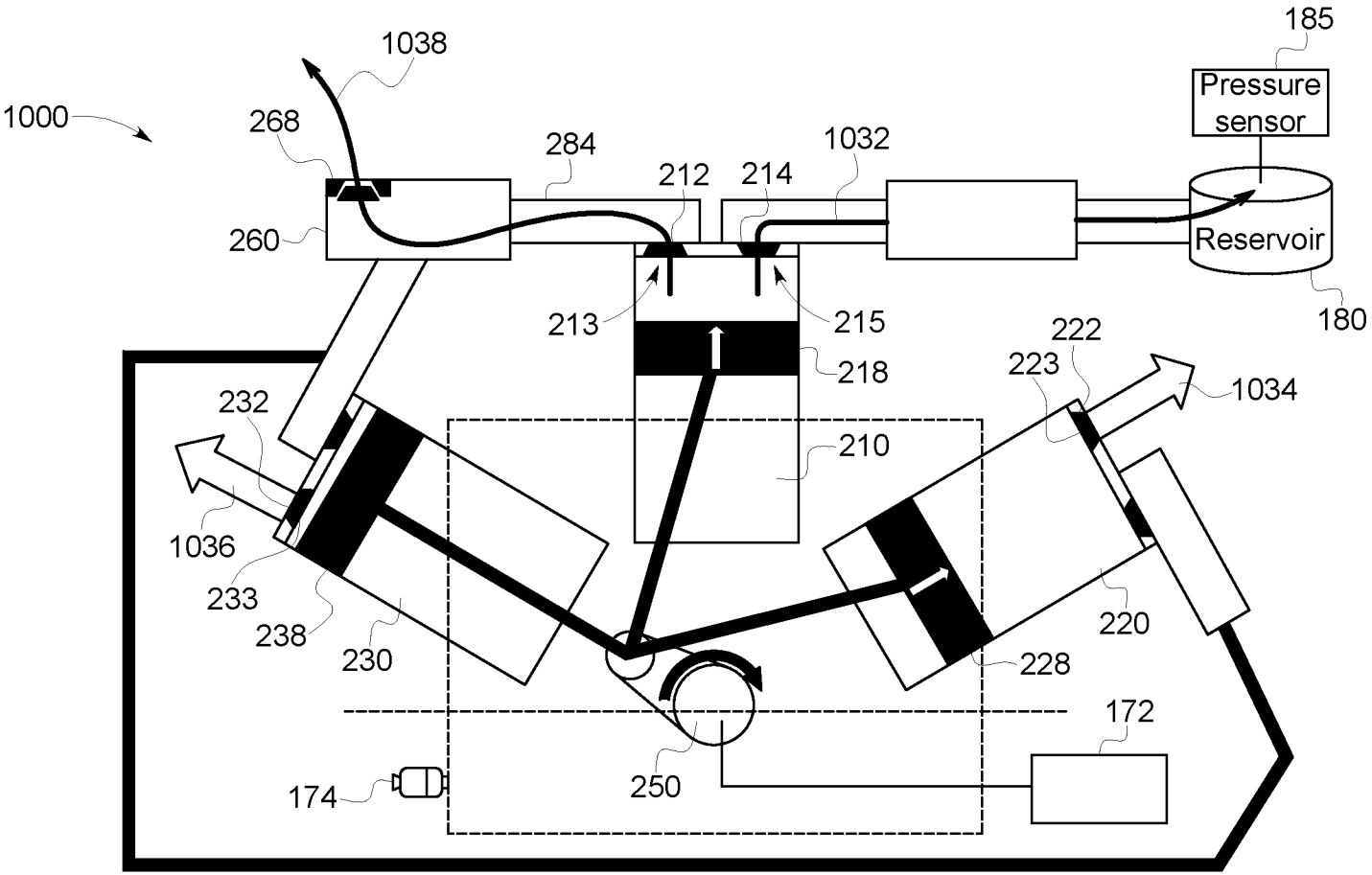
FIG. 10 is an illustration of an embodiment of a system that includes a compressor.

Referring now to FIGS. 8-10, an aspect of a method for a compressor is illustrated. A compressor, such as the compressor illustrated in FIGS. 1 and 2, operates to charge a reservoir 180 with compressed air or other gas. Once the compressor charges the reservoir to a determined pressure value the compressor operation is discontinued. In some embodiments, when compressor operations are discontinued, one or more unloader valves are opened to vent intermediate stages of the compressor to the atmosphere. The intake valves of the cylinders as well as unloader valves of the intermediate stage reservoirs may all operate as unloader valves to vent the cylinders of the compressor to the atmosphere. Once the unloader valves are actuated and the cylinders and intermediate stages of the compressor have been vented to the atmosphere the pressure within the reservoir is expected to remain constant as previously discussed.

In an embodiment, a method of diagnosing a compressor includes monitoring a pressure of compressed air within a reservoir, actuating a piston within a cylinder of the compressor, and detecting a leak condition of an exhaust valve of the cylinder through recognition of a change in the monitored pressure of the compressed air within the reservoir during a time period in which the piston is actuated. A leak condition of the exhaust valve 214 of the cylinder 210 may be detected by correlating the monitored pressure of the compressed air within the reservoir 180 with an indication of a position of the piston 218 within the cylinder 210. Turning to FIG. 8, graph 800 illustrates compression strokes and measured pressure over time. During normal or loaded operation of the compressor, on each compression stroke (↑) of the high-pressure cylinder 210, the measured pressure 842 in the reservoir 180 increases as an additional mass of compressed air is forced through the exhaust port 215 and into the reservoir 180. During each suction stroke (↓), the exhaust port 215 is closed and the measured pressure 840 within the reservoir 180 is expected to remain constant. As such, the measured reservoir pressure is expected to increase in a generally step-wise fashion once per revolution of the piston 218. Thus, during loaded operation of the compressor a change in the monitored pressure, or lack of change, correlated with each compression stroke may indicate faulty operation of the compressor.

In another embodiment, the piston is actuated by cycling the piston within the cylinder with the compressor in an unloaded condition. The unloaded condition is maintained by opening one or more of the unloader valves to vent the cylinders and intermediate stage reservoir, if present, to the atmosphere. In an unloaded condition, the crankshaft 250 of the compressor rotates causing the pistons 218, 228, 238 to move within their respective cylinders, however, air flows into and out of the cylinders through the open unloader valves.

As shown in FIG. 9, a system 900 is depicted. During the suction stroke of the piston 238, an air flow 924 enters cylinder 230 through intake port 233. Similarly, during the compression stroke of piston 228, an air flow 926 exits cylinder 220 through intake port 223. In this embodiment, the intake valves 222, 232 function as unloader valves for their respective cylinders. Regarding cylinder 210, the piston 218 is illustrated during a suction stroke resulting in the air flow 928 being drawn into the cylinder 210 through the unloader valve 268, the intermediate stage reservoir 260, and intake port 213.

During unloaded operations, the exhaust port 215 and exhaust valve 214 of the cylinder 210 are expected to remain closed to maintain a closed volume and constant pressure within the reservoir, provided air is not currently being supplied from the reservoir 180 to pneumatic devices. If the exhaust port 215 and/or exhaust valve 214 are degraded, such as by corrosion or wear, the exhaust valve may not maintain an air tight seal during unloaded operations and compressed air may leak from the reservoir back through the exhaust port 215 into the cylinder 210. Depending upon the pressure within the reservoir and the nature of the degradation of the exhaust value or exhaust port, a leak may be intermittent or difficult to identify.

In an embodiment, a leak condition of the exhaust valve 214 is detected by correlating the monitored pressure of the compressed air within the reservoir with an indication of a position of the piston within the cylinder. During the suction stroke, a reduced pressure is created in the cylinder 210. The reduced pressure is transitory in nature as the inflow of air through the intake port will restore the pressure within the cylinder to atmospheric pressure. During the period of reduced pressure, however, an exhaust valve 214 with a sufficient leak condition will allow air flow 922 from the reservoir into the cylinder. The air flow 922 results in a decrease in the reservoir pressure as air is drawn out of the reservoir. Such air flow 922 may occur even if the exhaust valve 214 does not demonstrate a leak under static conditions.

Referring to FIG. 10, a system 1000 that illustrates a compressor during a compression stroke is provided. During the compression stroke of the piston 218 an increased pressure is created in the cylinder 210. In a similar manner as described above, the increased pressure is transitory in nature as the air flow 1038 out through the intake port 213 and through the unloader valve 268 restores the pressure within the cylinder to atmospheric pressure. During the period of increased pressure, however, an exhaust valve 214 with a sufficient leak condition will allow air flow 1032 from the cylinder 210 through the exhaust port 215 and into the reservoir 180 resulting in an increase in reservoir pressure. Such air flow 1032 may also occur even if the exhaust valve 214 does not demonstrate a leak condition under static conditions, or when cycling the unloader valve as described above. Depending upon the configuration of the compressor system, during the compression stroke of the piston 218, the pistons 228, 238 may be in various stages of their respective rotations. As shown in FIG. 10, the piston 228 had reached top dead center resulting in an air flow 1034 out of cylinder 220 through intake port 223. The piston 238 may be traversing a compression stroke as shown resulting in an air flow 1036 out of cylinder 230 through intake port 233. In this manner, the intake valves 222, 232 continue to function as unloader valves for their respective cylinders.

In some embodiments, the increase and decrease in reservoir pressure corresponding to compression and suction strokes of piston 218 are detectable even when the air flows 922 (as seen in FIG. 9) and 1032 (as seen in FIG. 10) are not individually identifiable. In an embodiment, the piston 218 is cycled at a known rate and a once-per-revolution signature identified in a frequency analysis of the monitored pressure data, corresponding to an exhaust valve leak during either the suction or compression stroke. In other embodiments, a twice-per-revolution signature may be identified if the exhaust valve leaks during both the suction and compression strokes of the piston. The rate at which the piston is cycled may be varied such that the frequency components corresponding to the leak may be adjusted to facilitate detection of the leak condition. In one example, the piston 218 is cycled at a first rate during a first portion of the time period and cycled at a second rate during a second portion of the time period. By comparing the measured reservoir pressure data, in either the time domain or the frequency domain, for each of the two time periods, noise or other variation in the measured reservoir pressure may be accounted for such that the variation corresponding to the piston movement is isolated. In other embodiments, the measured reservoir pressure may be affected by vibrations or noise from the compressor environment or other distortions caused by surrounding equipment. In such environments, cycling the piston at two or more different rates may enable identification of leaks that would otherwise have been masked. In addition, the piston 218 may be cycled at rates less than the sample rate of the monitored pressure in order to provide sufficient detection of pressure changes correlated with the movement of the piston. In this manner, both time domain and frequency domain analysis of the measured reservoir pressure may be used to identify a leak condition of an exhaust valve.

In some embodiments, the leakage through exhaust valve 214 may be dependent upon reservoir pressure. When the reservoir pressure is high, air flow 1032 from the cylinder 210 into reservoir 180 may be inhibited, however, air flow 922 from the reservoir 180 into the cylinder 210 may still result. When reservoir pressure is low, air flow 922 from the reservoir 180 into cylinder 210 may not result, but air flow 1032 from the cylinder 210 into the reservoir 180 may be detected. As a result, in some embodiments, a method of diagnosing a compressor includes filling the reservoir with compressed air to a determined pressure value prior to cycling the piston as discussed above. Just as the rate at which the piston is cycled may be varied to assist in detecting leak conditions, the diagnostic method may be performed at more than one reservoir pressure level to detect leaks under varying condition.

In yet another embodiment, a controller is provided to determine the condition of a compressor. The controller is configured to receive a signal corresponding to a monitored pressure of compressed air within a reservoir of the compressor, and detect a leak condition of an exhaust valve of a cylinder of the compressor through recognition of a change in the monitored pressure of the compressed air within the reservoir during a time period in which a piston actuated within the cylinder. In an embodiment, the controller is integral with a vehicle system, such as controller 130. In yet another embodiment, the controller is provided with a test kit used for maintenance and repair or diagnostic operations. In this manner, the controller may be further configured to actuate the piston within the cylinder of the compressor during at least a portion of the time period.

In various embodiments, the controller may interface with controller 130, compressor actuators 152, or motor 104 to actuate the piston. In addition, the controller is configured to communicate with one or more reservoir pressure sensors 185 and receive the signal corresponding to the monitored pressure. The controller may also correlate the signal corresponding to the monitored pressure of the compressed air within the reservoir with an indication of a position of the piston in the cylinder of the compressor. The position of the piston may be indicated by the rotational position of the crankshaft or the motor, or by a sensor configured to identify the position of a piston within a cylinder of the compressor. In one embodiment, the crankshaft position sensor 172 is used to determine the position of a piston in the cylinder.

In order to evaluate the health of the compressor under various operating conditions, the controller may be configured to actuate the piston within the cylinder of a reciprocating compressor in a loaded or unloaded condition. The controller is further configured to recognize a reduction in the monitored pressure corresponding to a suction stroke of the piston in the cylinder and to recognize an increase in the monitored pressure corresponding to a compression stroke of the piston in the cylinder as previously discussed. The controller may also be configured to perform frequency domain analysis on the monitored pressure data during the time period in which the piston is actuated. In some embodiments, the controller includes a digital signal processor capable of analyzing the frequency components of the monitored pressure data. In this manner, the controller implements a diagnostic method and is configured to generate diagnostic information for the compressor.

Upon detecting a leak or potential fault in the compressor system, a variety of steps may be taken to reduce further degradation of the components and facilitate repair. In an embodiment, a signal is generated in response to recognizing a change in the monitored pressure of the compressed air within the reservoir during a time period in which the piston is actuated. The generated signal may be indicative of a severity level of the leak condition of the exhaust valve, where the severity level corresponds to the change in the monitored pressure when the piston is actuated. In an embodiment, in response to the signal, the duty cycle of the compressor is reduced in order to reduce further degradation of the compressor until repairs can be made. The duty cycle may be reduced by a fixed amount, such as by 25%, 50% or more, or may be reduced in proportion to the severity of the identified failure. If the leak condition is severe, power to the compressor may be disconnected such that the compressor ceases operating until appropriate repairs have been effected. In another embodiment, personnel are notified by an audio alarm, a visual alarm, a text message, an email, an instant message, a phone call, or other method appropriate for the operating environment. In a system having multiple compressors, in response to a detected leak on one compressor (e.g., on a first compressor) the operation of the other compressors may be adjusted to compensate for the reduced performance of the leaking compressor allowing the system to remain functional until repairs can be scheduled.

In one or more embodiments, the controller can be configured to actuate a check valve 290 and a drain valve 292 of the aftercooler 270 (of FIG. 2) to facilitate removing fluid from the compressor and, in particular, the aftercooler. In an embodiment, the drain valve 292 can be coupled to a drain line 294 that can include a first end coupled the drain valve and a second end opposite the first end open to the atmosphere. In another embodiment, a discharge line (not shown) can tie into the drain line 294 for discharge into the atmosphere. In such embodiment, one or more additional lines or valves (e.g., drain valve for intercooler, actuator lines, among others) can be coupled to the discharge line for release to the atmosphere.

In an embodiment, the controller can actuate the check valve 290 and/or the drain valve 292 prior to a starting of the compressor. In another embodiment, the controller can actuate the check valve 290 and/or the drain valve 292 while the compressor is in an unloaded condition.

Figure 12:
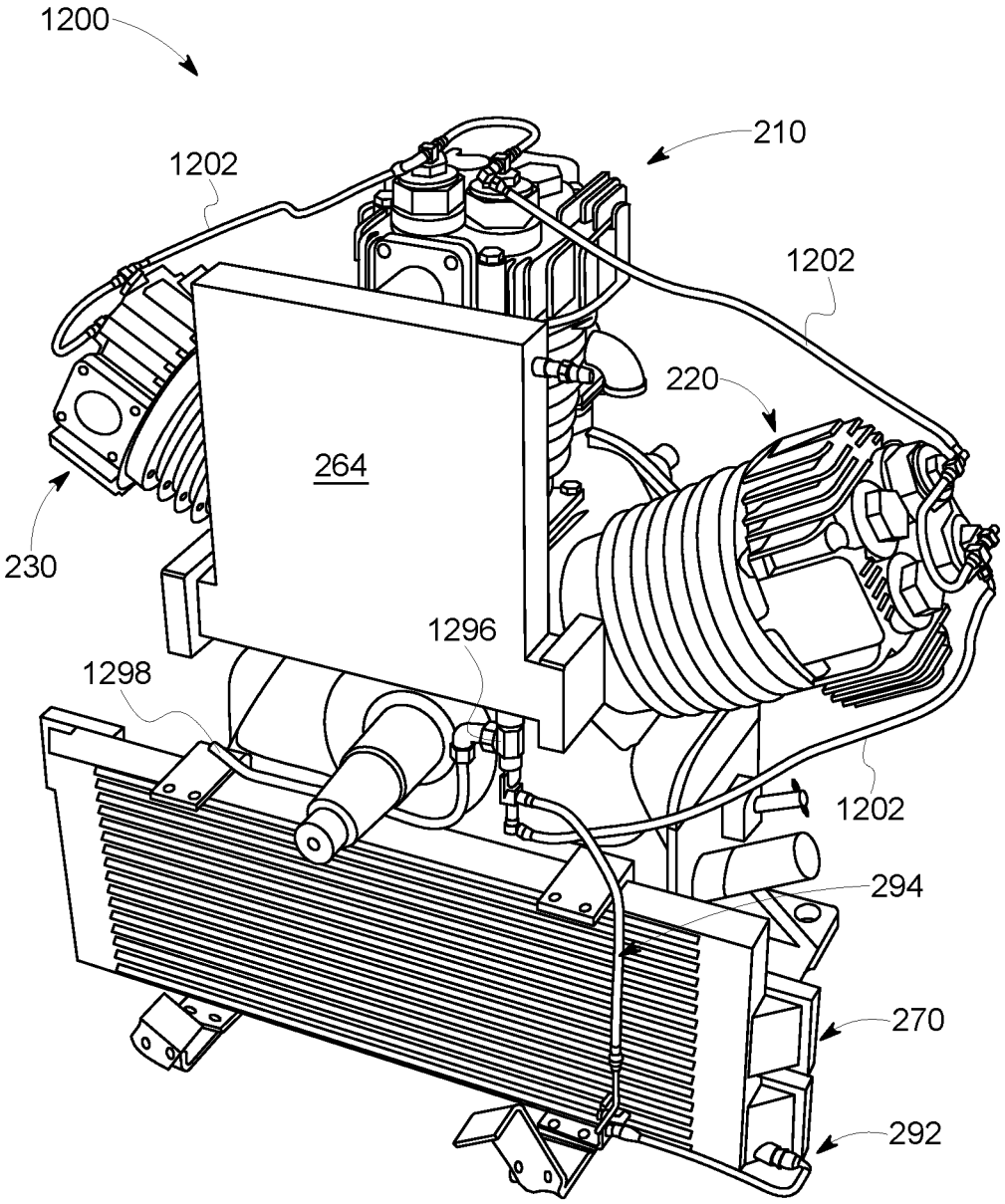
FIG. 12 is an illustration of an embodiment of a compressor.
Figure 13D:
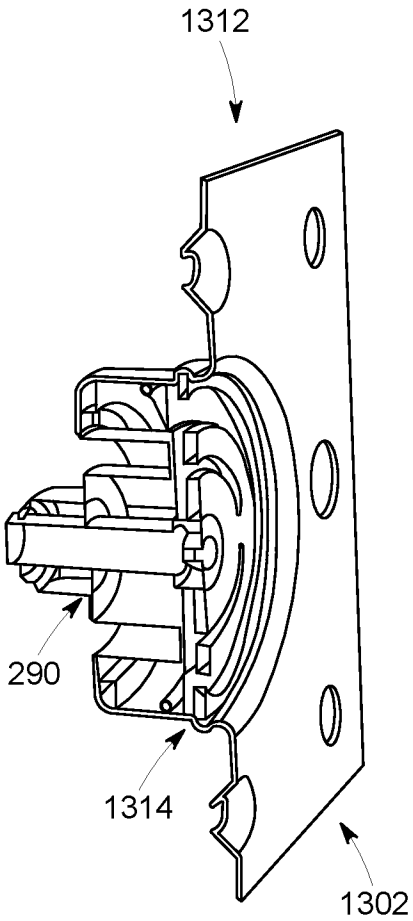
FIGS. 13A-13D are illustrations of views of a check valve for a compressor.
Figure 13C:
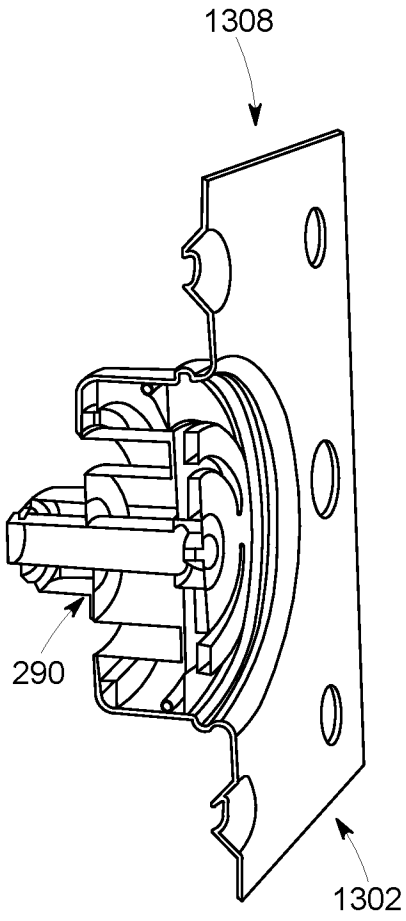
Figure 13B:
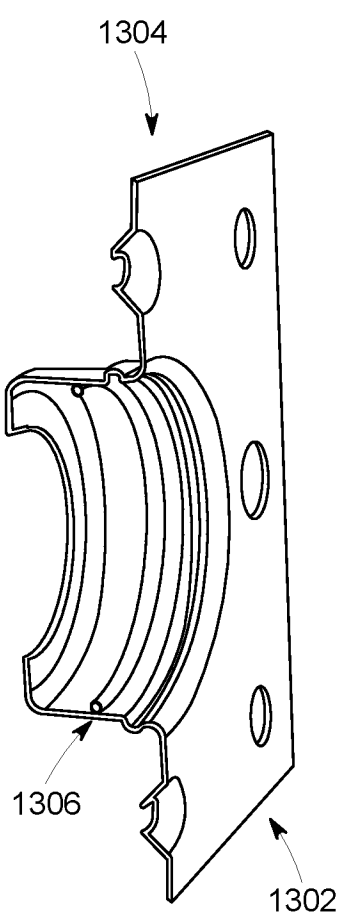
Figure 13A:
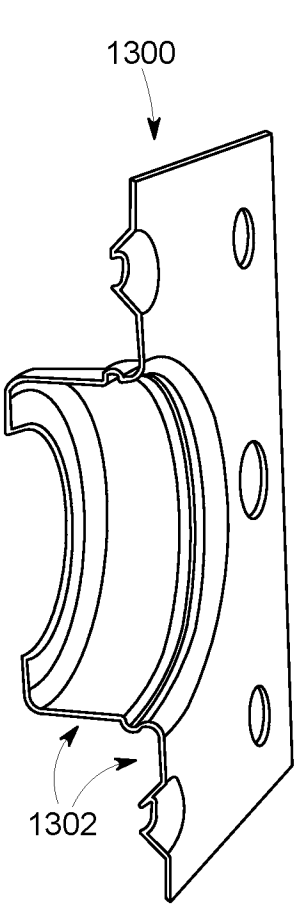

FIGS. 12-16 illustrate the check valve 290, the drain valve 292, and other components of the compressor 110. In a view 1200 of FIG. 12, an actuation line 1202 can interconnect one or more unloader valves of the compressor. (View 1200 of FIG. 12 shows the compressor generally, which may be the compressor 110 of FIG. 2.) The view 1200 illustrates the compressor with the high-pressure cylinder 210 and at least one low pressure cylinder (e.g., low pressure cylinder 230, low pressure cylinder 220). The intercooler 264 can include a drain valve 1296 that is connected to a discharge line 1298. The discharge line 1298 can open to the atmosphere to allow release of at least one of the actuation line 1202, the drain valve 292 of the aftercooler 270, and/or the drain line 294. In an embodiment, the actuation line can connect to the drain line via one or more couplings or connectors. As depicted, the actuation line 1202 can meet with the drain line 294 at the drain valve 1296, which ties into the discharge line 1298.

In an embodiment, the routing of the actuation line 1202 can be fitted to the cylinder style head and to minimize handling damage.

Figure 14A:
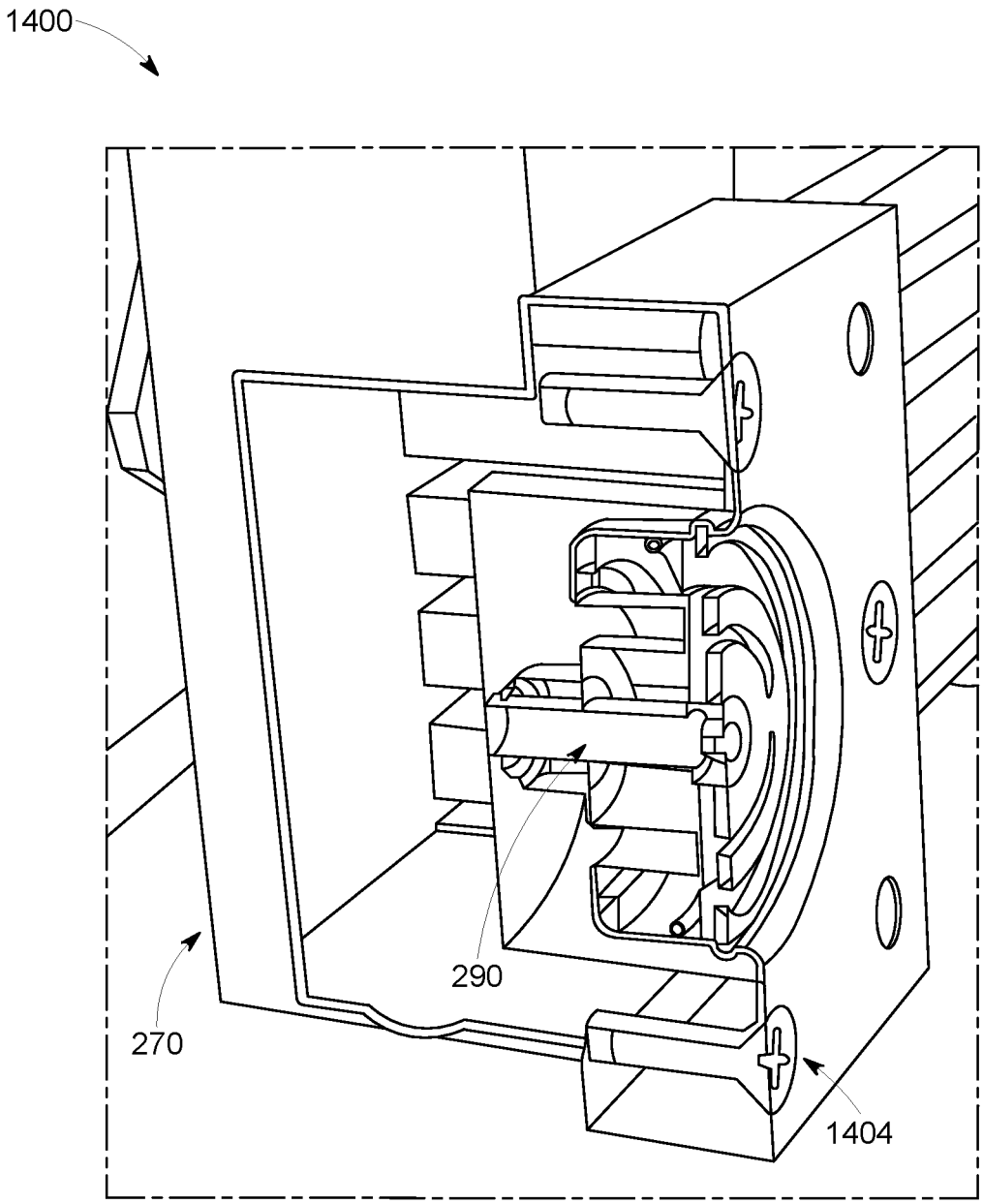
FIGS. 14A-14B are illustrations of views of a check valve for a compressor.
Figure 14B:
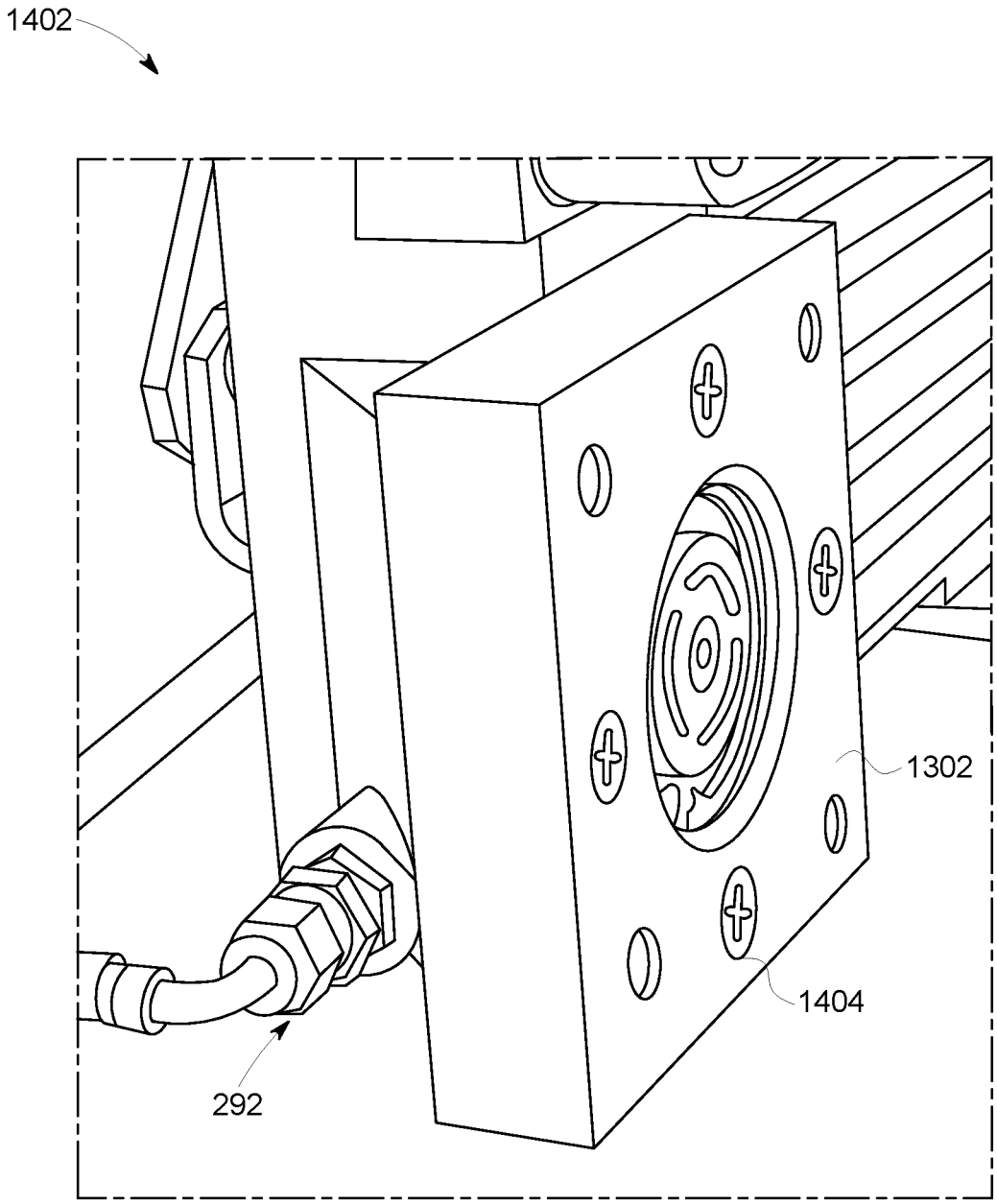

Turning to FIGS. 13A-13D, the check valve 290 is illustrated. In view 1300 (FIG. 13A), an adapter plate 1302 is illustrated. In an example, the adapter plate 1302 can be hydro-formed. In view 1304 (FIG. 13B), a gasket 1306 can be used with the adapter plate 1302. For instance, the gasket 1306 can be an o-ring. View 1308 (FIG. 13C) illustrates the check valve 290 and the adapter plate 1302. View 1312 (FIG. 13D) illustrates a gasket 1314 with the check valve 290, wherein the gasket 1314 can be a snap-ring for example. In an embodiment, the check valve 290 is an inlet discharge check valve that addresses leakage issues with cylinder heads and allows for the addition of the drain valve 292 by isolating the pressure in the aftercooler 270 from the pressure in the reservoir 180. Turning to FIGS. 14A and 14B, a view 1400 depicts the check valve 290 within the aftercooler 270 affixed to the aftercooler with one or more screws 1404. A view 1402 illustrates the adapter plate 1302 as well as the drain valve 292.

Figure 15:
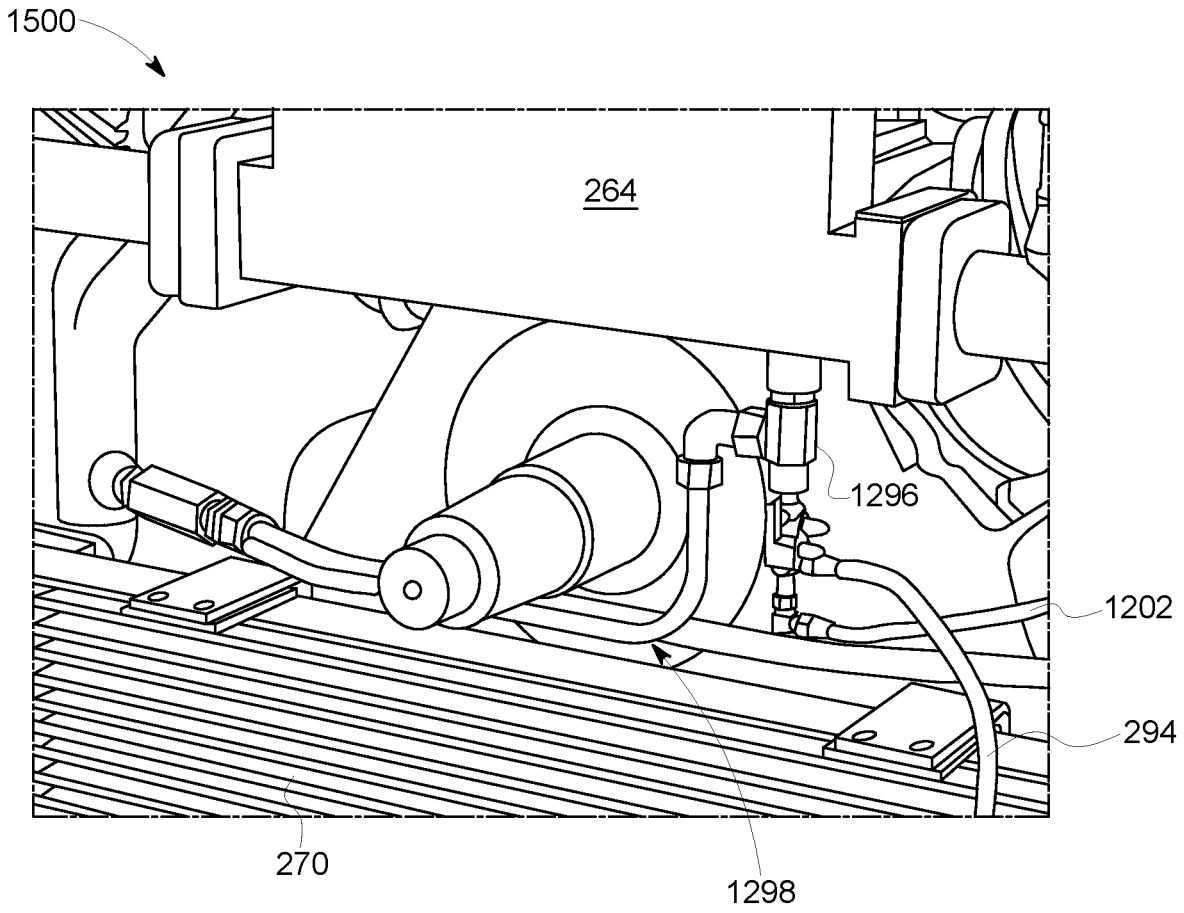
FIG. 15 is an illustration of a system with a discharge line for a compressor.
Figure 16:
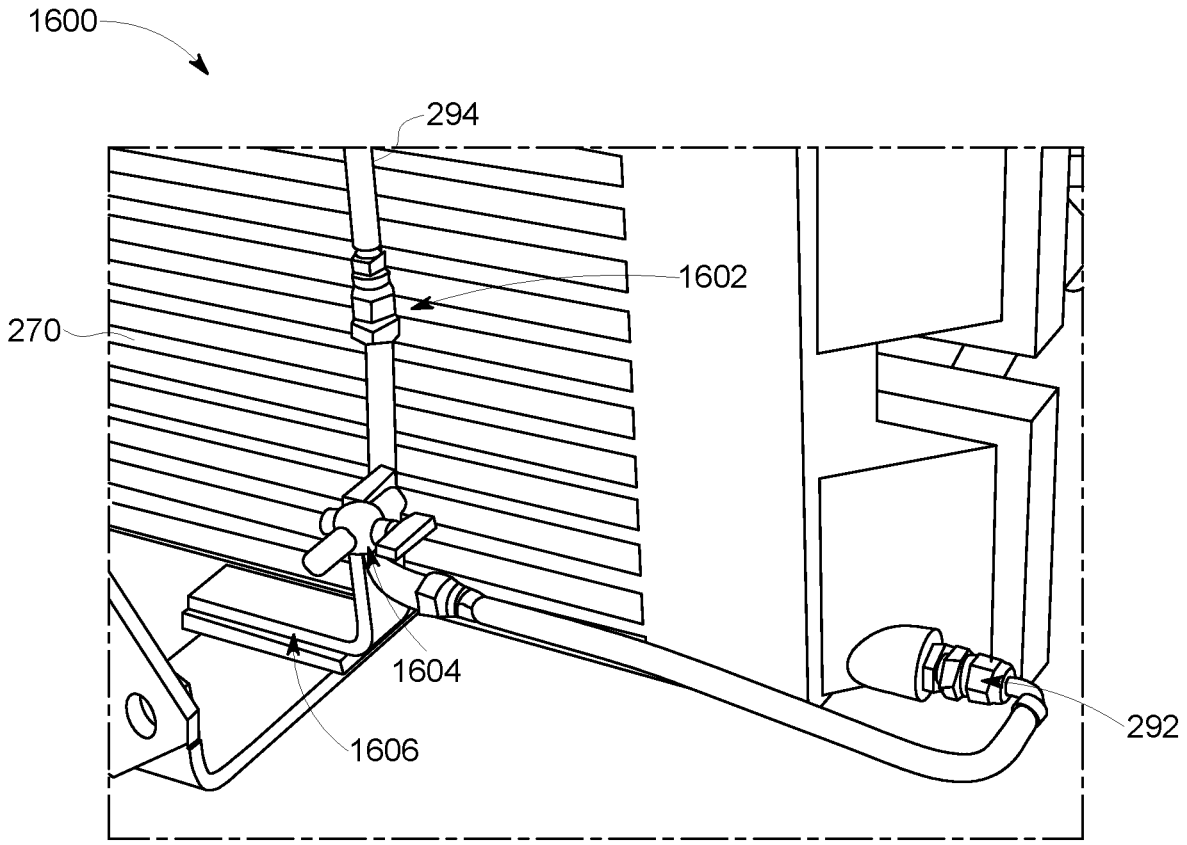
FIG. 16 is an illustration of a system with a drain valve for an aftercooler of a compressor.

FIG. 15 illustrates a system 1500 that includes the drain valve 1296 for the intercooler 264. The drain valve 1296 can be coupled to the discharge line 1298 that opens to the atmosphere. In this embodiment, the discharge line 1298 is a pipe that is directionally angled away from the compressor to avoid clogging the aftercooler 270. The drain valve 1296 can further include connectors or couplings that tie in the actuation lines 1202 and/or the drain line 294. In an embodiment, the discharge line 1298 can be a non-conductive nylon tubing in which the opening to the atmosphere is away from the aftercooler and from a potential user. Continuing with illustrations of the lines, FIG. 16 depicts a system 1600 that includes the drain line 294 connected to the drain valve 292 associated with the aftercooler 270. The drain valve 292 can be coupled to the drain line 294 via a connector or coupling. For instance, the coupling or connector can be an isolation cock. For example, the drain line 294 can include a connector 1602 to couple to the drain valve 292 and/or a pipe that connects to the drain valve 292. A connector 1604 can be an isolation cock connector that can be used for diagnostics. The isolation cock connector can be a discharge isolation cock. A mounting bracket 1606 can further be included with the drain valve 292.

Figure 17A:
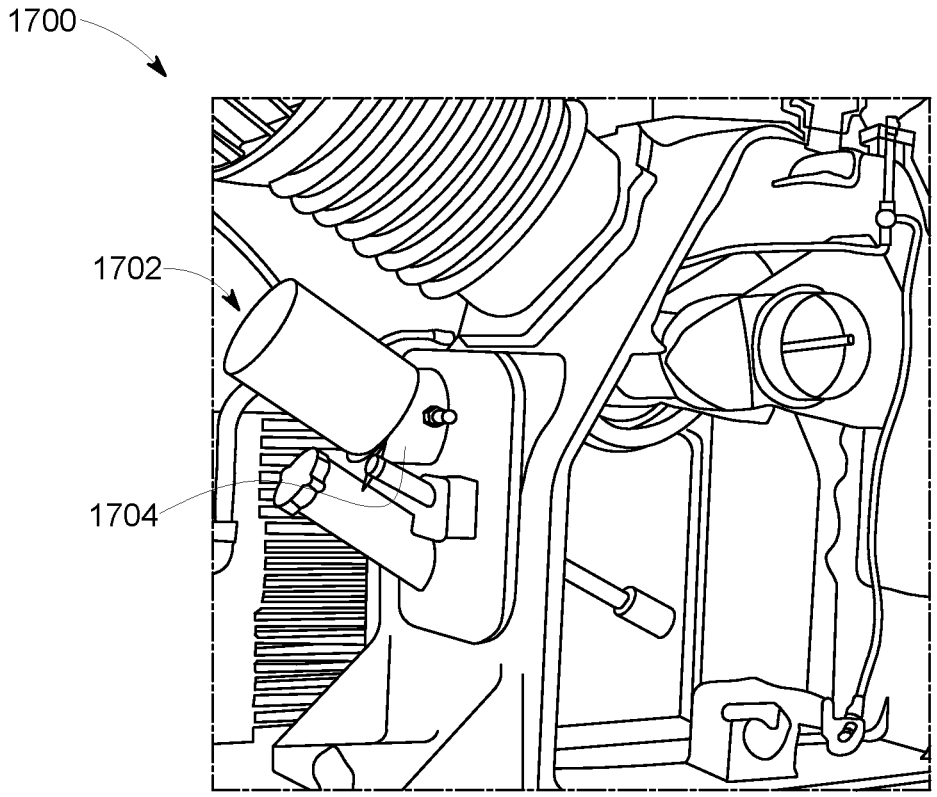
FIGS. 17A-17B are illustrations of views of an external oil filter utilized with a compressor.
Figure 17B:
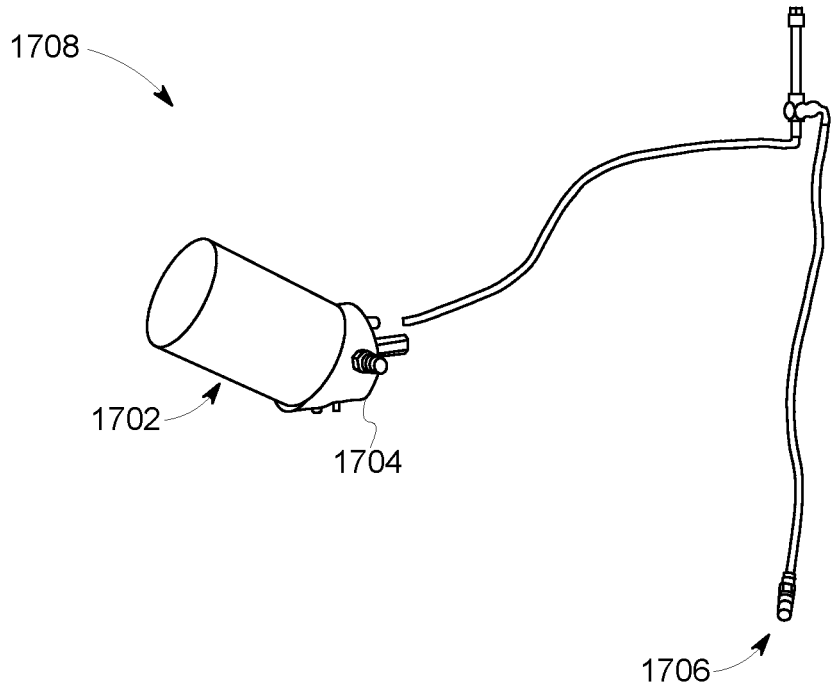
Figure 18A:
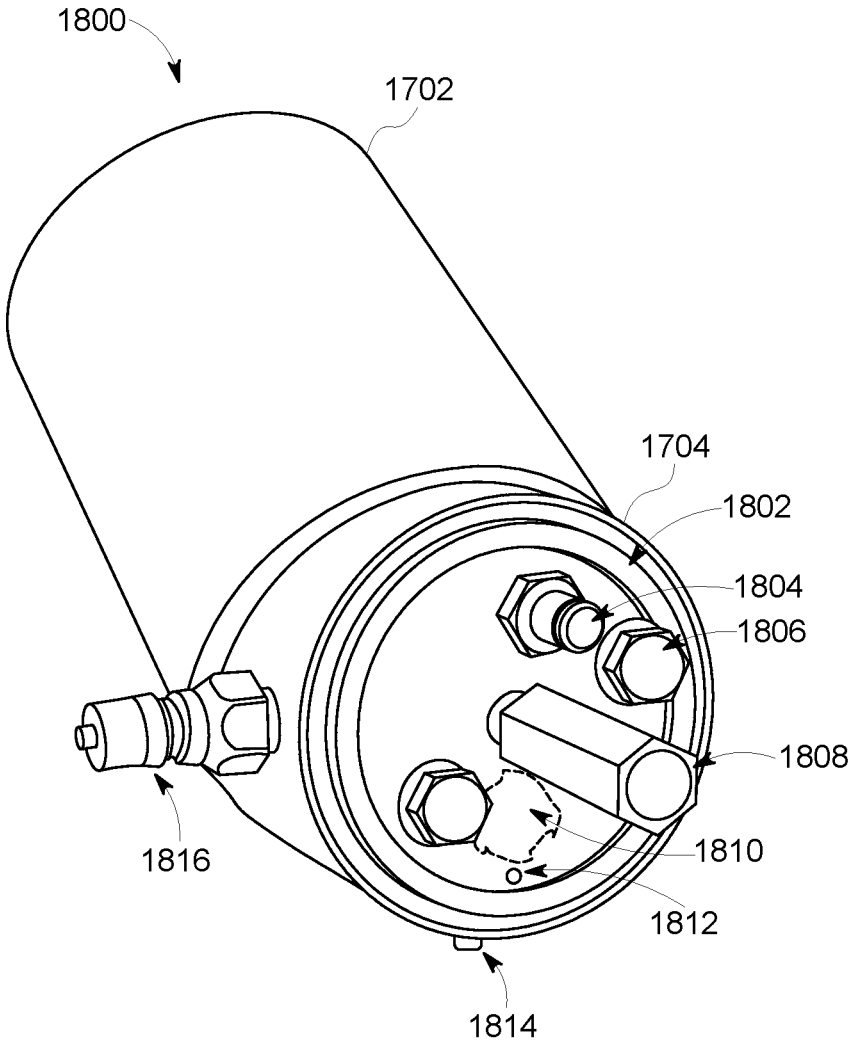
FIGS. 18A-18B are illustrations of a view of an oil filter and a manifold for a compressor.
Figure 18B:
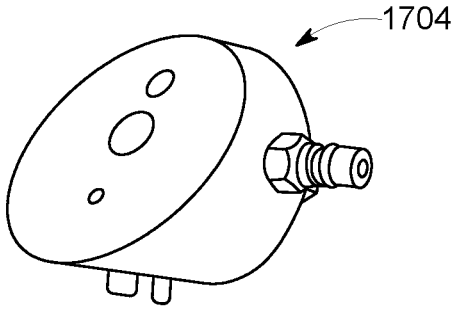
Figure 19:
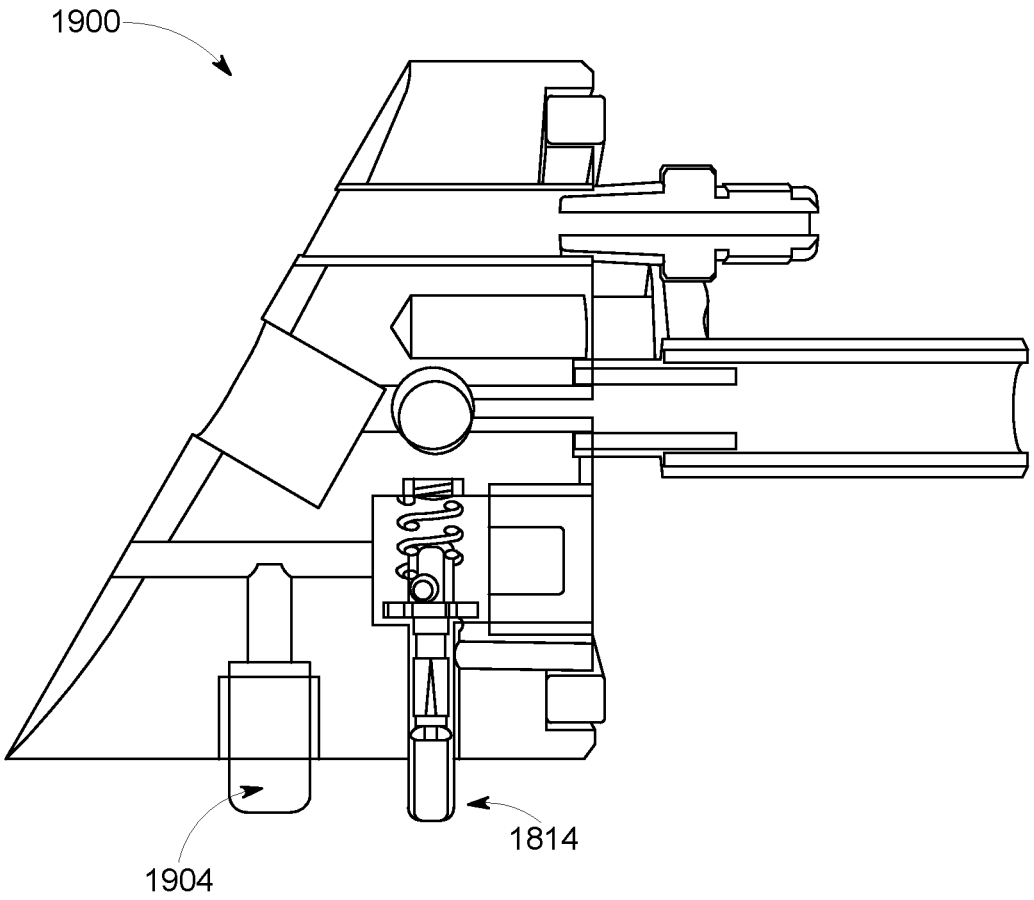
FIG. 19 is an illustration of a view of a manifold used to couple an oil filter to a compressor.

FIGS. 17A-19 relate to an oil filter for the compressor. In FIG. 17A, a view 1700 illustrates an oil filter 1702 and a manifold 1704, wherein the oil filter is external to the compressor 110 (see FIGS. 1 and 2). The oil filter can be utilized to filter oil that is used with the motor 104 (see FIG. 1). A view 1708 (FIG. 17B) illustrates lines associated with the oil filter 1702 and at least one connection 1706 at an oil pump. Turning to FIG. 18A, the oil filter 1702 is illustrated in view 1800. The oil filter 1702 includes the manifold 1704 (see also FIG. 18B) that allows attachment of the oil filter 1702 for use with the compressor 110 and/or motor 104. The oil filter 1702 can further include at least one of a gasket 1802 (e.g., a square cut gasket), a connector (e.g., an adapter for oil in), a fastener 1806 (e.g., ⅜-16 fastener), a relief valve 1808 (e.g., an inline pressure relief valve), a port 1810 (e.g., a plugged port that provides access to vent pin), an oil vent 1812 (e.g., filter removal oil vent), a vent pin 1814 (e.g., filter removal oil vent valve), or a pressure port 1816 (e.g., post filter pressure port). FIG. 19 illustrates a view 1900 that depicts the vent pin 1814 and a pre-filter port 1904, wherein the pre-filter port 1904 can be an external pre-filter port provided for external oil pump application(s). For example, the pre-filter port allows connectivity to access a source of the oil before the oil enters the filter. In another example, the pre-filter port allows a test device to connect. In another embodiment, the pre-filter port is an auxiliary access to the oil. In an embodiment, the oil can be drained from the oil filter 1702 by creating a vent hole on a top portion (side that is not connected to the manifold 1704) and activating the vent pin 1814 to equalize pressure to enable flow of oil from the oil filter 1702 into at least one of the motor, oil pump, among others.

Figure 20A:
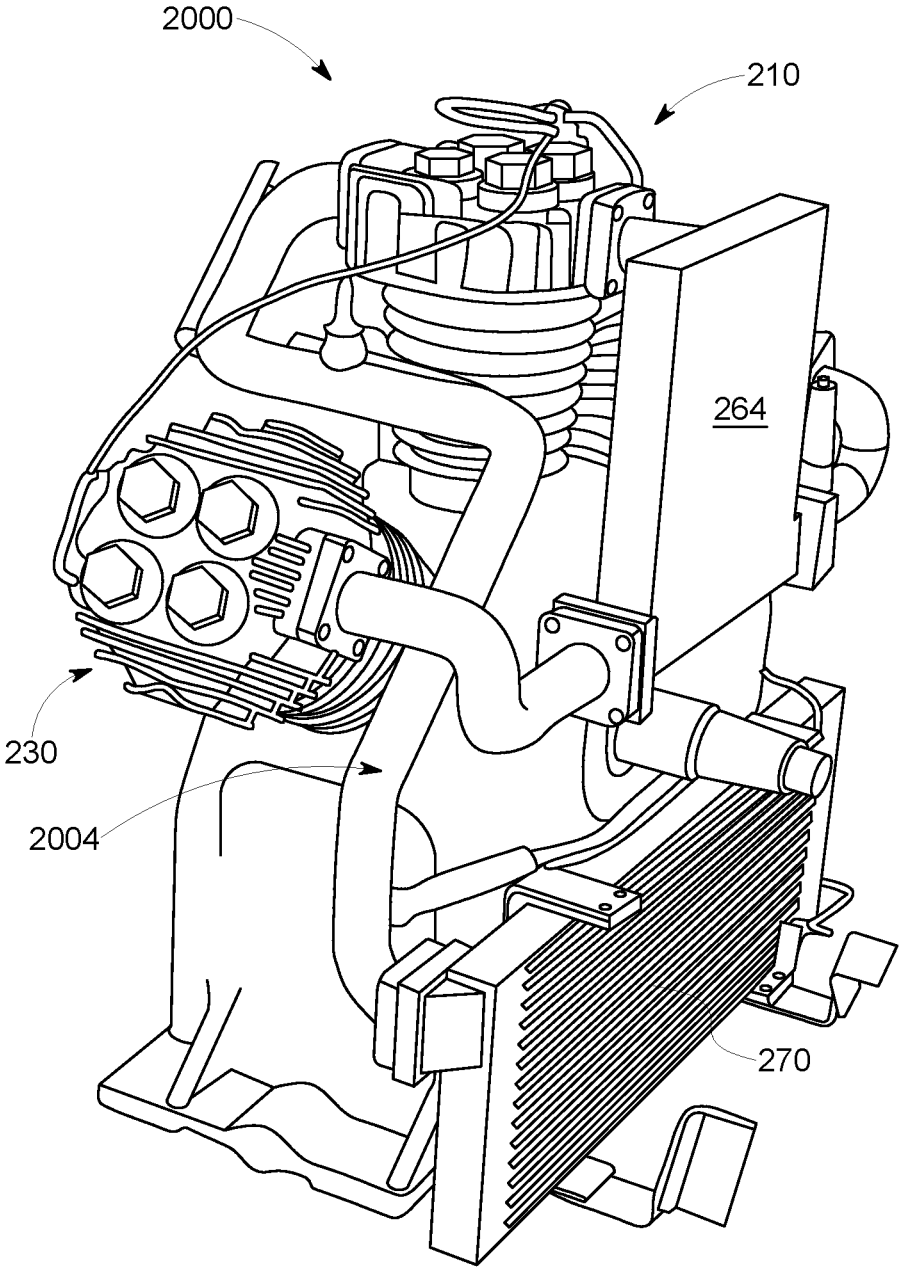
FIGS. 20A-20B are illustrations of views for an exhaust pipe for a high-pressure cylinder to an aftercooler of a compressor.
Figure 20B:
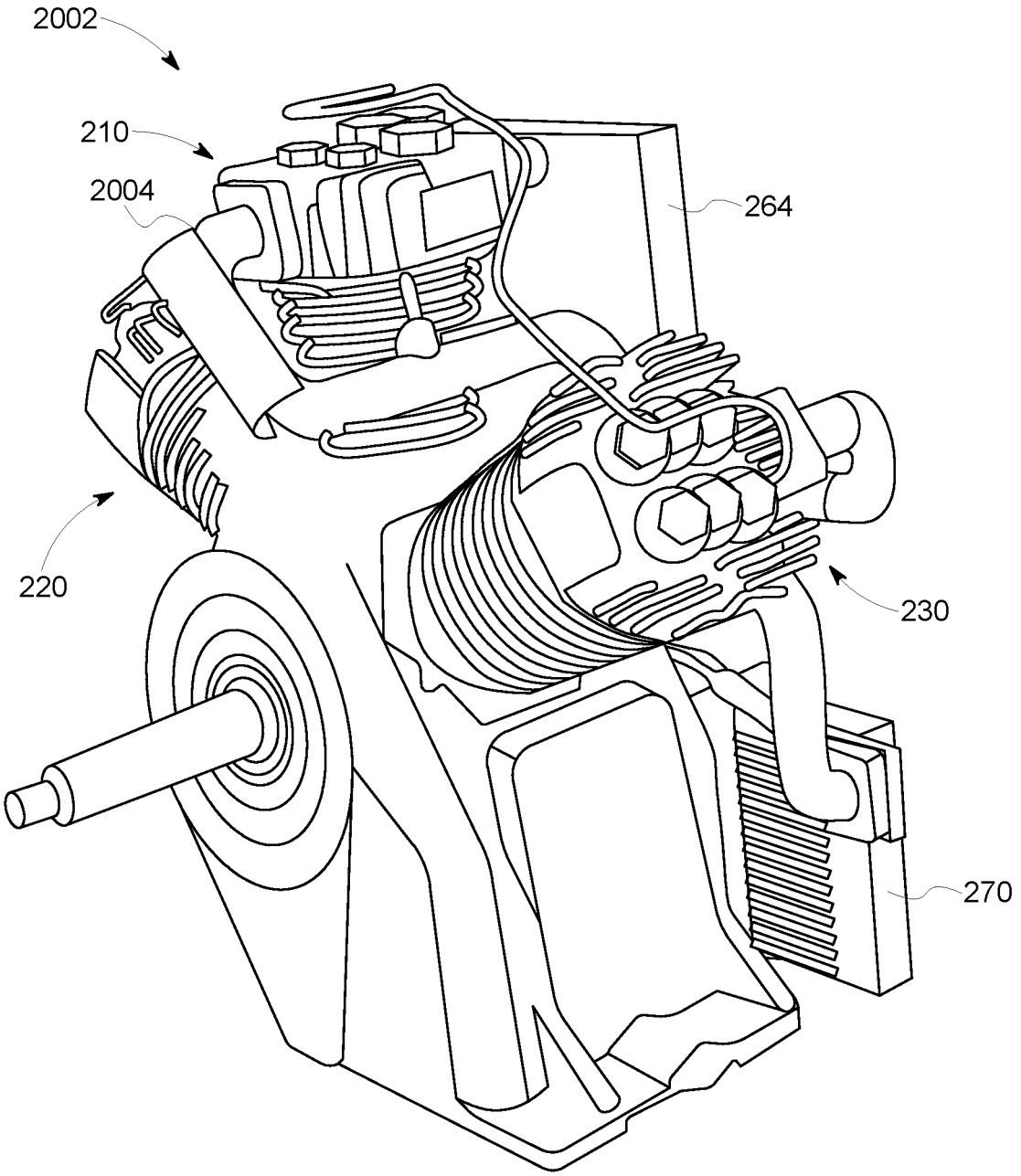
Figure 21:
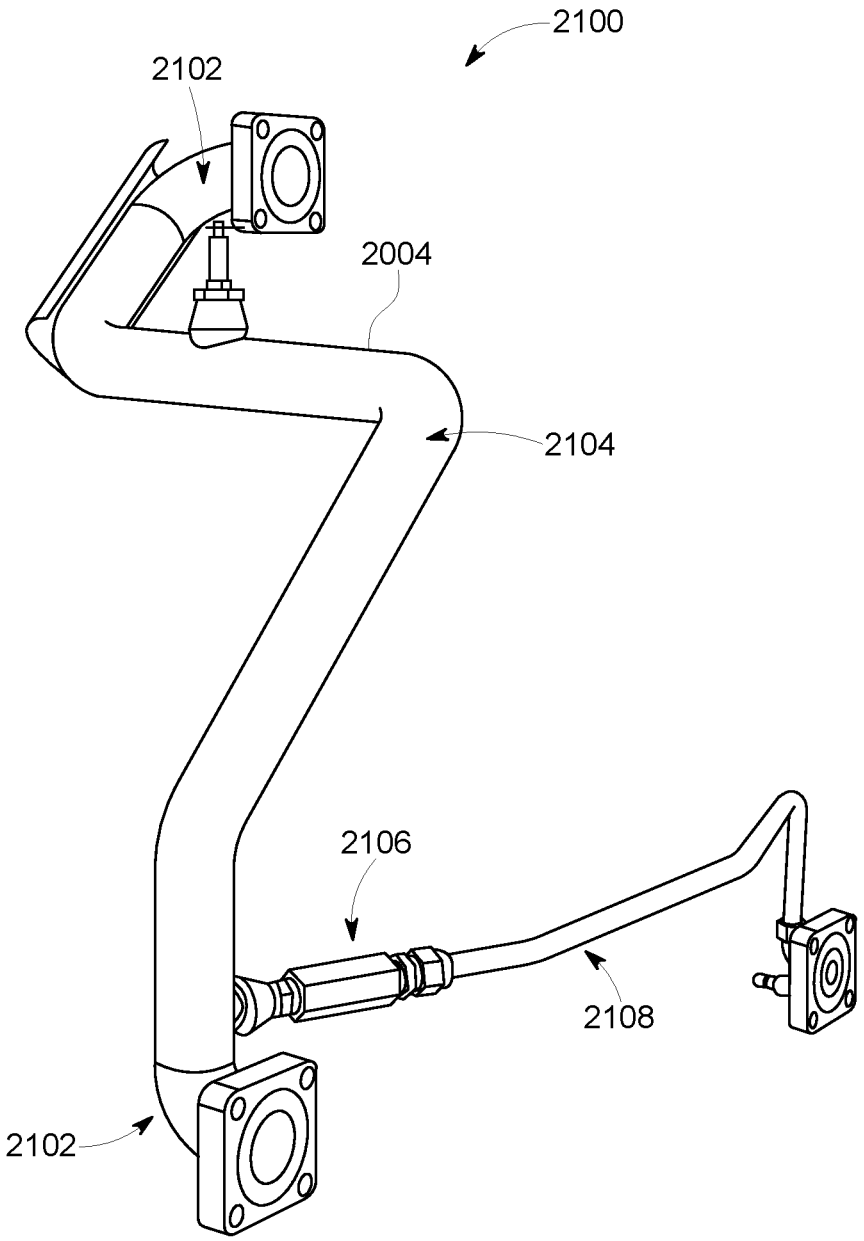
FIG. 21 is an illustration of a view of an exhaust pipe for a compressor.
Figure 22:
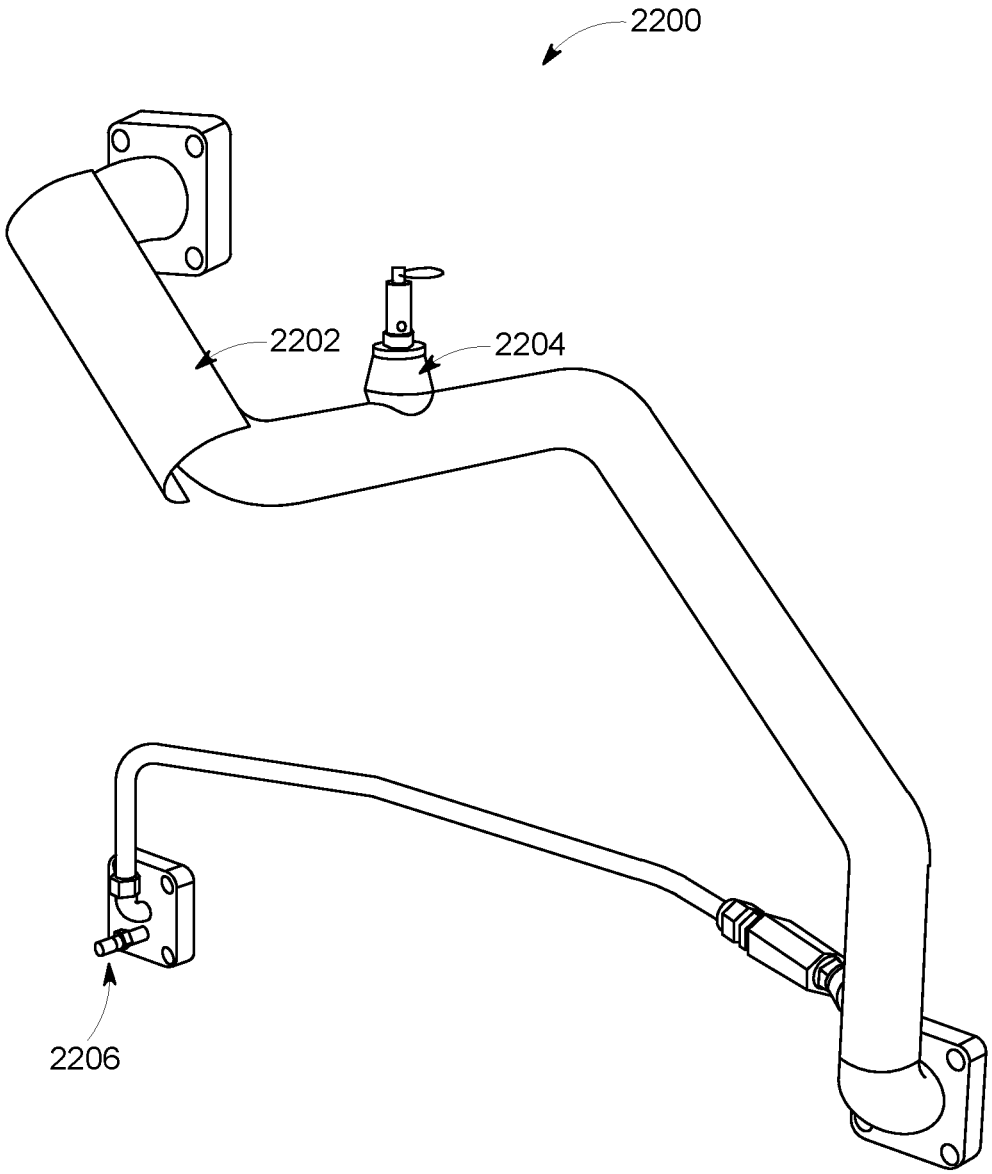
FIG. 22 is an illustration of a view of an exhaust pipe for a compressor.

FIGS. 20A-22 depict an exhaust pipe 1104 for the compressor 110. FIG. 20A illustrates a view 2000 of the compressor that includes the high-pressure cylinder 210, the low pressure cylinder 230, the intercooler 264, and the aftercooler 270. The view 2000 further illustrates the exhaust pipe 2004 that connects the high-pressure cylinder 210 to the aftercooler 270. A view 2002 (FIG. 20B) further illustrates a perspective of the exhaust pipe 2004 that connects the high-pressure cylinder 210 to the aftercooler 270. The view 2002 also illustrates low pressure cylinder 220. The exhaust pipe 2004 is routed to minimize access to burn surfaces and to provide accessible location for an aftercooler pressure relief valve. The routing of the exhaust pipe 2004 facilitates a location for the aftercooler bypass. FIG. 21 illustrates a perspective view 2100 of the exhaust pipe 2004. The exhaust pipe 2004 can include one or more pre-formed elbows 2102, an inline pressure relief valve 2106 (e.g., as well as aftercooler by-pass), and tubing 2108 that bypasses and provides access for oil servicing. In an embodiment, the tubing 2108 can be ¾ inch (20 mm) tubing with fire sleeve protection, and the like. In an example, the exhaust pipe 2004 can include one or more bends 2104 and can be, for instance, 2 inch (50 mm) pipe. In an embodiment, the in-line pressure relief valve 2106 and aftercooler bypass can be located on a warm side to minimize freezing and eliminate continual bypass design. Turning to FIG. 22, a view 2200 illustrates an embodiment of the exhaust pipe 2004 which can include a heat shield 2202, a relief valve 2204 (e.g., aftercooler pressure relief valve in a position to eliminate removal while compressor is removed/installed), and a pressure port 2206. For instance, the pressure port 2206 can provide diagnostics including, but not limited to, discharge check valve (discussed above).

Figure 23:
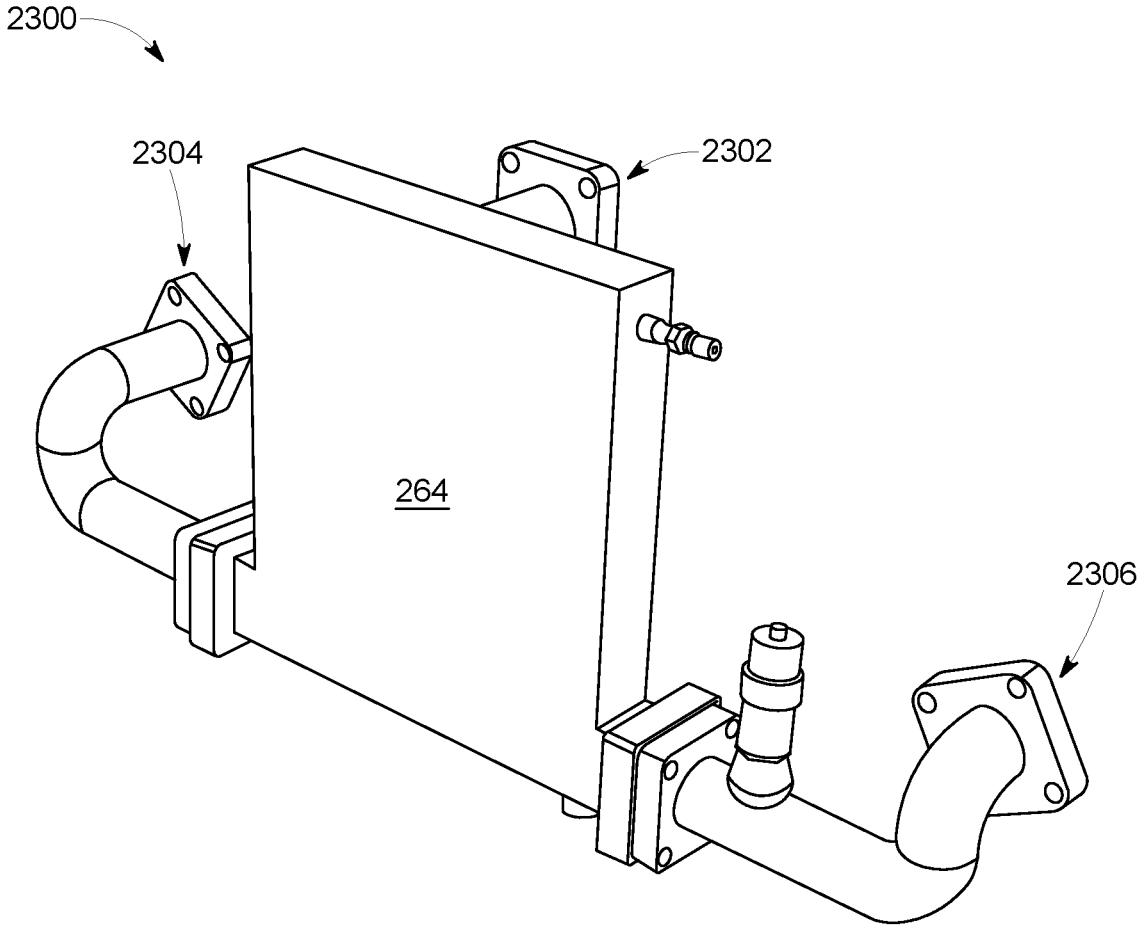
FIG. 23 is an illustration of a view of an intercooler for a compressor.
Figure 24:
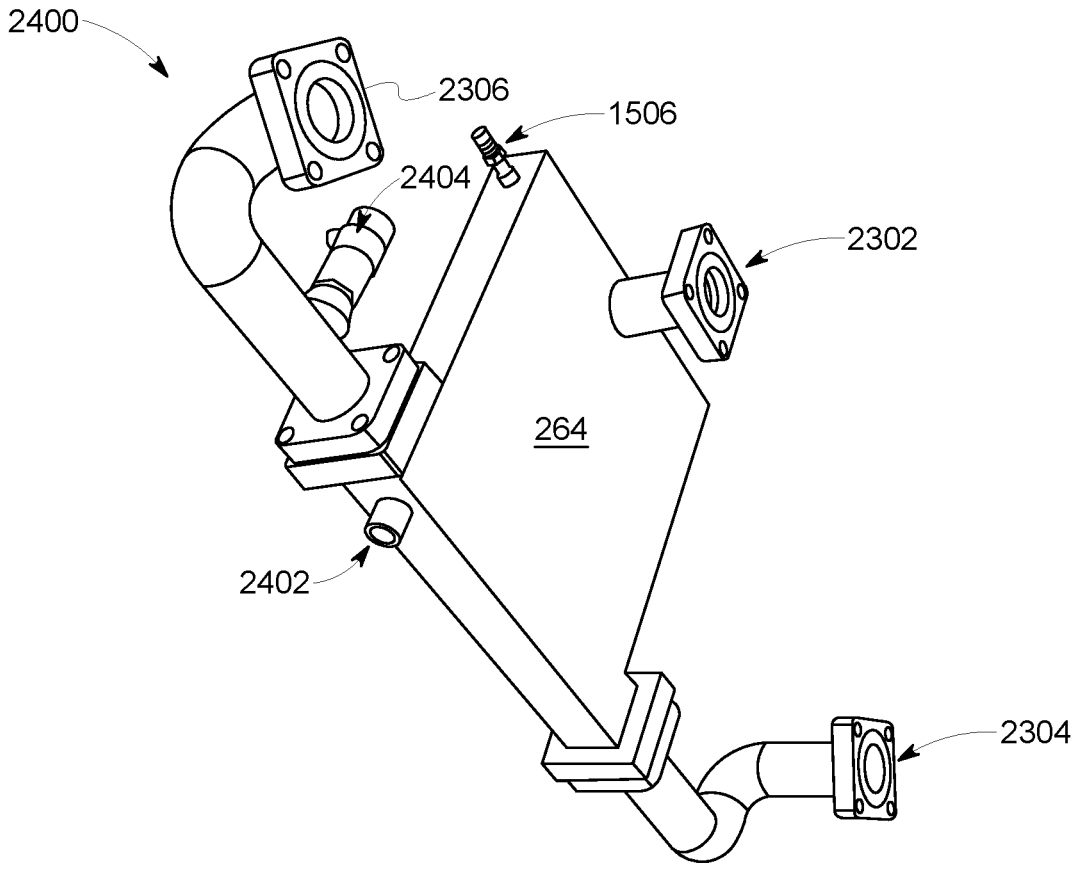
FIG. 24 is an illustration of a view of an intercooler for a compressor.

FIGS. 23 and 24 illustrate an intercooler for the compressor. FIG. 23 illustrates a view 2300 of the intercooler 264 that includes a high-pressure cylinder connector 2302, a low pressure cylinder connector 2304, and a low pressure cylinder connector 2306. In an embodiment, the intercooler 264 is sized to meet requirements of motor-driven applications and/or load. In particular, the intercooler 264 can eliminate one or more cooler covers required by a dual cooler design. Turning to FIG. 24, a perspective view 2400 is provided of the intercooler 264. The view 2400 illustrates an embodiment of the intercooler 264 that includes a drain valve or drain port 2402 (e.g., drain port with a connector to accept the drain valve and eliminates the use of a heater), a pressure relief valve 2404 (e.g., an inter-stage pressure relief valve that provides improved access for servicing or repair), and/or a pressure connect port 2406 (e.g., pressure connect port provided for diagnostics).

Figure 25:
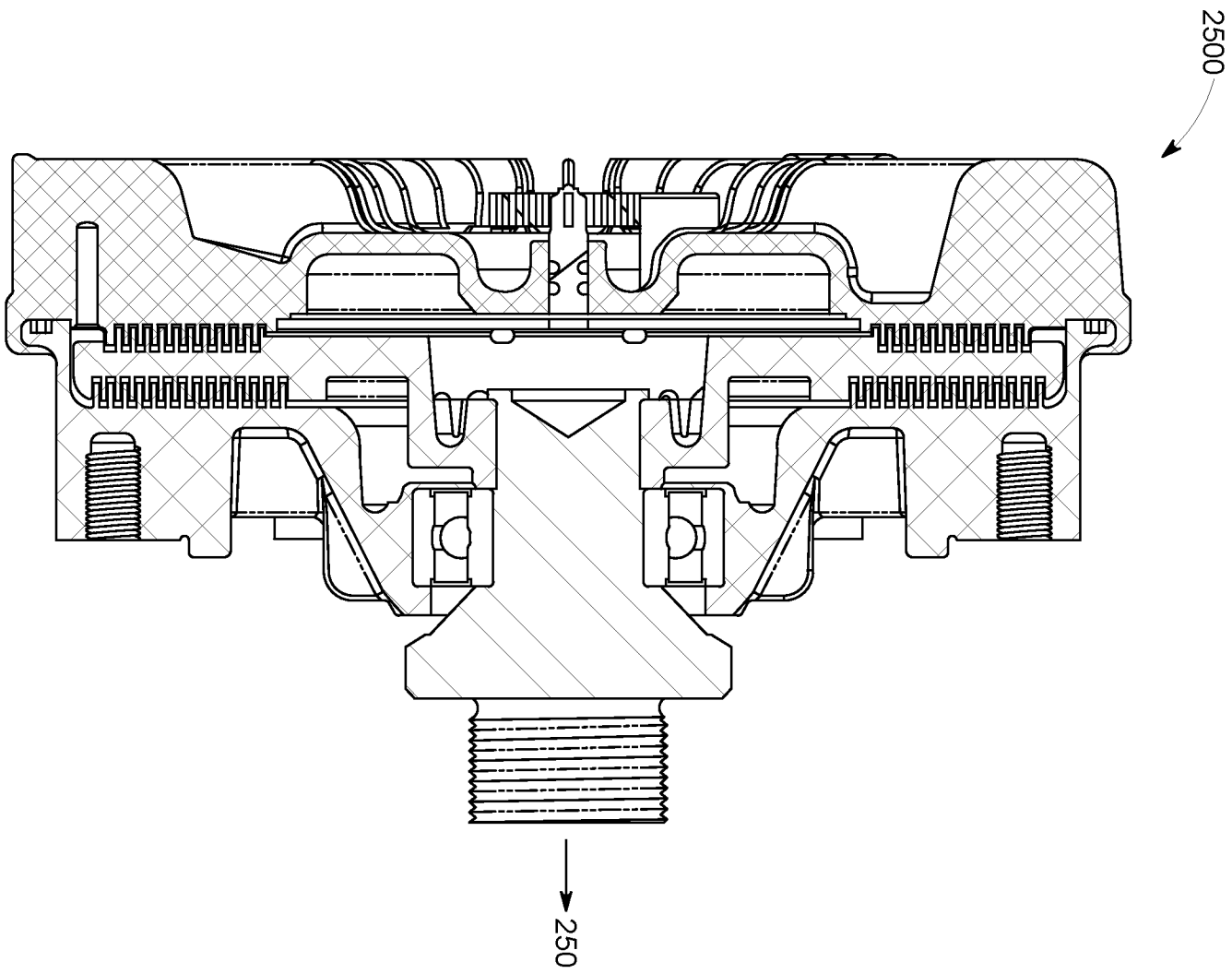
FIG. 25 is an illustration of a view of a crankshaft interface for a thermal clutch of a compressor.
Figure 26:
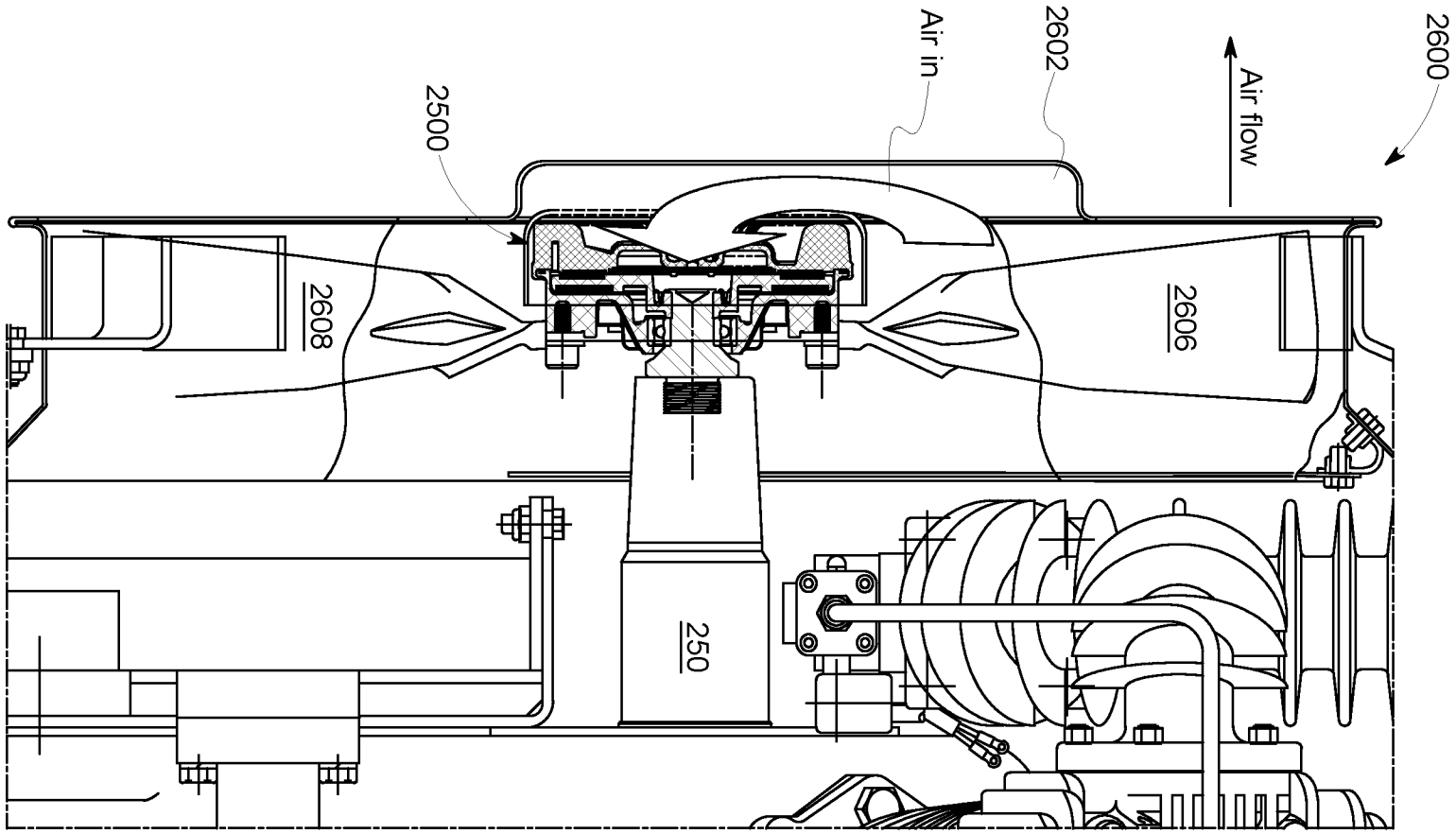
FIG. 26 is an illustration of a view of a thermal clutch and crankshaft interface for a compressor.
Figure 27:
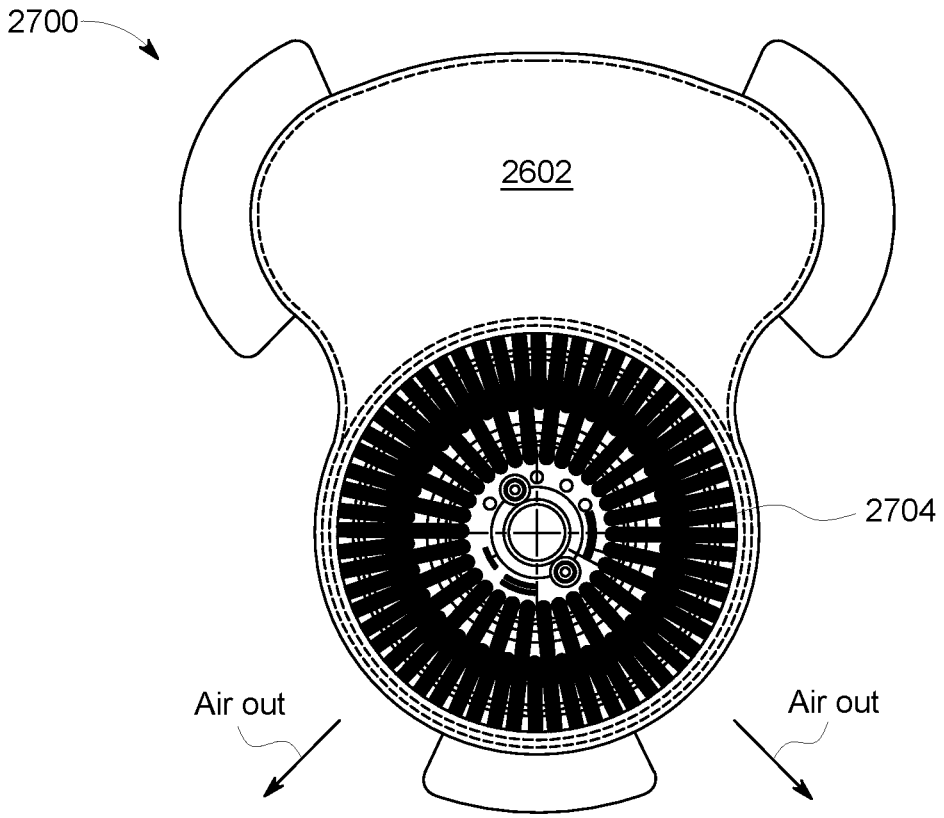
FIG. 27 is an illustration of a view of a thermal clutch for a compressor.

FIGS. 25-27 relate to a thermal clutch and interface for the compressor and in particular the crankshaft of the compressor. FIG. 25 is a cross-sectional view of a crankshaft interface 2500 that can connect to the crankshaft 250 of the compressor. Turning to FIG. 26, a cross-sectional view 2600 illustrates the crankshaft 250, a fan blade 2606, a fan blade 2608, a thermal clutch 2602, and the crankshaft interface 2500. FIG. 27 illustrates a view 2700 of the thermal clutch 2602 with a clutch mechanism 2704. In an embodiment, the thermal clutch 2602 can engage the crankshaft 250 to activate a fan (e.g., to rotate one or more fan blades 2606, 2608 for the compressor, wherein the thermal clutch 2602 engages the crankshaft 250 based upon a temperature of an air flow discharged from the compressor. By utilizing the thermal clutch 2602 with the compressor, a Revolutions Per Minute (RPM) can be reduced and/or a Horse Power (HP) can be reduced. In an embodiment, the cooling fan can be run at a reduced rate when the compressor is cold (e.g., 20% synchronous speed, for instance) and a higher rate when the compressor is hot (e.g., 90% synchronous speed, for instance). One or more clutch ducts on the thermal clutch 2602 allows the cooling fan discharge air flow to be directed continually to the thermal clutch and away from the compressor which minimizes hardware changes utilized to implement such control technique.

In one or more embodiments, the controller can be configured to employ an adjustment to the compressor based upon at least one of a detected change of pressure in the reservoir or a detected change of pressure in the reservoir during an actuation of an unloader valve. In embodiment, the pressure sensor can monitor a pressure for the reservoir with or without a cycling of an unloader valve. Upon detection of a change in the pressure, the controller can implement an adjustment to the compressor and/or communicate an alert based on the detected change.

Referring now to FIGS. 29-33, an aspect of a system and method for a compressor is disclosed that may assist in diagnosing a compressor. In operation, the compressor, such as the compressor illustrated in FIG. 29, compresses air which is stored in reservoir 180 as previously described. The pressure level of the compressed air within reservoir 180 is monitored by reservoir pressure sensor 185. When the pressure level within the reservoir has reached a determined pressure value, operation of the compressor is discontinued. At this time, the measured pressure in the reservoir is expected to remain constant until the compressor is restarted or until the compressed air is supplied to pneumatic devices or other equipment connected to the reservoir.

The crankshaft 250 can include a first end opposite a second end in which the first end is coupled to one or more connecting rods for each respective cylinder. The crankshaft, cylinders, and pistons are illustrated in BDC position in FIG. 29 based upon the location of the first end. BDC position is a location of the first end at approximately negative ninety degrees (−90 degrees) or 270 degrees. A TDC position is a location of the first end at approximately ninety degrees (90 degrees) or −270 degrees.

In an embodiment, a method of diagnosing leaks in a compressor includes monitoring the pressure of the compressed air within the reservoir 180 of a compressor, and actuating an unloader valve, such as unloader valve 268. A leak condition of the compressor is detected through recognition of a change in the monitored pressure of the compressed air within the reservoir, as measured by the reservoir pressure sensor 185, during a time period in which the unloader valve is actuated. In one embodiment, the unloader valve 268 is actuated by cycling the unloader valve between an open position and a closed position during at least a portion of the time period in which the unloader valve is actuated. In the open position, the unloader valve vents the intermediate stage reservoir relieving pressure within the cylinder 210. In the closed position, the unloader valve 268 maintains a closed volume in the intermediate stage reservoir and the cylinder 210. In another embodiment, such as a single stage compressor, the intake valve of the cylinder is the unloader valve for the cylinder. In some embodiments, the reservoir pressure sensor 185 measures or reports the measured pressure within the reservoir at a determined sample rate based on the sensor design. In such systems, the unloader valve may be cycled at a rate less than the sample rate of the monitored pressure in order to provide sufficient detection of pressure changes correlated with the movement of the unloader valve. In yet other embodiments, the unloader valve is maintained in the open position for a first duration and is maintained in the closed position for a second duration different from the first duration. The first duration and second duration may be selected to produce a desired response in the monitored pressure to facilitate detection of a leak condition. In still other embodiments, the unloader valve may be cycled between an open position and a closed position at a single known rate. In other embodiments, the unloader valve is cycled at a first rate during at least a first portion of the time period and at a second rate during at least a second portion of the time period while the reservoir pressure is monitored. A position of the unloader valve may be monitored directly or may be inferred from the commands used to direct the opening and closing of the unloader valve when performing the method. In this manner, the effect of opening and closing the unloader valve may be tailored to produce a desired result on the measured pressure with the reservoir to facilitate detection of leaks. In order to isolate the relationship between actuation of the unloader valve and the measured reservoir pressure, in some embodiments, movement of the piston 218 in the cylinder 210 is inhibited during the time period in which the unloader valve is actuated. In another embodiment, piston movement is monitored via the crankshaft position sensor 172 and movement of the piston when the unloader valve is in a closed position may be used to identify a leak in an exhaust valve 214 of the cylinder 210.

Referring to FIGS. 30-33, graphs 3000, 3100, 3200, and 3300 illustrate monitored reservoir pressure plotted during a time period in which an unloader valve is actuated to illustrated selected conditions of a compressor (e.g., compressor 110 of FIG. 1). In an embodiment, the reservoir pressure can be monitored by the pressure sensor 185, the changes, data (e.g., pressure readings, pressure signatures, measurements of pressure, among others) can be evaluated by the detection component 128 (illustrated in FIGS. 1 and 2), and the controller 130 can adjust the compressor 110 based upon the evaluation and/or monitored pressure.

Figure 30:
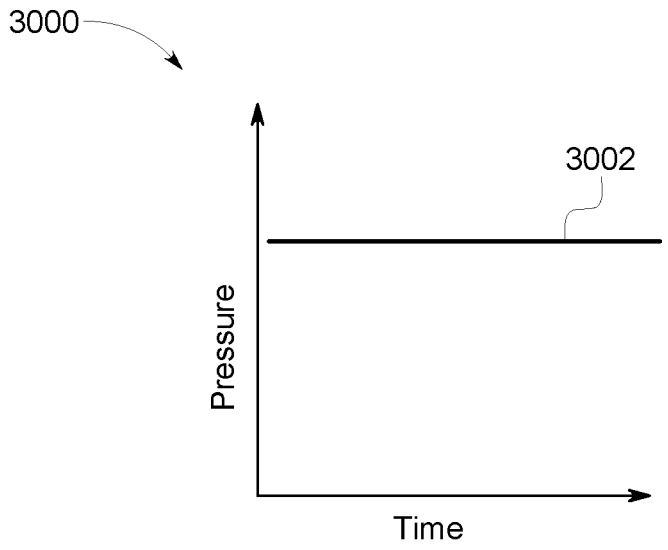
FIG. 30 is a graph illustrating a monitored pressure for a reservoir of a compressor without a leak condition.

As shown in FIG. 3000, a graph 3000 is illustrated that depicts pressure over time for a compressor. The measured pressure 3002 remains constant demonstrating that the reservoir (e.g., reservoir 180) is maintaining the compressed air at a constant pressure even when the unloader valve (e.g., unloader valve 268) is actuated. The graph in FIG. 30 represents a healthy compressor with no leakage from a valve of the compressor disposed between the reservoir and a cylinder of the compressor (e.g., exhaust valve 214, exhaust port 215, intake port 213, intake valve 212, among others).

Figure 29:
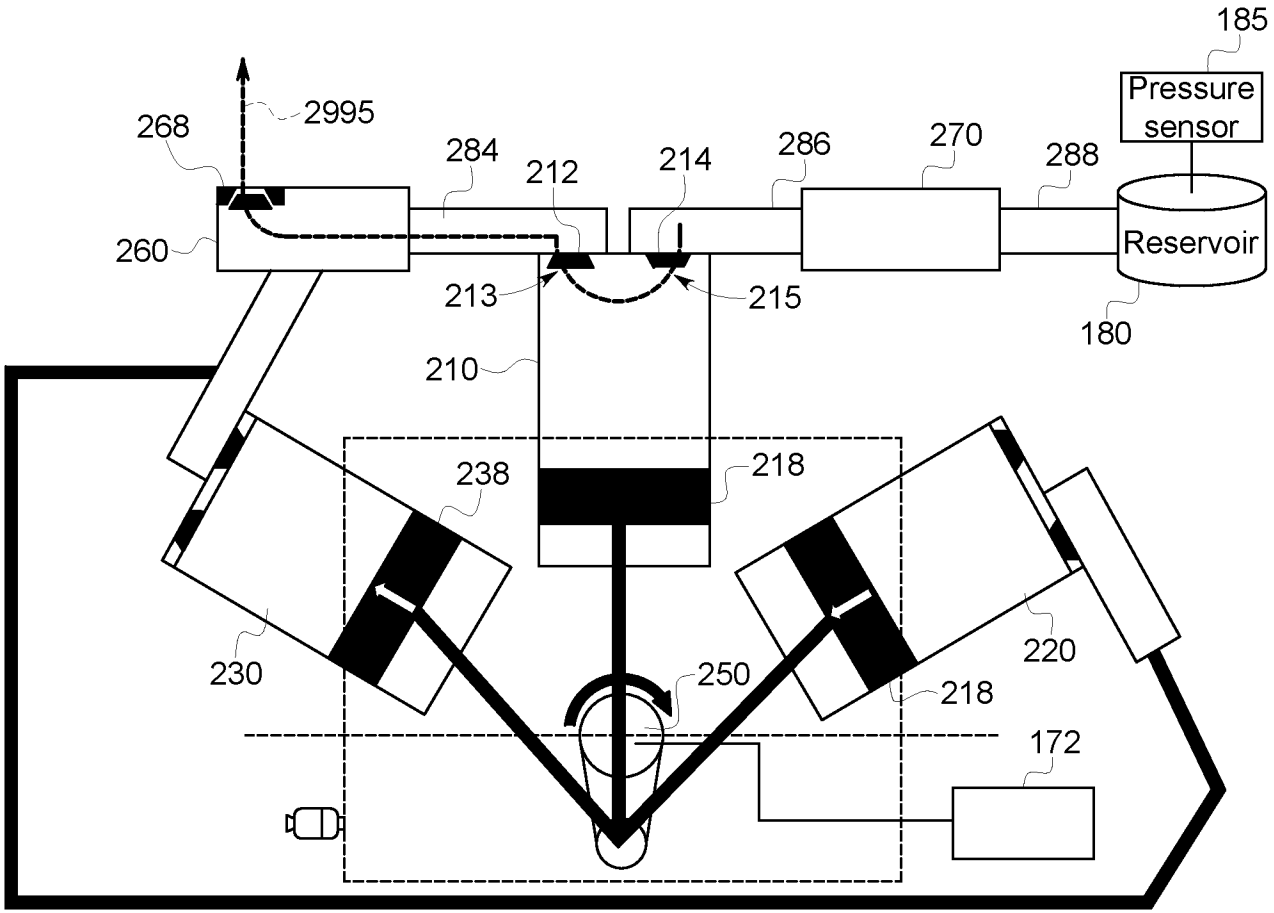
FIG. 29 is an illustration of an embodiment of a system that includes a compressor with an unloader valve in an open position.
Figure 31:
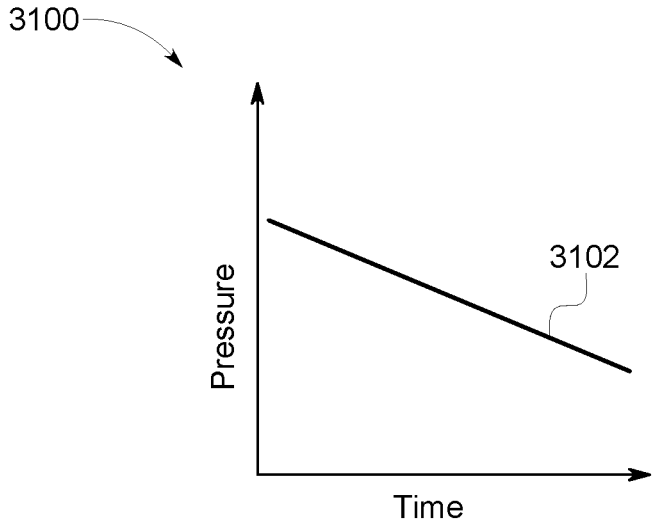
FIG. 31 is a graph illustrating a monitored pressure for a reservoir of a compressor with a leak condition.
Figure 32:
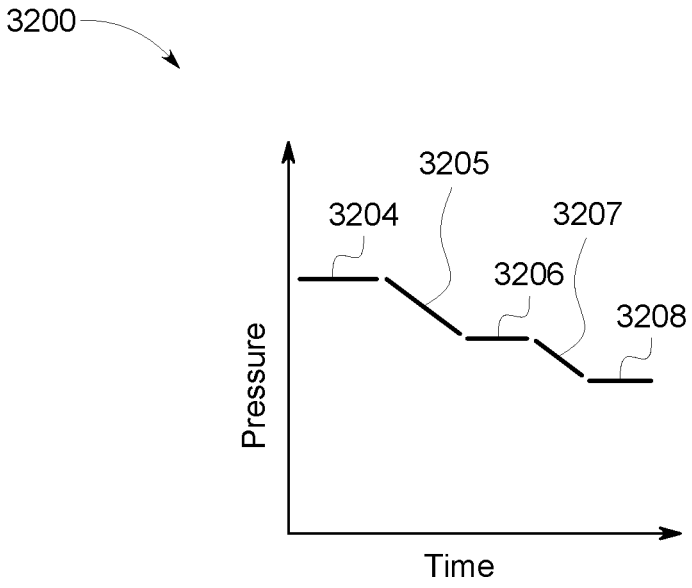
FIG. 32 is a graph illustrating a monitored pressure for a compressor.
Figure 33:
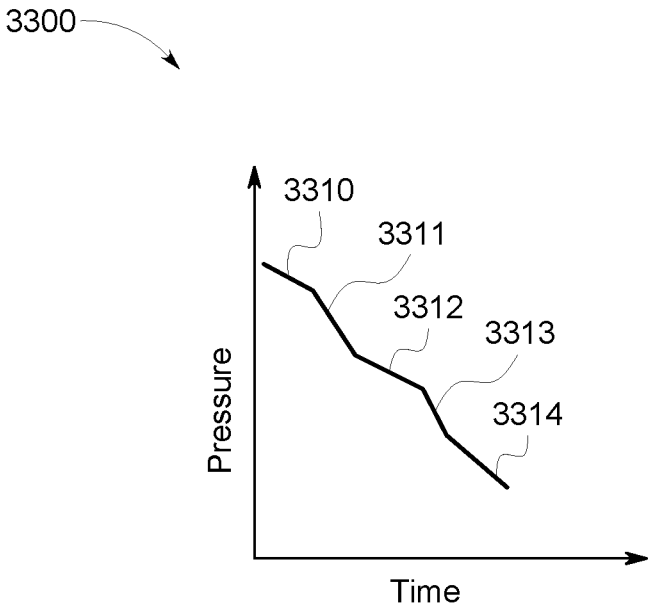
FIG. 33 is a graph illustrating a monitored pressure for a compressor.

Graph 3100 in FIG. 31 illustrates a measured pressure 3102 that is decreasing without correlation to the movement (e.g., actuation) of the unloader valve 268. The steady decline in the measured pressure 3102 may indicate a leak in the reservoir or in air lines leading to pneumatic devices that is unaffected by the movement of the unloader valve 268. In contrast to FIGS. 30 and 31, the measured pressure illustrated in FIGS. 32 and 33 is correlated to the actuation of the unloader valve. As shown in graph 3200, when the unloader valve is in the closed position, measured pressure 3204, 3206, and 3208 remains constant indicating no leaks from the reservoir 180. When the unloader valve is in the open position however, a decrease in the measured pressure 3205 and 3207 indicates that compressed air is escaping from the reservoir 180 as shown by air flow 2995 (as seen in FIG. 29). In this manner, a leak condition of the compressor is detected by correlating changes in the monitored pressure of the compressed air in the reservoir with an indication of the position of the unloader valve in either the open position or the closed position.

As one example, in the embodiment of FIG. 29, a correlation between actuation of the unloader valve and measured reservoir pressure demonstrates a leak condition of exhaust valve 214, disposed between the reservoir 180 and the cylinder 210 of the reciprocating compressor. In yet another embodiment, the correlation between measured reservoir pressure and actuation of the unloader valve may indicate leaks in both the reservoir and a valve between the reservoir a cylinder. In FIG. 33, graph 3300 illustrates changes in pressure of the reservoir during actuation of the unloader valve. When the unloader valve is in the closed position, the measured pressure 3310, 3312, and 3314 decreases, indicating a leak in the reservoir 180 analogous to graph 3100 in FIG. 31. However, when the unloader valve is in the open position, the measured pressure 3311 and 3313 decreases at a different rate, indicating an additional leak, such as in a valve between the reservoir and the cylinder 210.

FIGS. 30-33 illustrate the measured pressure in a time domain, however frequency domain analysis may also be used. A frequency domain analysis of the monitored pressure in FIGS. 32 and 33, includes a frequency component corresponding to the rate at which the unloader valve is actuated. The frequency component may be identified based upon the known rate or rates at which the unloader valve is actuated. By operating the unloader valve at different rates, different frequency components may be created and identified to facilitate determining the nature of the leak condition and identifying the components in need of maintenance.

As illustrated in FIGS. 30-33, the correlation between measured reservoir pressure and actuation of the unloader valve enables the diagnosis of leaks within a compressor system. In addition, the correlation enables discrimination between different potential failure modes improving the information available to guide maintenance and repair operations. In one embodiment, the method of diagnosing a compressor using the unloader valve is employed each time the compressor ceases operation after the reservoir reaches a determined pressure value. In other embodiments, the method of diagnosing a compressor is employed periodically, such as once per hour or once per day depending upon the application in which the compressor is utilized.

In yet another embodiment, a controller (e.g., controller 130) is provided to determine the condition of a compressor. The controller is configured to receive a signal corresponding to a monitored pressure of compressed air within a reservoir of the compressor, and detect a leak condition of the compressor through recognition of a change in the monitored pressure of the compressed air within the reservoir during a time period in which an unloader valve of the compressor is actuated. In an embodiment, the controller is integral with a vehicle system, such as controller 130. In yet another embodiment, the controller is provided with a test kit used for maintenance and repair or diagnostic operations. The controller may be further configured to actuate the unloader valve of the compressor, and may interface with controller 130 or directly with compressor actuators 152. In addition, the controller is configured to communicate with one or more reservoir pressure sensors 185 and receive the signal corresponding to the monitored pressure. Additionally, the controller is configured to communicate with the detection component (illustrated in FIGS. 1 and 2). In an embodiment, the controller is configured to correlate changes in the signal corresponding to the monitored pressure of the compressed air within the reservoir with a position of the unloader valve. The controller may analyze the monitored pressure in the time domain, the frequency domain, or both as described above. In this manner, controller implements the prognostic method and is configured to generate diagnostic information about the compressor prior to a compressor failure.

Upon detecting a leak or potential fault in the compressor system, a variety of steps may be taken to reduce further degradation of the components and facilitate repair. In an embodiment, a signal is generated in response to recognizing a change in the monitored pressure during a time period in which the unloader valve is actuated. The generated signal is indicative of a severity level of the leak condition, where the severity level corresponds to the change in the monitored pressure when the unloader valve is actuated. In an embodiment, in response to the signal, the duty cycle of the compressor is reduced in order to reduce further degradation of the compressor until repairs can be made. The duty cycle may be reduced by a fixed amount, such as by 25%, 50% or more, or may be reduced in proportion to the severity of the identified failure. If the leak condition is severe, power to the compressor may be disconnected such that the compressor ceases operating until appropriate repairs have been effected. In another embodiment, personnel are notified by an audio alarm, a visual alarm, a text message, an email, an instant message or a phone call. In a system having multiple compressors, in response to a detected leak on one compressor the operation of the other compressors may be adjusted to compensate for the reduced performance of the leaking compressor allowing the overall system to remain functional until repairs can be scheduled.

In various other embodiments, the aspects of the systems and methods previously described may also be employed individually or in combination to diagnose the condition of a compressor. In one embodiment, a method for diagnosing a compressor includes operating a compressor in an unloaded condition by cycling the pistons within their respective cylinders, monitoring at least the reservoir pressure and the crankcase pressure, and determining a condition of the compressor based on an analysis of both the monitored reservoir pressure and crankcase pressure. In another embodiment, a method for diagnosing a compressor includes operating a multi-stage compressor to charge a reservoir with compressed air, monitoring at least a crankcase pressure and an intermediate stage pressure, and determining a condition of the compressor based on an analysis of both the monitored crankcase pressure and the monitored intermediate stage pressure. In yet another embodiment, a method for diagnosing a compressor includes monitoring signals from at least two of a primary reservoir pressure sensor, an intermediate reservoir pressure sensor, a crankcase pressure sensor, and a crankshaft position sensor, and correlating the monitored signals to identify a failure condition of the compressor. In yet another embodiment, a method of diagnosing a compressor includes actuating an unloader valve, monitoring at least a reservoir pressure sensor and a crankshaft position sensor, and identifying a leak condition of a valve disposed between a cylinder and a reservoir of a compressor. By way of example and not limitation, the subject disclosure can be utilized alone or in combination with a system and/or method disclosed in U.S. Provisional Application Ser. No. 61/636,192, filed Apr. 20, 2012, and entitled "SYSTEM AND METHOD FOR A COMPRESSOR" in which the entirety of the aforementioned application is incorporated herein by reference.

The methods and systems disclosed herein may be applied to a reciprocating compressor having one or more compressor stages, such as the compressor illustrated in FIG. 2. In other embodiments, the methods and systems may be applied to other types of compressors. For example, the compressor may be a diaphragm or membrane compressor in which the compression is produced by movement of a flexible membrane. The compressor may also be a hermetically sealed or semi-hermetically sealed compressor. In addition, the compressor types may include centrifugal compressors, diagonal or mixed flow compressors, axial flow compressors, rotary screw compressors, rotary vane compressors, and scroll compressors, among others.

The methods presently disclosed may also include generating a signal corresponding to the failure condition and alerting an operator or other personnel so that remedial action may be taken. Each of these systems and methods described above may also be implemented on a vehicle system such as the rail vehicle 106 described above. In still yet other embodiments, a test kit is provided that includes a controller having a memory and a processor configured to perform the methods described above.

In each of the embodiments presently disclosed, component fault data may be recorded. In one embodiment, component fault data may be stored in a database including historical compressor data. For example, the database may be stored in memory 134 of controller 130. As another example, the database may be stored at a site remote from rail vehicle 106. For example, historical compressor data may be encapsulated in a message and transmitted with communications system 144. In this manner, a command center may monitor the health of the compressor in real-time. For example, the command center may perform steps to diagnose the condition of the compressor using the compressor data transmitted with communications system 144. For example, the command center may receive compressor data including cylinder pressure data from rail vehicle 106, reservoir pressure, intermediate stage pressure, crankcase pressure, displacement of one or more pistons, and/or movement of the crankshaft to diagnose potential degradation of the compressor. Further, the command center may schedule maintenance and deploy healthy locomotives and maintenance crews in a manner to optimize capital investment. Historical compressor data may be further used to evaluate the health of the compressor before and after compressor service, compressor modifications, and compressor component change-outs.

If a leak or other fault condition exists, further diagnostics and response may be performed. For example, a potential faulty valve condition can be reported to notify appropriate personnel. In an embodiment, reporting is initiated with a signal output to indicate that a fault condition exists. The report is presented via display 140 or a message transmitted with communications system 144, as examples. Once notified, the operator may adjust operation of rail vehicle 106 to reduce the potential of further degradation of the compressor.

In one embodiment, a message indicating a potential fault is transmitted with communications system 144 to a command center. Further, the severity of the potential fault may be reported. For example, diagnosing a fault based on the above described methods may allow a fault to be detected earlier than when the fault is diagnosed with previously available means. In some applications, the compressor is permitted to continue operating when a potential fault is diagnosed in the early stages of degradation. In other applications, the compressor is stopped or maintenance may be promptly scheduled, such as when the potential fault is diagnosed as severe. In this manner, the cost of secondary damage to the compressor can be avoided by early and accurate detection.

The severity of the potential fault may be determined based upon an analysis of one or more parameters from one or more diagnostic methods. For example, it may be more desirable to switch off the compressor than to have a degraded cylinder fail in a manner that may cause additional damage to the compressor. In one embodiment, a threshold value or one or more monitored parameters may be determined that indicates continued operation of the compressor is undesirable because the potential fault is severe. As one example, the potential fault may be judged as severe if the leakage of an exhaust valve exceeds a predetermined threshold.

In some embodiments, a request to schedule service is sent, such as by a message sent via communications system 144. Further, by sending the potential fault condition and the severity of the potential fault, down-time of rail vehicle 106 may be reduced. For example, service may be deferred on rail vehicle 106 when the potential fault is of low severity. Down-time may be further reduced by derating power of the compressor, such as by adjusting a compressor operating parameter based on the diagnosed condition.

In yet other embodiments, backup or redundant systems may be available. In an example, backup systems can be evaluated to determine if adequate substitute resources exist to replace the compromised compressor. In some instances, a pre-ordered list of backup systems is used to prioritize the use of backup systems, such as other compressors configured to supply compressed air to pneumatic devices on a plurality of rail vehicles. Various backup systems may be employed including stopping the faulty compressor and receiving charged air from another source. In one example, the other source is a compressor that is disposed on an adjacent locomotive engine. In another example, the other source is a redundant compressor on the same locomotive that is used for this purpose. The backup procedure can be designed to minimize negative system-wide consequences to operation of the locomotive. This is especially true for mission critical systems.

The aforementioned systems, components, (e.g., controller, detection component, pressure sensor, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

In view of the exemplary devices and elements described supra, methodologies that may be implemented in accordance with the disclosed subject matter will be better appreciated with reference to the flow charts of FIGS. 7, 11, 28, and 34. The methodologies are shown and described as a series of blocks, the claimed subject matter is not limited by the order of the blocks, as some blocks may occur in different orders and/or concurrently with other blocks from what is depicted and described herein. Moreover, not all illustrated blocks may be required to implement the methods described hereinafter. The methodologies can be implemented by a component or a portion of a component that includes at least a processor, a memory, and an instruction stored on the memory for the processor to execute.

Figure 7:
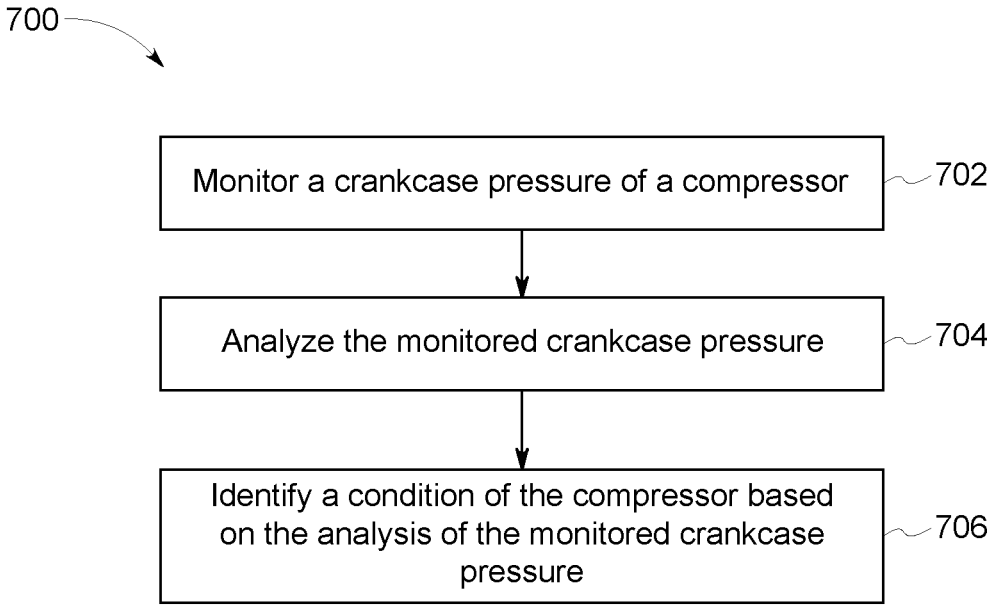
FIG. 7 is a flow chart of an embodiment of a method for identifying a condition of a compressor based upon a measured crankcase pressure.

FIG. 7 illustrates a flow chart of a method 700 for identifying a condition of a compressor based upon a measured crankcase pressure. At reference numeral 702, a crankcase pressure of a compressor can be monitored. At reference numeral 704, the monitored crankcase pressure can be analyzed. At reference numeral 706, a condition of the compressor can be identified based on the analysis of the monitored crankcase pressure.

Figure 11:
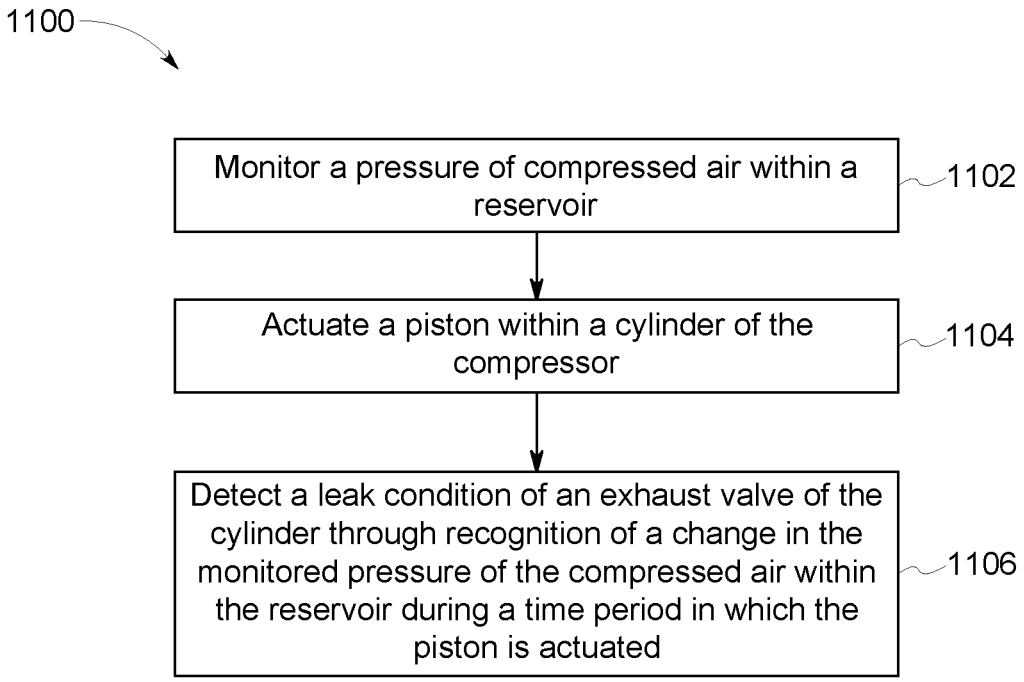
FIG. 11 is a flow chart of an embodiment of a method for identifying a leak condition for a compressor based upon a cycling piston.

FIG. 11 illustrates a flow chart of a method 1100 for identifying a leak condition for a compressor based upon a cycling piston. At reference numeral 1102, a pressure of compressed air within a reservoir can be monitored. At reference numeral 1104, a piston within a cylinder of the compressor can be actuated. At reference numeral 1106, a leak condition of an exhaust valve of the cylinder can be detected through recognition of a change in the monitored pressure of the compressed air within the reservoir during a time period in which the piston is actuated.

Figure 28:
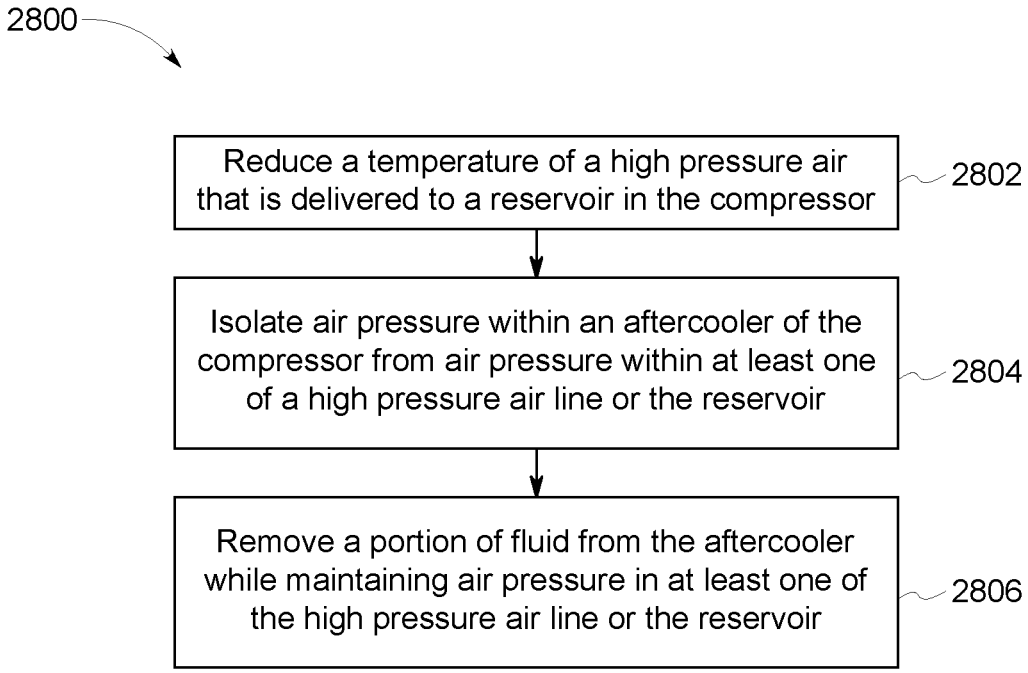
FIG. 28 is a flow chart of an embodiment of a method for removing fluid from an aftercooler while maintaining pressure in a reservoir of a compressor.

FIG. 28 illustrates a flow chart of a method 2800 for removing fluid from an aftercooler while maintaining pressure in a reservoir of a compressor. At reference numeral 2802, a temperature of a high-pressure air that is delivered to a reservoir in the compressor can be reduced. In an embodiment, the temperature can be reduced by an aftercooler. At reference numeral 2804, air pressure within an aftercooler of the compressor can be isolated from air pressure within at least one of a high-pressure air line or the reservoir. In an embodiment, the air pressure can be isolated with a check valve between the reservoir and the aftercooler. At reference numeral 2806, a portion of fluid can be removed from the aftercooler while maintaining air pressure in at least one of the high-pressure air line or the reservoir.

Figure 34:
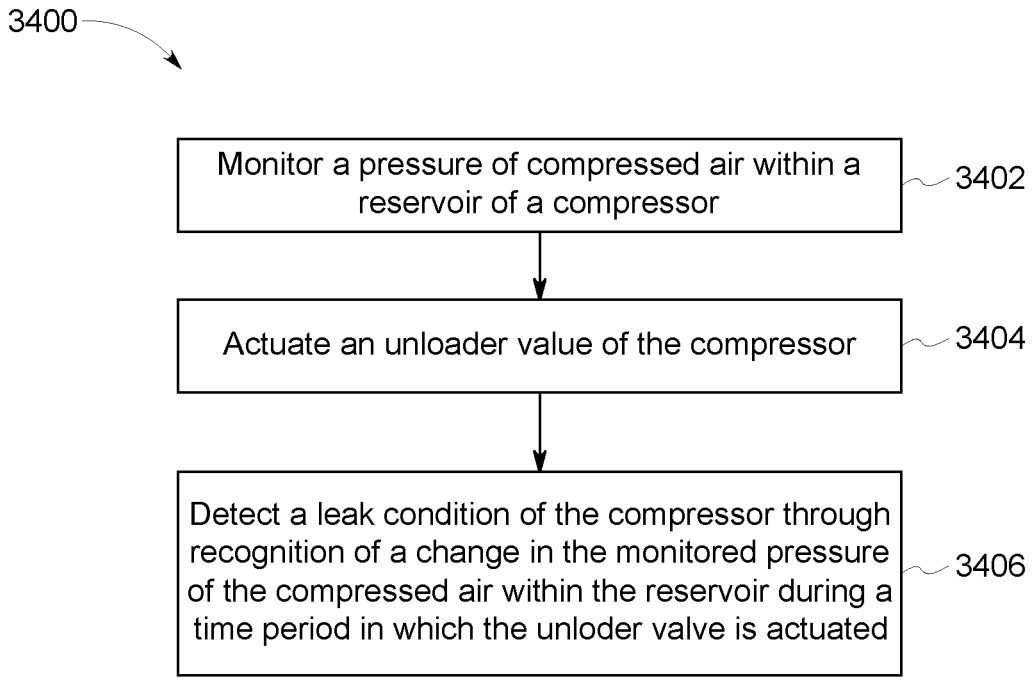
FIG. 34 is a flow chart of an embodiment of a method for identifying a leak condition for a compressor based upon a cycling unloader valve.

FIG. 34 illustrates a flow chart of a method 3400 for identifying a leak condition for a compressor based upon a cycling unloader valve. At reference numeral 3402, a pressure of compressed air within a reservoir of a compressor can be monitored. For example, the pressure sensor 185 can monitor the pressure of compressed air within the reservoir of a compressor. At reference numeral 3404, an unloader valve of the compressor can be actuated. For instance, the unloader valve can be actuated between an open position to a closed position, wherein each actuation (e.g., open position, closed position, transitioning between open position and/or close position, among others) can be for a duration of time. In an example, the controller 130 can actuate an unloader valve. At reference numeral 3406, a leak condition of the compressor can be detected through recognition of a change in the monitored pressure of the compressed air within the reservoir during a time period in which the unloader valve is actuated. For example, the detection component 128 can detect a pattern of the monitored pressure of the compressed air during a time period.

In an embodiment, a method for a compressor is provided that includes monitoring a crankcase pressure of a compressor; analyzing the monitored crankcase pressure; and determining a condition of the compressor based on the analysis of the monitored crankcase pressure. In embodiment, the method can include analyzing the monitored crankcase pressure by calculating an average of the crankcase pressure over a time period; and comparing the average crankcase pressure over the time period to a nominal crankcase average pressure. In an embodiment, the method includes determining a condition of the compressor based on the difference between the calculated crankcase average pressure and the nominal crankcase average pressure. In an embodiment, the method includes determining the nominal crankcase average pressure from at least one of ambient air temperature and ambient air pressure. In an embodiment, the method includes determining the nominal crankcase average pressure from at least one of compressor speed, reservoir pressure, and oil temperature.

In an embodiment, the method includes analyzing the monitored crankcase pressure by identifying frequency content of the monitored crankcase pressure at one or more known frequencies. In an embodiment, the method includes determining the one or more known frequencies based on a rate at which the compressor is operated. In an embodiment, the method includes analyzing the monitored crankcase pressure by correlating the monitored crankcase pressure with an indication of the position of one or more pistons of the compressor during a time period in which the one or more pistons are operated. In an embodiment, the method includes determining a condition of the compressor by identifying a condition of one of a plurality of cylinders of the compressor based on a correlation of the monitored crankcase pressure and an indication of the position of the piston in the cylinder of the compressor.

In an embodiment, the method includes determining a condition of the compressor by identifying a piston blow-by condition of at least one cylinder of the compressor based on the analysis of the monitored crankcase pressure. In an embodiment, the method includes determining a condition of the compressor by identifying a crankcase breather valve failure based on the analysis of the monitored crankcase pressure. In an embodiment, the method includes monitoring the crankcase pressure of a compressor while a piston is cycled within a cylinder of the compressor in an unloaded condition. In an embodiment, the method includes monitoring the crankcase pressure of the compressor while a piston is cycled within a cylinder of the compressor in a loaded condition.

In an embodiment, the method includes monitoring the crankcase pressure of the compressor during a first time period during which a piston is cycled within a cylinder of the compressor in an unloaded; monitoring the crankcase pressure of the compressor during second time period during which the piston is cycled within the cylinder of the compressor in a loaded condition; and determining a condition of the compressor based on the analysis of the monitored crankcase pressure from the first time period and the second time period.

In an embodiment, the method includes generating a signal in response to determining a condition of the compressor based on the analysis of the monitored crankcase pressure. In an embodiment, the method includes reducing a duty cycle of the compressor in response to determining a condition of the compressor based on the analysis of the monitored crankcase pressure. In an embodiment, the method includes notifying personnel via one or more of an audio alarm, a visual alarm, a text message, an email, an instant message, or a phone call in response to determining a condition of the compressor based on the analysis of the monitored crankcase pressure.

In an embodiment, a controller that is operable to determine a condition of a compressor is provided in which the controller is configured to receive a signal corresponding to a monitored pressure within a crankcase of the compressor; analyze the monitored crankcase pressure; and identify a condition of the compressor based on the analysis of the monitored crankcase pressure. In an embodiment, the condition of the compressor is a piston blow-by condition of at least one cylinder of the compressor. In an embodiment, the condition of the compressor is a crankcase breather valve failure. In an embodiment, the controller is further configured to calculate an average of the crankcase pressure over a time period; and compare the average crankcase pressure over the time period to a nominal crankcase average pressure. In an embodiment, the controller is further configured to communicate with one or more crankcase pressure sensors and receive the signal corresponding to the monitored pressure from the one or more crankcase pressure sensors.

In embodiments, a system is disclosed. The system includes an engine; a compressor operatively connected to the engine, wherein the compressor includes a crankcase having a crankcase pressure sensor; a controller that is operable to determine a condition of the compressor, wherein the controller is configured to receive a signal corresponding to a monitored pressure within the crankcase of the compressor from the crankcase pressure sensor, analyze the monitored crankcase pressure; and determine a condition of the compressor based on the analysis of the monitored crankcase pressure.

In embodiments, a compressor system is disclosed that includes means for means for monitoring a crankcase pressure of a compressor (for example, a crankcase pressure of a compressor can be monitored by the pressure sensor 170, the sensor 172, the detection component 128, among others); means for analyzing the monitored crankcase pressure (for example, the analysis of the monitored crankcase pressure can be provided by the controller 130, the detection component 128, among others); and means for determining a condition of the compressor based on the analysis of the monitored crankcase pressure (for example, the condition of the compressor can be determined by the controller 130).

In an embodiment, a compressor can be provided that includes a sensor configured to measure pressure in a crankcase of a compressor and means for determining the position of a piston in a cylinder of the compressor, wherein the piston is operably connected to a crankshaft in the crankcase of the compressor. In the embodiment, the compressor can further include means for determining a condition of the compressor based on a correlation of the monitored crankcase pressure and an indication of a position of a piston in a cylinder of the compressor. Furthermore, the means for determining the position of a piston in a cylinder of the compressor can include a crankshaft position sensor.

In an embodiment, a method for a compressor is provided that includes monitoring a pressure of compressed air within a reservoir; actuating a piston within a cylinder of the compressor; and detecting a leak condition of an exhaust valve of the cylinder through recognition of a change in the monitored pressure of the compressed air within the reservoir during a time period in which the piston is actuated. In an embodiment, the method can further include detecting a leak condition of the exhaust valve of the cylinder by correlating the monitored pressure of the compressed air within the reservoir with an indication of a position of the piston in the cylinder. In an embodiment, the method includes filling the reservoir with compressed air to a determined pressure value, wherein the reservoir is configured to store compressed air to be provided to at least one pneumatic device.

In an embodiment of the method, actuating the piston within the cylinder can include cycling the piston within the cylinder at a first rate during a first portion of the time period and cycling the piston within the cylinder at a second rate during a second portion of the time period. In an embodiment, detecting a leak condition of the exhaust valve of the cylinder includes recognizing a once-per-revolution signature in a frequency analysis of the monitored pressure, wherein the once-per-revolution signature corresponds to a rate at which the piston is actuated within the cylinder.

In an embodiment, actuating the piston within the cylinder includes cycling the piston within the cylinder in an unloaded condition. In an embodiment, actuating the piston within the cylinder can include cycling the piston within the cylinder in a loaded condition. In an embodiment, detecting a leak condition of the exhaust value of the cylinder further includes recognizing a reduction in the monitored pressure corresponding to a suction stroke of the piston in the cylinder. In an embodiment, detecting a leak condition of the exhaust valve of the cylinder further includes recognizing an increase in the monitored pressure corresponding to a compression stroke of the piston in the cylinder.

In an embodiment, the method also includes generating a signal in response to recognizing a change in the monitored pressure of the compressed air within the reservoir during a time period in which the piston is actuated. In an embodiment, the method includes reducing a duty cycle of the compressor in response to recognizing a change in the monitored pressure of the compressed air within the reservoir during a time period in which the piston is actuated. In an embodiment, the method includes notifying personnel via one or more of an audio alarm, a visual alarm, a text message, an email, an instant message, or a phone call in response to recognizing a change in the monitored pressure of the compressed air within the reservoir during a time period in which the piston is actuated.

In an embodiment, a controller that is operable to determine a condition of a compressor is disclosed. The controller is configured to receive a signal corresponding to a monitored pressure of compressed air within a reservoir of a compressor; and detect a leak condition of an exhaust valve of a cylinder of the compressor through recognition of a change in the monitored pressure of the compressed air within the reservoir during a time period in which a piston is actuated within the cylinder. In an embodiment, the controller is further configured to actuate the piston within the cylinder of the compressor during at least a portion of the time period. The controller 130 can actuate a piston within the compressor such that the actuation is outside the compressor's normal duty cycle for compressing air. During this actuation outside the normal duty cycle, the system can detect a leak condition based upon comparisons of the monitored pressure. In another embodiment, the controller 130 can actuate the piston within the compressor such that the actuation is inside the compressor's normal duty cycle for compressing air. During this actuation inside the normal duty cycle, the system can detect a leak condition based upon comparison of the monitored pressure. Thus, the controller 130 can actuate the piston outside the compressor's normal duty cycle, inside the compressor's normal duty cycle, an alternating actuating of the piston from inside or outside the normal duty cycle, or a combination thereof. In an embodiment, the controller is further configured to correlate the signal corresponding to the monitored pressure of the compressed air within the reservoir with an indication of a position of the piston in the cylinder of the compressor. In an embodiment, the controller is further configured to actuate the piston within the cylinder of the compressor in an unloaded condition. In an embodiment, the controller is further configured to actuate the piston within the cylinder of the compressor in a loaded condition.

In an embodiment, the controller is further configured to recognize a reduction in the monitored pressure corresponding to a suction stroke of the piston in the cylinder. In an embodiment, the controller is further configured to recognize an increase in the monitored pressure corresponding to a compression stroke of the piston in the cylinder. In an embodiment, the controller is further configured to recognize a once-per-revolution signature in a frequency analysis of the monitored pressure, wherein the once-per-revolution signature corresponds to a rate at which the piston is actuated within the cylinder. In an embodiment, the controller is further configured to communicate with one or more reservoir pressure sensors and receive the signal corresponding to the monitored pressure from the one or more reservoir pressure sensors.

In embodiments, a system is disclosed that includes an engine; a compressor operatively connected to the engine, wherein the compressor includes a reservoir configured to store compressed air; a controller that is operable to determine a condition of the compressor, wherein the controller is configured to receive a signal corresponding to a monitored pressure of compressed air within the reservoir, and detect a leak condition of an exhaust valve of a cylinder of the compressor through recognition of a change in the monitored pressure of the compressed air within the reservoir during a time period in which a piston is actuated within the cylinder.

In embodiments, a compressor system is disclosed that includes means for means for monitoring a pressure of compressed air within a reservoir (for instance, a pressure sensor 185 can monitor a pressure of compressed air within a reservoir); means for actuating a piston within a cylinder (for example, a controller 130 can actuate a piston within a cylinder); and means for detecting a leak condition of an exhaust valve of the cylinder through recognition of a change in the monitored pressure of the compressed air within the reservoir during a time period in which the piston is actuated (for example, a detection component 128 can detect a leak condition of an exhaust valve of the cylinder).

In an embodiment, a compressor can be provided that includes a reservoir configured to receive and store compressed air for use with at least one pneumatic device and a sensor configured to monitor a pressure of compressed air within the reservoir. The compressor can additionally include a compressor stage that has an exhaust port and an exhaust valve configured to seal the exhaust port, wherein the compressor stage is configured to compress air and discharge the compressed air through the exhaust port into the reservoir. In the embodiment, the compressor can further include means for detecting a leak condition of the compressor through recognition of a change in the monitored pressure of the compressed air within the reservoir during a time period in which the compressor stage is operated in an unloaded condition.

In the embodiment, the compressor stage can include a cylinder and a piston, wherein the piston is actuated in the cylinder to compress air to be discharged into the reservoir through the exhaust port. In the embodiment, the compressor can include means for unloading the compressor stage by venting the compressor stage to atmospheric pressure.

In an embodiment, a system is provided that includes a filter that is external to the compressor that filters oil used with an engine, wherein the filter is coupled to an external surface of the compressor through a manifold. In the embodiment, the manifold can include a vent pin that enables oil to flow from the filter to the engine. In such embodiment, the vent pin can be configured to restrict a flow of oil from the filter to the engine via an oil vent and to enable oil flow from the filter to the engine via an oil vent. In the embodiment, the manifold can further include a pre-filter port that is configured to be utilized with an oil pump.

In an embodiment, the system can include an aftercooler coupled to o a high-pressure cylinder of the compressor with a single exhaust pipe. In an embodiment, the system can include an intercooler coupled at least two low pressure cylinders of the compressor and a high-pressure cylinder of the compressor. In an embodiment, the system can include an actuation line connecting at least one unloader valve of at least one low pressure cylinder of the compressor to at least one unloader valve of at least one high-pressure cylinder of the compressor; a drain line connecting a drain valve of an intercooler of the compressor to the drain valve of the aftercooler of the compressor; and a discharge line that is coupled to at least one of the actuation line or the drain line that flows to the atmosphere for release thereto. In the embodiment, a controller can be configured to actuate the at least one unloader valve of the at least one low pressure cylinder, the at least one unloader valve of the at least one high-pressure cylinder, the drain valve of the aftercooler, the drain valve of the intercooler, and the drain valve of the aftercooler at substantially the same time. In the embodiment of the system, the actuation can open each valve to the discharge line for flow to the atmosphere. In the embodiment of the system, the controller can be configured to actuate the check valve and the drain valve when the compressor is in an unloaded condition.

In the embodiment, the controller can be further to actuate at least one of the check valve or the drain valve prior to starting of the compressor. In the embodiment, the controller further configured to determine a high-pressure cylinder discharge valve leak with an exhaust port based upon a flow from at least one of the check valve or the drain valve to the atmosphere. In an embodiment, a propulsion system can be provided with the system and can include a thermal clutch that engages a crankshaft to activate a fan for the compressor, wherein the thermal clutch engages the crankshaft based upon a temperature of an air flow discharged from the compressor.

In an embodiment, a method is provided that includes a step of removing the portion of fluid from the after cooler prior to starting a compressor to reduce air pressure resisting a high-pressure cylinder head. In an embodiment, a method is provided that includes the steps of measuring a flow of the portion of fluid from the aftercooler; and identifying a high-pressure cylinder discharge valve leak with an exhaust port based upon the measured flow. In an embodiment, a method is provide that includes the steps of engaging a thermal clutch with a crankshaft of the compressor based upon a temperature of an air flow discharged from the compressor; and activating a fan based upon the engagement of the thermal clutch. In an embodiment, a method is provided that includes the steps of filtering a portion of oil with an external oil filter for use with an engine of the compressor; flowing air from at least one unloader valve of a first low pressure cylinder to a drain valve coupled to at least one of the aftercooler or an intercooler of the compressor; flowing air from at least one unloader valve of a second low pressure cylinder to the drain valve; flowing air from at least one unloader valve of a first high-pressure cylinder to the drain valve; or flowing air or the portion of fluid through the drain valve of the aftercooler to the atmosphere.

In another embodiment, the method includes filling the reservoir with compressed air to a determined pressure value. In another embodiment, detecting a leak condition of the compressor includes correlating changes in the monitored pressure of the compressed air within the reservoir with an indication of a position of the unloader valve.

In another embodiment, detecting a leak condition of the compressor includes detecting a leak condition of a valve of the compressor disposed between the reservoir and a cylinder of the compressor. In another embodiment, detecting a leak condition of the compressor includes detecting a leak condition of the reservoir of the compressor.

In another embodiment, actuating the unloader valve of the compressor includes cycling the unloader valve between an open position and a closed position during at least a portion of the time period. In another embodiment, during said at least the portion of the time period the unloader valve is maintained in the open position for a first duration and is maintained in the closed position for a second duration, wherein the first duration is not equal to the second duration.

In another embodiment, actuating the unloader valve of the compressor includes cycling the unloader valve between an open position and a closed position at a known rate during at least a portion of the time period. In another embodiment, actuating the unloader valve of the compressor includes cycling the unloader valve between an open position and a closed position at a first rate during a first portion of the time period and at a second rate during at least a second portion of the time period. In another embodiment, actuating the unloader valve of the compressor includes unloading the compressor.

In another embodiment, the method further includes generating a signal in response to recognizing a change in the monitored pressure during a time period in which the unloader valve is actuated, wherein the signal corresponds to a severity level of a leak condition. In another embodiment, the method further includes reducing a duty cycle of the compressor in response to recognizing a change in the monitored pressure during a time period in which the unloader valve is actuated. In another embodiment, the method further includes notifying personnel via one or more of an audio alarm, a visual alarm, a text message, an email, an instant message, or a phone call in response to recognizing a change in the monitored pressure during a time period in which the unloader valve is actuated.

In an embodiment, a controller that is operable in association with a compressor is disclosed. The controller is configured to receive a signal corresponding to a monitored pressure of compressed air within a reservoir of a compressor; and detect a leak condition of the compressor through recognition of a change in the monitored pressure of the compressed air within the reservoir during a time period in which an unloader valve of the compressor is actuated. In an embodiment, the controller is further configured to actuate the unloader valve of the compressor. In another embodiment, the controller is further configured to correlate changes in the signal corresponding to the monitored pressure of the compressed air within the reservoir with a position of the unloader valve. In another embodiment, the controller is further configured to detect a leak condition of a valve of the compressor disposed between the reservoir and a cylinder of the compressor. In another embodiment, the controller is further configured to actuate the unloader valve by cycling the unloader valve between an open position and a closed position at a known frequency during at least a portion of the time period. In an embodiment, the controller is further configured to communicate with one or more reservoir pressure sensors and receive the signal corresponding to the monitored pressure from the one or more reservoir pressure sensors.

In an embodiment, a system includes an engine; a compressor operatively connected to the engine, wherein the compressor includes a reservoir configured to store compressed air and an unloader valve configured to release pressure from a portion of the compressor; and a controller that is operable to determine a condition of the compressor, wherein the controller is configured to receive a signal corresponding to a monitored pressure of compressed air within the reservoir of the compressor, and detect a leak condition of the compressor through recognition of a change in the monitored pressure of the compressed air within the reservoir during a time period in which an unloader valve is actuated.

In embodiments, a compressor system is disclosed that includes means for monitoring a pressure of compressed air within a reservoir of a compressor (for example, the pressure sensor 185 can monitor the pressure of compressed air within the reservoir of a compressor); means for actuating an unloader valve of the compressor (in an example, the controller 130 can actuate an unloader valve); and means for detecting a leak condition of the compressor through recognition of a change in the monitored pressure of the compressed air within the reservoir during a time period in which the unloader valve is actuated (for example, the detection component 128 can detect a pattern of the monitored pressure of the compressed air during a time period).

In an embodiment, a compressor system is provided that includes a reservoir configured to receive and store compressed air for use with at least one pneumatic device and at least one sensor configured to monitor a pressure of compressed air within the reservoir. The compressor system can include a compressor stage having an exhaust port and an exhaust valve configured to seal the exhaust port, wherein the compressor stage is configured to compress air and discharge the compressed air through the exhaust port into the reservoir. Further, the compressor system can include means for unloading the compressor stage by venting the compressor stage to atmospheric pressure and means for detecting a leak condition of the compressor through recognition of a change in the monitored pressure of the compressed air within the reservoir during a time period in which the means for unloading the compressor stage is actuated.

In the compressor system, the compressor stage can include a cylinder and a piston, wherein the piston is actuated in the cylinder to compress air to be discharged into the reservoir through the exhaust port. In the compressor system, the means for unloading the compressor can include at least one unloader valve. Moreover, in the compressor system the at least one unloader valve can be configured to be cycled between an open position and a closed position during at least a portion of the time period.

In an embodiment of the subject matter described herein, a method (e.g., a method for controlling and/or operating a compressor) is provided that includes the steps of monitoring a crankcase pressure of a first compressor; analyzing the monitored crankcase pressure that includes calculating an average of the crankcase pressure over a time period and comparing the average of the crankcase pressure over the time period to a nominal crankcase average pressure; identifying a condition of the first compressor based on the analysis of the monitored crankcase pressure; and adjusting operation of a second compressor to compensate for the first compressor in response to identifying the condition of the first compressor based on the analysis of the monitored crankcase pressure. (The method may be carried out automatically or otherwise by a controller.)

In one aspect, the condition of the first compressor is identified based on a difference between the calculated crankcase average pressure and the nominal crankcase average pressure.

In one aspect, the nominal crankcase average pressure is based on operating conditions, wherein the operating conditions include at least one of a compressor speed, a reservoir pressure, or an oil temperature.

In one aspect, analyzing the monitored crankcase pressure includes performing a frequency analysis at one or more known frequencies based on a rate at which the first compressor is operated to identify frequency components of the monitored crankcase pressure.

In one aspect, wherein the frequency components are affected by one or more pistons, one or more blow-by conditions, or a breather valve failure.

In one aspect, analyzing the monitored crankcase pressure includes correlating the monitored crankcase pressure with an indication of the position of a piston of the first compressor during a time period in which the piston is operated.

In one aspect, identifying the condition of the first compressor includes at least one of the following: identifying a piston blow-by condition of at least one cylinder of the first compressor based on the analysis of the monitored crankcase pressure, or identifying a crankcase breather valve failure based on the analysis of the monitored crankcase pressure.

In one aspect, the crankcase pressure is monitored while a piston is cycled within a cylinder of the first compressor in at least one of an unloaded condition or in a loaded condition.

In one aspect, monitoring the crankcase pressure of the first compressor includes monitoring the crankcase pressure during a first time period during which a piston is cycled within a cylinder of the first compressor in an unloaded condition, and monitoring the crankcase pressure of the first compressor during a second time period during which the piston is cycled within the cylinder of the first compressor in a loaded condition, and identifying the condition of the first compressor based on the analysis of the monitored crankcase pressure from the first time period and the second time period.

In one aspect, the method also includes scheduling a maintenance operation in response to identifying the condition of the first compressor based on the analysis of the monitored crankcase pressure.

In one aspect, the method also includes notifying personnel with an alert that is generated in response to identifying the condition of the first compressor, the alert including one or more of an audio alarm, a visual alarm, a text message, an email, an instant message, or a phone call.

In one aspect, the method also includes reducing a duty cycle of the first compressor in response to identifying the condition of the first compressor.

In one embodiment of the subject matter described herein, a system comprises a compressor operatively connectable to an engine, wherein the compressor includes a crankcase having a crankcase pressure sensor. The system further comprises a controller having one or more processors and one or more memories that is configured to receive a signal corresponding to a monitored crankcase pressure within the crankcase of the compressor from the crankcase pressure sensor. The controller is further configured to analyze the monitored crankcase pressure, to identify a condition of the compressor based on the analysis of the monitored crankcase pressure, and to generate an alert in response to identifying the condition of the compressor based on the analysis of the monitored crankcase pressure.

In one aspect, the condition of the compressor is at least one of the following: a piston blow-by condition of at least one cylinder of the compressor, or a crankcase breather valve failure.

In one aspect, the controller is configured to communicate with a crankshaft position sensor to identify a position of a piston in a cylinder of the compressor, and the controller is configured to analyze the monitored crankcase pressure based at least in part on the position of the piston.

In one aspect, the controller is configured to automatically reduce a duty cycle of the compressor in response to the condition of the compressor that is identified, such that the compressor is operated at least some time but less than before the condition was identified.

In one aspect, the compressor also includes a reservoir configured to store compressed air, an aftercooler that is configured to change a temperature of air that is delivered to the reservoir via an air line, and a first drain valve coupled to the aftercooler.

In one aspect, the system also includes a check valve in line between the aftercooler and at least one of the air line or the reservoir, wherein the check valve is configured to isolate air pressure within the aftercooler and air pressure within the at least one of the air line or the reservoir. The controller is configured to actuate the check valve to isolate air pressure within the aftercooler and air pressure within the at least one of the air line or the reservoir, and actuate the first drain valve coupled to the aftercooler to enable removal of fluid accumulated within the aftercooler.

In one aspect, the system also includes a filter that is external to the compressor that filters oil used with the engine, wherein the filter is coupled to an external surface of the compressor through a manifold.

In one embodiment of the subject matter described herein, a system comprises a compressor operatively connectable to an engine that includes a reservoir configured to store compressed air, an aftercooler that is configured to change a temperature of air that is delivered to the reservoir via an air line, and a first drain valve coupled to the aftercooler. The system further comprises a check valve in line between the aftercooler and at least one or the air line or the reservoir. The check valve is configured to isolate air pressure within the aftercooler and air pressure within the at least one of the air line or the reservoir. The system further comprises a controller that is configured to actuate the check valve to isolate air pressure within the aftercooler and air pressure within the at least one of the air line or the reservoir; and actuate the first drain valve coupled to the aftercooler to enable removal of fluid accumulated within the aftercooler.

In one embodiment of the subject matter described herein, a method may include monitoring a crankcase pressure of a compressor and analyzing the monitored crankcase pressure. Monitoring the crankcase pressure includes calculating an average of the crankcase pressure over a time period and comparing the average of the crankcase pressure over the time period to a nominal crankcase average pressure. The method includes identifying a condition of a compressor based on the analysis of the monitored pressure and generating an alert and adjusting operation of a second compressor to compensate for the compressor in response to identifying the condition of the compressor based on the analysis of the monitored crankcase pressure.

In one aspect, the condition of the compressor is identified based on a difference between the calculated crankcase average pressure and the nominal crankcase average pressure.

In one aspect, the nominal crankcase average pressure is based on environmental conditions, the environmental conditions including ambient air temperature or ambient air pressure.

In one aspect, the nominal crankcase average pressure is further based on operating conditions, wherein the operating conditions includes at least one of a compressor speed, a reservoir pressure, or an oil temperature.

In one aspect, analyzing the monitored crankcase pressure includes performing a frequency analysis at one or more know frequencies based on a rate at which the compressor is operated to identify frequency components of the monitored crankcase pressure.

In one aspect, the frequency components are affected by one or more pistons, one or more blow-by components, or a breather valve failure.

In one aspect, analyzing the monitored crankcase pressure includes correlating the monitored crankcase pressure with an indication of the position of a piston of the compressor during a time period in which the piston is operated.

In one aspect, identifying the condition of the compressor further includes identifying a condition of a cylinder of the compressor based on a correlation of the monitored crankcase pressure and an indication of the position of the piston in the cylinder of the compressor.

In one aspect, identifying the condition of the compressor includes at least one of the following: identifying a piston blow-by condition of at least one cylinder of the compressor based on the analysis of the monitored crankcase pressure, or identifying a crankcase breather valve failure based on the analysis of the monitored crankcase pressure.

In one aspect, the crankcase pressure is monitored while a piston is cycled within a cylinder of the compressor in at least one of an unloaded condition or in a loaded condition.

In one aspect, monitoring the crankcase pressure of the compressor includes monitoring the crankcase pressure during a first time period during which a piston is cycled within a cylinder of the compressor in an unloaded condition, and monitoring the crankcase pressure of the compressor during a second time period during which the piston is cycled within the cylinder of the compressor in a loaded condition. The condition of the compressor is identified based on the analysis of the monitored crankcase pressure from the first time period and the second time period.

In one aspect, the method includes scheduling a maintenance operation in response to identifying the condition of the compressor based on the analysis of the monitored crankcase pressure.

In one aspect, the method includes notifying personnel with the alert, the alert comprising one or more of an audio alarm, a visual alarm, a text message, an email, an instant message, or a phone call.

In one aspect, the method includes reducing a duty cycle of the compressor in response to identifying the condition of the compressor.

In one embodiment of the subject matter described herein, a controller having a processor and a memory is operable in association with a compressor. The controller is configured to receive a signal corresponding to a monitored crankcase pressure within a crankcase of the compressor. The controller is configured to analyze the monitored crankcase pressure, wherein analysis of the monitored crankcase pressure includes a calculation of an average of the crankcase pressure over a time period and a comparison of the average of the crankcase pressure over the time period to a nominal crankcase average pressure. The controller is configured to identify a condition of the compressor based on the analysis of the monitored crankcase pressure and generate an alert and adjust operation of a second compressor to compensate for the compressor in response to identifying the condition of the compressor based on the analysis of the monitored crankcase pressure.

In one aspect, the condition of the compressor is at least one of a piston blow-by condition of at least one cylinder of the compressor or a crankcase breather valve failure.

In one aspect, the controller is configured to communicate with one or more crankcase pressure sensors and receive the signal corresponding to the monitored crankcase pressure from the one or more crankcase pressure sensors.

In one or more embodiments of the subject matter described herein, a system includes an engine and a compressor operatively connected to the engine. The compressor includes a crankcase having a crankcase pressure sensor and a controller having a processor and a memory. The controller is configured to receive a signal corresponding to a monitored crankcase pressure within the crankcase of the compressor from the crankcase pressure sensor. The controller is also configured to receive a signal corresponding to a monitored crankcase pressure within the crankcase of the compressor from the crankcase pressure sensor. The controller is configured to analyze the monitored crankcase pressure, wherein analysis of the monitored crankcase pressure includes a calculation of an average of the crankcase pressure over a time period and a comparison of the average of the crankcase pressure over the time period to a nominal crankcase average pressure. The controller identifies a condition of the compressor based on the analysis of the monitored crankcase pressure and generates an alert and adjust operation of a second compressor to compensate for the compressor in response to identifying the condition of the compressor based on the analysis of the monitored crankcase pressure.

In one aspect, the condition of the compressor is at least one of a piston blow-by condition of at least one cylinder of the compressor, or a crankcase breather valve failure.

In one aspect, the controller is configured to communicate with a crankshaft position sensor to identify a position of a piston in a cylinder of the compressor, and wherein the controller is configured to analyze the monitored crankcase pressure based at least in part on the position of the piston.

In one aspect, the controller is configured to automatically reduce a duty cycle of the compressor in response to the condition of the compressor that is identified, such that the compressor is operated at least some time but less than before the condition was identified.

In one aspect, the controller is configured to automatically reduce a duty cycle of the compressor in response to the condition of the compressor that is identified, such that the compressor is operated at least some time but less than before the condition was identified.

In one or more embodiments of the subject matter described herein, a method for a compressor includes providing a reservoir configured to store compressed air to be provided to at least one pneumatic device, monitoring a pressure of compressed air within the reservoir, providing a compressor having a first stage to compress air to a first pressure level and having a second stage to pressurize air from the first stage to a second pressure level which is greater than the first pressure level, actuating a piston within a cylinder of the second stage of the compressor, and detecting a leak condition of an exhaust valve of the cylinder based on an analysis of a frequency domain of the monitored pressure of the compressed air within the reservoir during a time period in which the piston is actuated.

In one aspect, detecting a leak condition of the exhaust valve of the cylinder further comprised correlating the monitored pressure of the compressed air within the reservoir with an indication of a position of the piston in the cylinder.

In one aspect, the method includes filling the reservoir with compressed air to a determined pressure value.

In one aspect, the analysis of the frequency domain includes comparing a first frequency component of the monitored pressure based on cycling the piston within the cylinder at a first rate during a first portion of the time period and a second frequency component of the monitored pressure based on cycling the piston within the cylinder at a second rate during a second portion of the time period.

In one aspect, the analysis of the frequency domain is based on a once-per-revolution signature of the monitored pressure, wherein the once-per-revolution signature corresponds to a rate at which the piston is actuated within the cylinder.

In one aspect, actuating the piston within the cylinder comprises cycling the piston within the cylinder in an unloaded condition.

In one aspect, actuating the piston within the cylinder comprises cycling the piston within the cylinder in a loaded condition.

In one aspect, detecting a leak condition of the exhaust valve of the cylinder further comprises recognizing a reduction in the monitored pressure corresponding to a suction stroke of the piston in the cylinder.

In one aspect, detecting a leak condition of the exhaust valve of the cylinder further comprises recognizing an increase in the monitored pressure corresponding to a suction stroke of the piston in the cylinder.

In one aspect, the method includes generating a signal in response to recognizing the change in the monitored pressure of the compressed air within the reservoir during the time period in which the piston is actuated.

In one aspect, the signal is generated for notifying personnel, and the signal comprises one or more of an audio alarm, a visual alarm, a text message, an email, an instant message, or a phone call.

In one aspect, the method includes reducing a duty cycle of the compressor in response to recognizing the change in the monitored pressure of the compressed air within the reservoir during the time period in which the piston is actuated.

In one or more embodiments of the subject matter described herein, a controller that is operable in association with a compressor is configured to receive a signal corresponding to a monitored pressure of compressed air within a reservoir configured to store compressed air to be provided to at least one pneumatic device. The compressed air, from a compressor having a first stage to compress air to a first pressure level and having a second stage to pressurize air from the first stage to a second pressure level which is greater than the first pressure level. The controller is also configured to detect a leak condition of an exhaust valve of a cylinder of the second stage of the compressor based on an analysis of a frequency domain of the monitored pressure of the compressed air within the reservoir during a time period in which a piston is actuated within the cylinder.

In one aspect, the controlled is configured to actuate the piston within the cylinder of the compressor during at least a portion of the time period.

In one aspect, the controller is configured to correlate the signal corresponding to the monitored pressure of the compressed air within the reservoir with an induction of a position of the piston in the cylinder of the compressor.

In one aspect, the controller is configured to actuate the piston within the cylinder of the compressor in an unloaded condition.

In one aspect, the controller is configured to actuate the piston within the cylinder of the compressor in a loaded condition.

In one aspect, the controller is configured to compare a first frequency component based on the monitored pressure of a first portion of the time period with a second frequency component based on the monitored pressure of a second portion of the time period.

In one aspect, the controller is configured to detect the leak condition based on recognizing an increase in the monitored pressure corresponding to a compression stroke of the piston the in cylinder.

In one aspect, the analysis of the frequency domain is based on a once-per-revolution signature of the monitored pressure, wherein the once-per-revolution signature corresponds to a rate at which the piston is actuated within the cylinder.

In one aspect, the controller is configured to communicate with one or more reservoir pressure sensors and receive the signal corresponding to the monitored pressure from the one or more reservoir pressure sensors.

In one or more embodiments of the subject matter described herein, a system includes an engine and a compressor having a first stage to compress air to a first pressure level and having a second stage to pressurize air from the first stage to a second pressure level which is greater than the first pressure level. The compressor is operatively connected to the engine, wherein the compressor includes a reservoir configured to store compressed air to be provided to at least one pneumatic device. The system includes a controller configured to receive a signal corresponding to a monitored pressure of the compressed air within the reservoir, and detect a leak condition of an exhaust valve of a cylinder of the second stage of the compressor based on an analysis of a frequency domain of the monitored pressure of the compressed air within the reservoir during a time period in which a piston is actuated within the cylinder.

In one aspect, the controller is configured to actuate the piston within the cylinder of the compressor during at least a portion of the time period.

In one aspect, the analysis of the frequency domain is based on a once-per-revolution signature of the monitored pressure, wherein the once-per-revolution signature corresponds to a rate at which the piston is actuated within the cylinder In one or more embodiments of the subject matter described herein, a system includes a compressor operatively connected to an engine. The compressor includes a reservoir configured to store compressed air, an aftercooler that is configured to change a temperature of air that is delivered to the reservoir via an air line, and a first drain valve coupled to the aftercooler. The system also includes a check valve in line between the aftercooler and at least one of the air line or the reservoir, wherein the check valve is configured to isolate air pressure within the aftercooler and air pressure within the at least one of the air line or the reservoir. The system also includes a controller that is configured to actuate the check valve to isolate air pressure within the aftercooler and air pressure within the at least one of the air line or the reservoir, and actuate the first drain valve coupled to the aftercooler to enable removal of fluid accumulated within the aftercooler.

In one aspect, the system includes a filter that is external to the compressor that filters oil used with the engine, wherein the filter is coupled to an external surface of the compressor through a manifold.

In one aspect, the manifold further includes a vent pin that enables oil to flow from the filter to the engine.

In one aspect, the vent pin, in a first mode of operation, is configured to restrict a flow of oil from the filter to the engine via an oil vent, and the vent pin, in a second mode of operation, is configured to enable the flow of oil from the filter to the engine via the oil vent.

In one aspect, the manifold further includes a pre-filter port that is configured to be utilized with an external oil pump application that access a portion of oil prior to entering the filter.

In one aspect, the aftercooler is coupled to a high pressure cylinder of the compressor with a single exhaust pipe.

In one aspect, the system includes an intercooler coupled to at least two low pressure cylinders of the compressor and a high pressure cylinder of the compressor.

In one aspect, the system includes an actuation line connecting at least one first unloaded valve of at least one low pressure cylinder of the compressor to at least one second unloader valve of at least one high pressure cylinder of the compressor. The system also includes a drain valve connecting a second drain valve of an intercooler of the compressor to the first drain valve of the aftercooler of the compressor, and a discharge line that is coupled to at least one of the actuation line or the drain line, wherein the discharge line flows to the atmosphere for release thereto.

In one aspect, the controller is configured to actuate the at least one first unloader valve of the at least one low pressure cylinder, the at least one second unloader valve of the at least one high pressure cylinder, the first drain valve of the aftercooler, and the second drain valve of the intercooler at substantially the same time.

In one aspect, the actuation opens each valve to the discharge line for flow to the atmosphere.

In one aspect, the controller is also configured to actuate the check valve and the first drain valve when the compressor is in an unloaded condition.

In one aspect, the controller is also configured to actuate at least one of the check valve or the first drain valve prior to starting of the compressor.

In one aspect, the controller is also configured to determine a cylinder discharge valve leak based upon a flow from at least one of the check valve, the first drain valve, or the second drain valve to the atmosphere.

In one aspect, a propulsion system that includes the system and also includes a crankshaft and a thermal clutch configured to engage the crankshaft to activate a fan for the compressor. The thermal clutch is configured to engage the crankshaft based upon a temperature of an air flow discharge from the compressor.

In one or more embodiments of the subject matter described herein, a system for a compressor includes means for delivering air under pressure to a reservoir, means for changing a temperature of the air that is delivered to the reservoir, means for isolating air pressure within the temperature changing means from air pressure within the reservoir, and means for removing a portion of fluid from the temperature changing means while maintaining air pressure in the reservoir.

In one aspect, the system is deployed on a vehicle and the system also includes a line configured to fluidly couple an outlet of the means for removing to atmosphere external to the vehicle.

In one aspect, the compressor, check valve, and controller are located on board a vehicle, and the system also includes a line that fluidly couples an outlet of the first drain valve to atmosphere external to the vehicle.

In one aspect, the system is deployed on a vehicle and the discharge line flows to the atmosphere external to the vehicle.

In one embodiment of the subject matter described herein, a method includes monitoring a pressure of compressed air within a reservoir that is fluidly connected to a compressor. The method also includes actuating an unloader valve of the compressor by cycling the unloader valve between an open position and a closed position of the unloader valve during a time period. The method also includes correlating the monitored pressure of the compressed air within the reservoir during the time period with the open position of the unloader valve and the closed position of the unloader valve, and detecting a leak condition during the time period by determining a difference between a rate of change of the monitored pressure of the compressed air within the reservoir while the unloader valve is in the open position and a rate of change of the monitored pressure while the unloader valve is in the closed position. The method also includes automatically generating a signal in response to detecting the leak condition to one or more of notify personnel of the leak condition or control the compressor based on the leak condition that is detected.

In one aspect, the method includes filling the reservoir with the compressed air to a determined pressure value.

In one aspect, detecting the leak condition includes detecting a source of the leak condition as a valve of the compressor disposed between the reservoir and the unloader valve.

In one aspect, during the time period, the unloader valve is maintained in the open position for a first duration and is maintained in the closed position for a second duration, wherein the first duration is not equal to the second duration.

In one aspect, actuating the unloader valve of the compressor includes cycling the unloader valve between the open position and the closed position at a known rate during the time period.

In one aspect, actuating the unloader valve of the compressor includes cycling the unloader valve between the open position and the closed position at a first rate during a first portion of the time period and at a second rate during at least a second portion of the time period.

In one aspect, actuating the unloader valve of the compressor includes unloading the compressor.

In one aspect, the signal corresponds to at least one of a severity level of the leak condition or a source of the leak condition.

In one aspect, the signal that is generated is one or more of an audio alarm, a visual alarm, a text message, an email, an instant message, or a phone call.

In one or more embodiments of the subject matter described herein, a controller that is operable in association with a compressor is configured to receive a signal corresponding to a monitored pressure of compressed air within a reservoir that is fluidly connected to the compressor. The controller is configured to actuate an unloader valve of the compressor by cycling the unloader valve between an open position and a closed position of the unloader valve during a time period. The controller is also configured to correlate the monitored pressure of the compressed air within the reservoir during the time period with the open position of the unloader valve and the closed position of the unloader valve, and detect a leak condition during the time period by determining a difference between a rate of change of the monitored pressure of the compressed air within the reservoir while the unloader valve is in the open position and a rate of change in the monitored pressure while the unloader valve is in the closed position. The controller is configured to automatically generate a signal in response to detecting the leak condition to one or more of notify personnel of the leak condition or control the compressor based on the leak condition that is detected.

In one aspect, the controller is also configured to detect a source of the leak condition as a valve of the compressor disposed between the reservoir and the unloader valve.

In one aspect, the controller is also configured to actuate the unloader valve by cycling the unloader valve between the open position and the closed position at a known frequency during the time period.

In one aspect, the controller is also configured to communicate with one or more reservoir pressure sensors and receive the signal corresponding to the monitored pressure from the one or more reservoir pressure sensors.

In one or more embodiments of the subject matter described herein, a system includes an engine, a reservoir configured to store compressed air, and a compressor operatively connected to the engine and fluidly connected to the reservoir. The compressor is configured to supply compressed air to the reservoir. The compressor includes an unloader valve that is configured to release pressure from a portion of the compressor. The system also includes a controller configured to receive a signal corresponding to a monitored pressure of the compressed air within the reservoir, actuate an unloader valve of the compressor by cycling the unloader valve between an open position and a closed position of the unloader valve during a time period, correlate the monitored pressure of the compressed air within the reservoir during the time period with the open position of the unloader valve and the closed position of the unloader valve, detect a leak condition during the time period by determining a difference between a rate of change of the monitored pressure of the compressed air within the reservoir while the unloader valve is in the open position and a rate of change of the monitored pressure while the unloader valve is in the closed position, and automatically generate a signal in response to detecting the leak condition to one or more of notify personnel of the leak condition or control the compressor based on the leak condition that is detected.

In one aspect, the leak condition is detected responsive to a decrease in the monitored pressure of the compressed air within the reservoir occurring while the unloader valve is in the open position.

In one aspect, the leak condition of the valve of the compressor disposed between the reservoir and the unloader valve is detected responsive to the monitored pressure of the compressed air decreasing a greater extent while the unloader valve is in the open position than while the unloader valve is in the closed position.

In one aspect, the controller is also configured to detect the leak condition responsive to a decrease in the monitored pressure of the compressed air within the reservoir occurring while the unloader valve is in the open position.

In one aspect, the controller is also configured to detect the leak condition of a valve of the compressor disposed between the reservoir and the unloader valve responsive to the monitored pressure of the compressed air decreasing a greater extent while the unloader valve is in the open position than while the unloader valve is in the closed position.

In one aspect, the controller is also configured to detect the leak condition responsive to a decrease in the monitored pressure of the compressed air within the reservoir occurring while the unloader valve is in the open position.

In one aspect, the controller is also configured to detect the leak condition responsive to the monitored pressure of the compressed air decreasing a greater extend while the unloader valve is in the open position than while the unloader valve is in the closed position.

In one aspect, detecting the leak condition includes detecting a source of the leak condition as being other than the compressor responsive to the monitored pressure of the compressed air decreasing by a non-zero amount that is the same while the unloader valve is in the open position as while the unloader valve is in the closed position.

In one aspect, the leak condition is not detected responsive to the monitored pressure of the compressed air remaining constant without decreasing while the unloader valve is in the open position and while the unloader valve is in the closed position.

In one aspect, the compressor is controlled by one or more of reducing a duty cycle of the compressor of ceasing operation of the compressor in response to detecting the leak condition.

In one aspect, the controller is configured to detect a source of the leak condition as being other than the compressor responsive to the monitored pressure of the compressed air decreasing by a non-zero amount that is the same while the unloader valve is in the open position as while the unloader valve is in the closed position.

In one aspect, the controller is also configured to generate the signal as one or more of an audio alarm, a visual alarm, a text message, an email, an instant message, or a phone call.

As used herein, the terms "high-pressure" and "low pressure" are relative to one another, that is, a high-pressure is higher than a low pressure, and a low pressure is lower than a high-pressure. In an air compressor, low pressure may refer to a pressure that is higher than atmospheric pressure, but that is lower than another, higher pressure in the compressor. For example, air at atmospheric pressure may be compressed to a first, low pressure (which is still higher than atmospheric pressure), and further compressed, from the first, low pressure, to a second, high-pressure that is higher than the low pressure. An example of a high-pressure in a rail vehicle context is 140 psi (965 kPa).

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the invention, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A method comprising:

determining a time period for monitoring a crankcase pressure of a first compressor over plural cycles of the first compressor;

monitoring the crankcase pressure of the first compressor;

analyzing the monitored crankcase pressure by calculating an average of the crankcase pressure over the time period and comparing the average of the crankcase pressure over the time period to a nominal crankcase average pressure, wherein the average of the crankcase pressure is based at least on a position of a piston of the first compressor;

identifying a condition of the first compressor based on comparing the average of the crankcase pressure to the nominal crankcase average pressure; and adjusting operation of a second compressor to compensate for the first compressor in response to identifying the condition of the first compressor.

2. The method of claim 1, wherein the condition of the first compressor is identified based on a difference between the calculated crankcase average pressure and the nominal crankcase average pressure.

3. The method of claim 1, wherein the nominal crankcase average pressure is based on operating conditions, wherein the operating conditions include at least one of a compressor speed, a reservoir pressure, or an oil temperature.

4. The method of claim 1, wherein analyzing the monitored crankcase pressure includes performing a frequency analysis at one or more known frequencies based on a rate at which the first compressor is operated to identify frequency components of the monitored crankcase pressure.

5. The method of claim 4, wherein the frequency components are affected by one or more pistons, one or more blow-by conditions, or a breather valve failure.

6. The method of claim 1, wherein analyzing the monitored crankcase pressure comprises correlating the monitored crankcase pressure with an indication of the position of the piston of the first compressor during a time period in which the piston is operated.

7. The method of claim 1, wherein identifying the condition of the first compressor comprises at least one of the following:

identifying a piston blow-by condition of at least one cylinder of the first compressor; or identifying a crankcase breather valve failure.

8. The method of claim 1, wherein the crankcase pressure is monitored while a piston is cycled within a cylinder of the first compressor in at least one of an unloaded condition or in a loaded condition.

9. The method of claim 1, wherein:

monitoring the crankcase pressure of the first compressor comprises: monitoring the crankcase pressure during a first time period during which a piston is cycled within a cylinder of the first compressor in an unloaded condition; and monitoring the crankcase pressure of the first compressor during a second time period during which the piston is cycled within the cylinder of the first compressor in a loaded condition; and identifying the condition of the first compressor based on comparing the monitored crankcase pressure from the first time period and the second time period.

10. The method of claim 1, further comprising scheduling a maintenance operation in response to identifying the condition of the first compressor.

11. The method of claim 1, further comprising notifying personnel with an alert that is generated in response to identifying the condition of the first compressor, the alert comprising one or more of an audio alarm, a visual alarm, a text message, an email, an instant message, or a phone call.

12. The method of claim 1, further comprising reducing a duty cycle of the first compressor in response to identifying the condition of the first compressor.

13. A system, comprising:

a first compressor comprising a controller and operatively connectable to an engine, the controller having one or more processors and one or more memories, the controller programmed to:

determine a time period for monitoring a crankcase pressure of the first compressor over plural cycles of the first compressor;

receive a signal corresponding to the monitored crankcase pressure within a crankcase of the first compressor from a crankcase pressure sensor;

analyze the monitored crankcase pressure, wherein analysis of the monitored crankcase pressure includes a calculation of an average of the crankcase pressure over a time period and a comparison of the average of the crankcase pressure over the time period to a nominal crankcase average pressure, wherein the average of the crankcase pressure is based at least on a position of a piston of the first compressor;

identify a condition of the first compressor based on the analysis of the monitored crankcase pressure;

adjust operation of a second compressor to compensate for the first compressor in response to identifying the condition of the first compressor; and generate an alert in response to identifying the condition of the first compressor based on the analysis of the monitored crankcase pressure.

14. The system of claim 13, wherein the condition of the first compressor is at least one of the following:

a piston blow-by condition of at least one cylinder of the first compressor; or a crankcase breather valve failure.

15. The system of claim 13, wherein the controller is further configured to communicate with a crankshaft position sensor to identify the position of the piston in a cylinder of the first compressor, and wherein the controller is configured to analyze the monitored crankcase pressure based at least in part on the position of the piston.

16. The system of claim 13, wherein the controller is further configured to automatically reduce a duty cycle of the first compressor in response to the condition of the first compressor that is identified, such that the first compressor is operated at least some time but less than before the condition was identified.

17. The system of claim 13, wherein the first compressor further comprises a reservoir configured to store compressed air, an aftercooler that is configured to change a temperature of air that is delivered to the reservoir via an air line, and a first drain valve coupled to the aftercooler.

18. The system of claim 17, further comprising a check valve in line between the aftercooler and at least one of the air line or the reservoir, wherein the check valve is configured to isolate air pressure within the aftercooler and air pressure within the at least one of the air line or the reservoir, wherein the controller is configured to:

actuate the check valve to isolate air pressure within the aftercooler and air pressure within the at least one of the air line or reservoir; and actuate the first drain valve coupled to the aftercooler to enable removal of fluid accumulated within the aftercooler.

19. The system of claim 17, further comprising a filter that is external to the first compressor that filters oil used with the engine, wherein the filter is coupled to an external surface of the first compressor through a manifold.

* * * * *